US011653781B2

(12) United States Patent
Miller

(10) Patent No.: US 11,653,781 B2
(45) Date of Patent: May 23, 2023

(54) SAFE "4U" MAILBOX

(71) Applicant: Sheila Roxann Miller, Stone Mountain, GA (US)

(72) Inventor: Sheila Roxann Miller, Stone Mountain, GA (US)

(73) Assignee: Sheila R. Miller, Stone Mountain, GA (US)

( * ) Notice: Subject to any disclaimer, the term of this patent is extended or adjusted under 35 U.S.C. 154(b) by 0 days.

(21) Appl. No.: 17/300,472

(22) Filed: Jul. 13, 2021

(65) Prior Publication Data

US 2023/0014387 A1 Jan. 19, 2023

(51) Int. Cl.

| | |
|---|---|
| ***A47G 29/12*** | (2006.01) |
| ***A47G 29/122*** | (2006.01) |
| ***A47G 29/30*** | (2006.01) |

(52) U.S. Cl.

CPC ..... *A47G 29/12095* (2017.08); *A47G 29/122* (2013.01); *A47G 29/1203* (2013.01); *A47G 29/12097* (2017.08); *A47G 29/30* (2013.01)

(58) Field of Classification Search

CPC ..... A47G 29/12095; A47G 29/12097; A47G 29/1203; A47G 29/122; A47G 29/1216; A47G 29/124; A47G 29/1209; A47G 29/16; A47G 29/30; A47G 29/20; A47G 2029/148; A47G 29/1207

USPC ..... 232/17, 45, 39, 29–32, 20, 21

See application file for complete search history.

(56) References Cited

U.S. PATENT DOCUMENTS

| | | | | | |
|---|---|---|---|---|---|
| 378,955 | A * | 3/1888 | Dubey | A47G 29/1207 | 193/8 |
| 461,381 | A * | 10/1891 | Richter | A47G 29/1207 | 383/34 |
| 1,027,524 | A * | 5/1912 | Cook | A47G 29/1207 | 383/22 |
| 1,256,044 | A * | 2/1918 | Schilling | A47G 29/1207 | 232/31 |
| 1,451,343 | A * | 4/1923 | Panagopolous | A47G 29/1207 | 383/7 |
| 2,421,221 | A * | 5/1947 | Rothe | B07C 7/04 | 232/30 |
| 4,363,438 | A * | 12/1982 | Connor | A47G 29/1207 | 232/38 |
| 4,844,332 | A * | 7/1989 | Long | A47G 29/12095 | 232/17 |
| 6,299,061 | B1 * | 10/2001 | Henson | A47G 29/22 | 232/39 |
| 7,040,529 | B2 * | 5/2006 | Swider | G01N 1/2226 | 232/30 |

(Continued)

*Primary Examiner* — William L Miller

(57) ABSTRACT

A security mailbox system known as the "Safe "4U" Mailbox", fully enclosed mailbox which is constructed from some sort of plastic, metal, fabricated material, or some sort of environmentally friendly material. The "Safe "4U" Mailbox" is easy to install and environmentally friendly, the mailbox includes chambers for incoming mail being delivered and pick-up for outgoing mail; a slot for newspapers/advertisements on side of mailbox. Incoming mail chamber is designed for mail to go into secure basket for pick-up from rear by homeowner. Outgoing mail can be placed from the real of mailbox for pick-up by postal worker. Mailbox is cemented into the ground though poles that extend from bottom of mailbox.

7 Claims, 16 Drawing Sheets

(56) References Cited

U.S. PATENT DOCUMENTS

| | | | | |
|---|---|---|---|---|
| 7,175,068 | B2 * | 2/2007 | Fitzgibbons | A47G 29/1207 232/30 |
| 7,210,616 | B1 * | 5/2007 | Van Watermulen | A47G 29/12097 232/29 |
| 7,487,907 | B2 * | 2/2009 | Miller | A47G 29/12095 232/27 |
| 9,554,646 | B1 * | 1/2017 | Charette | B01L 3/50853 |
| 10,376,084 | B2 * | 8/2019 | Hempsch | A47G 29/12 |
| 11,206,940 | B2 * | 12/2021 | Kaechele | A47G 29/30 |
| 2003/0127505 | A1 * | 7/2003 | Avant | A47G 29/1207 232/30 |
| 2003/0168505 | A1 * | 9/2003 | Felice | A47G 29/22 232/28 |
| 2003/0222132 | A1 * | 12/2003 | Esakov | A47G 29/1207 232/30 |
| 2005/0247772 | A1 * | 11/2005 | Miller | A47G 29/12095 232/45 |
| 2009/0014509 | A1 * | 1/2009 | Miller | A47G 29/1203 232/31 |

* cited by examiner

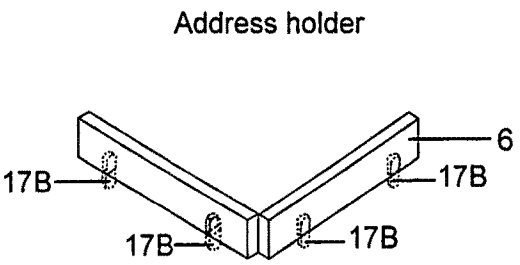
FIG. 5A
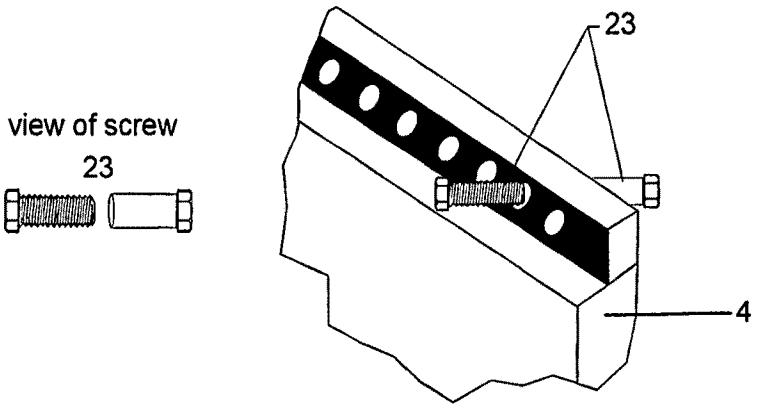
FIG. 5C
FIG. 5
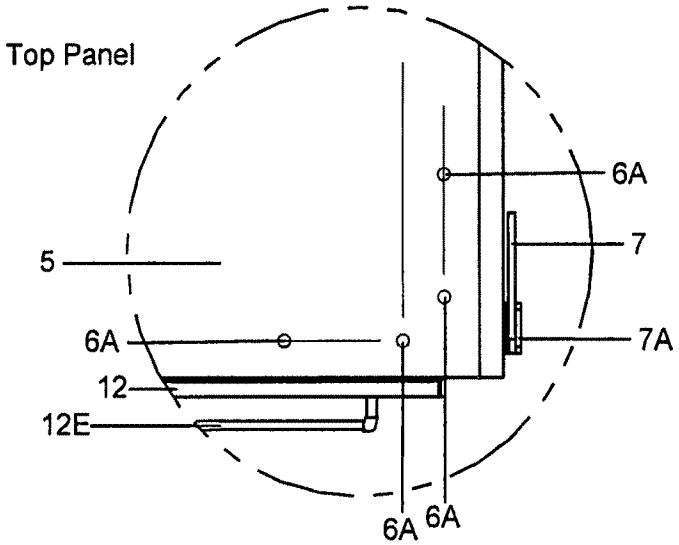
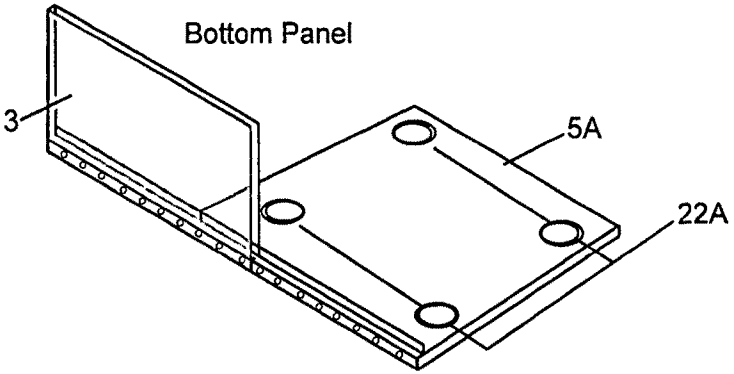
FIG. 5B

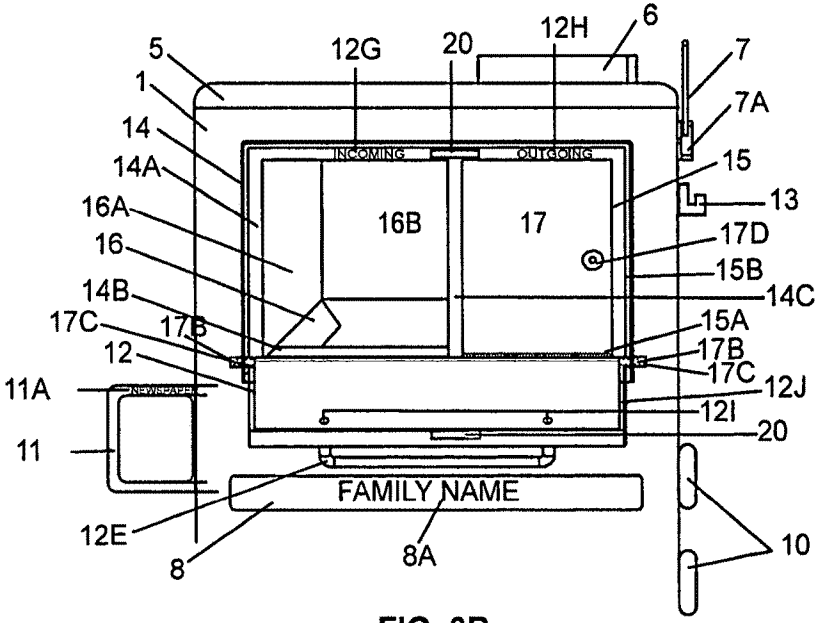
FIG. 6B
FIG. 6
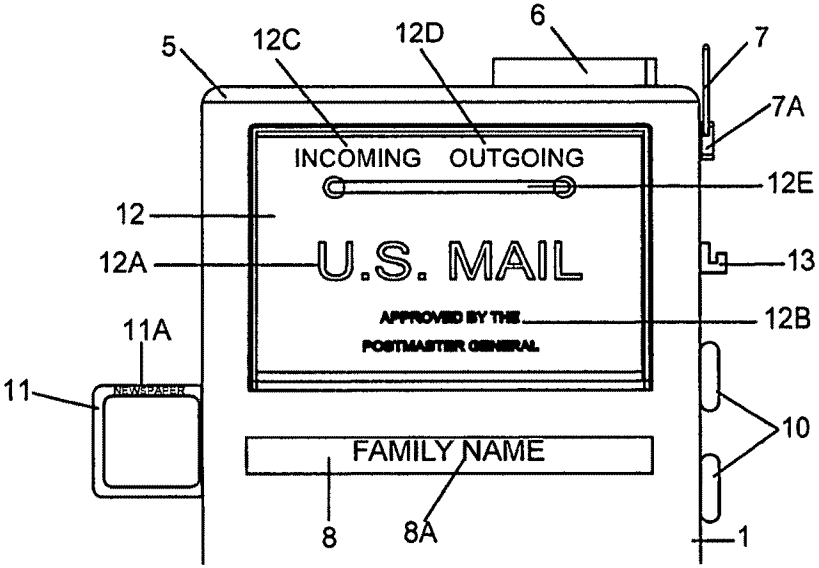
FIG. 6A

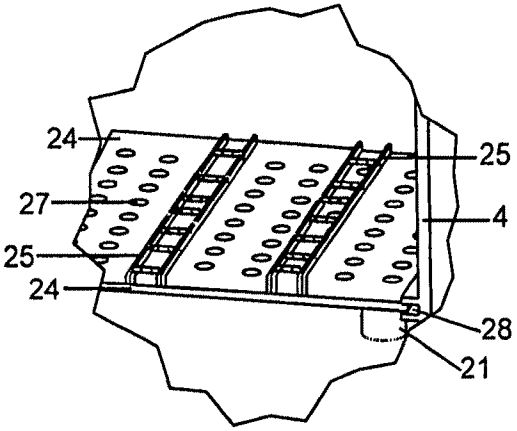
FIG. 10C
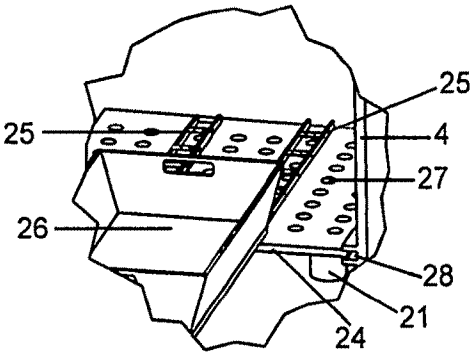
FIG. 10D
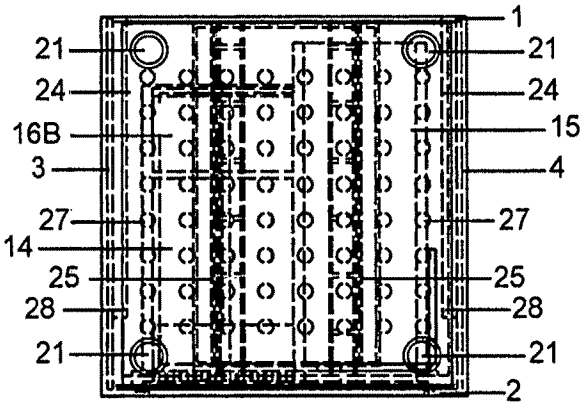
FIG. 10A
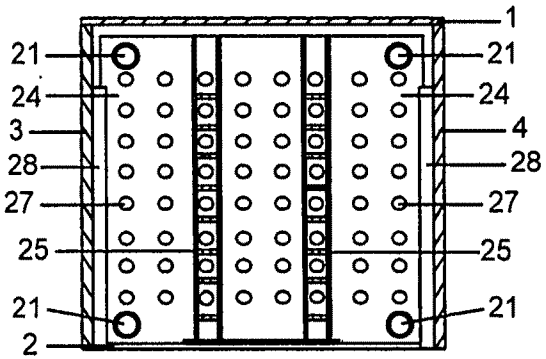
FIG. 10B
FIG. 10

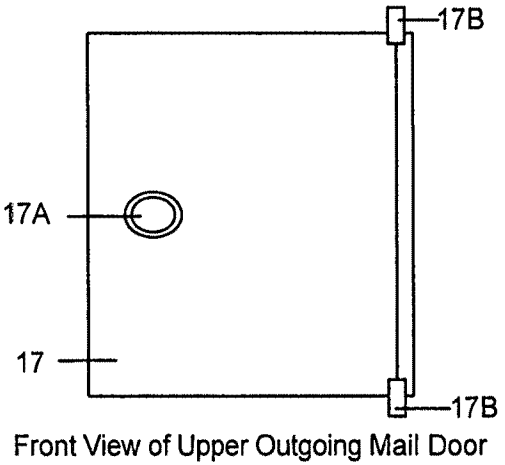
Front View of Upper Outgoing Mail Door
FIG. 12B
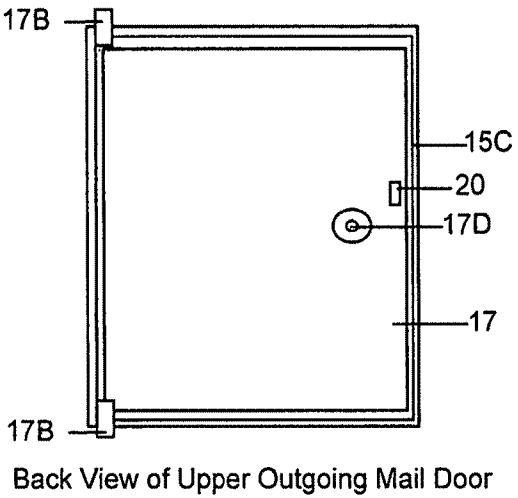
Back View of Upper Outgoing Mail Door
FIG. 12C
FIG. 12
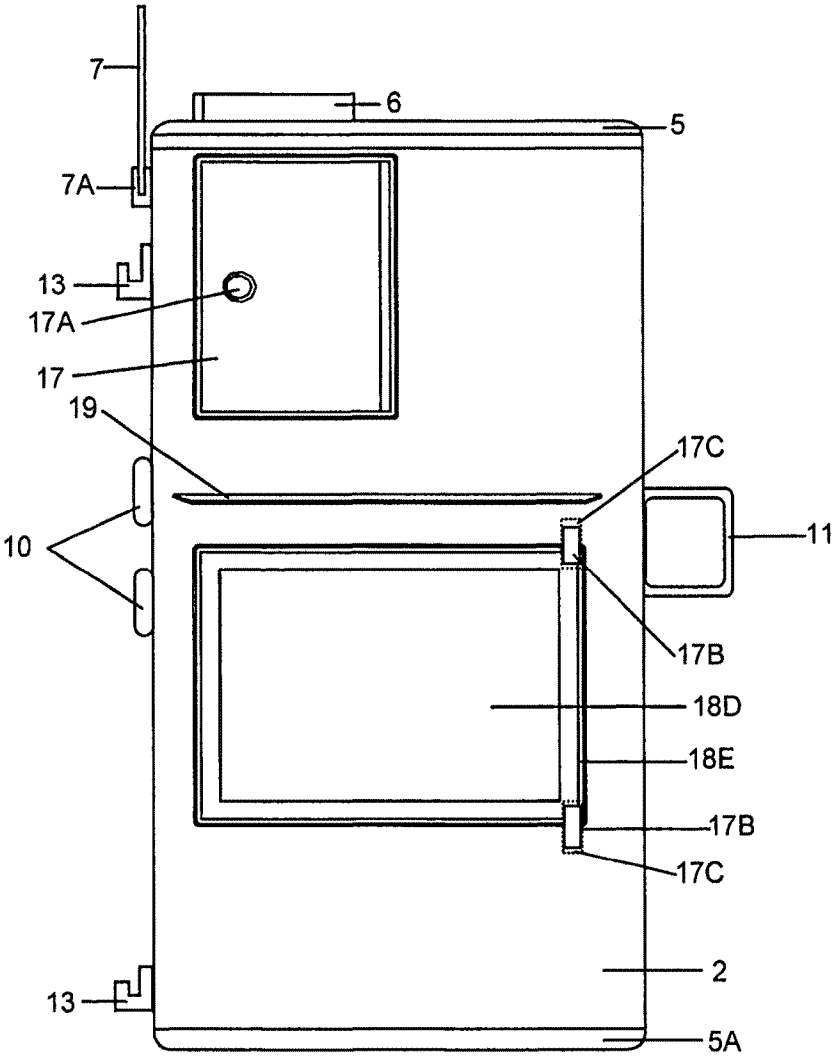
FIG. 12A

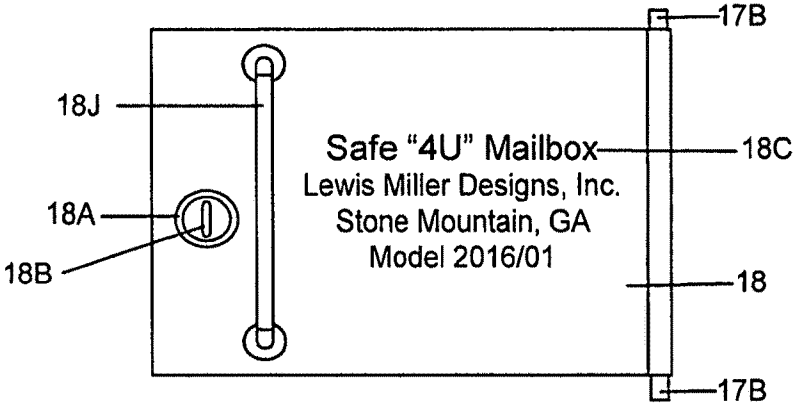
Front View of lower Secure Door
FIG. 13B
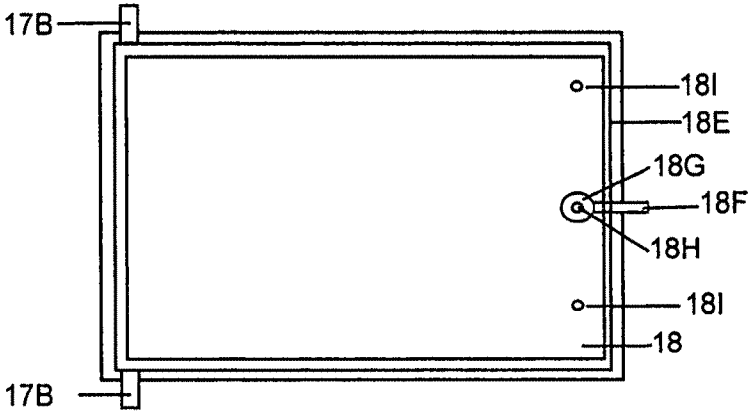
Rear View of Lower Secure Door
FIG. 13C
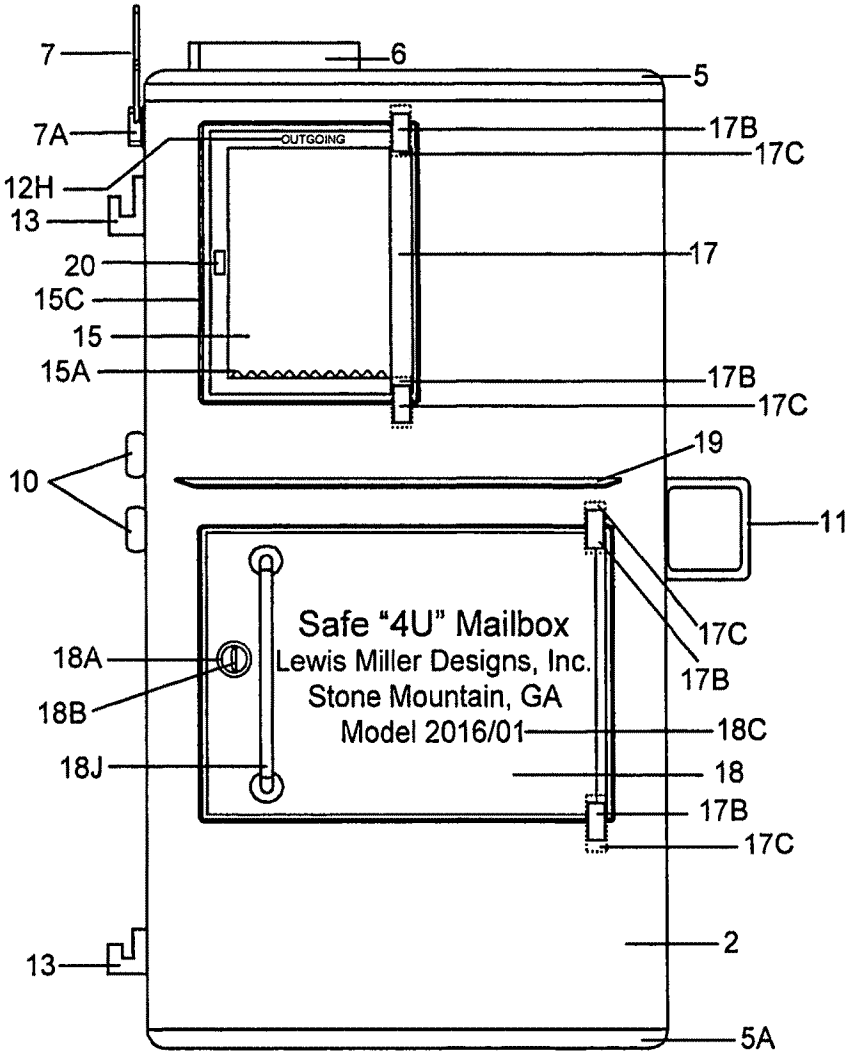
FIG. 13A
FIG. 13

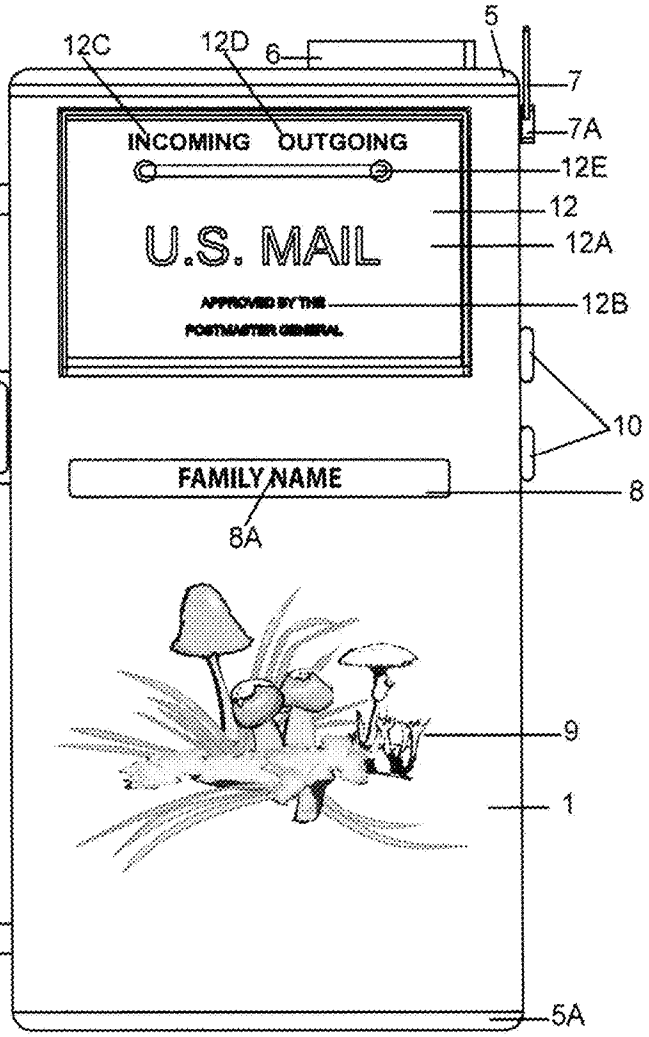
FIG. 14B
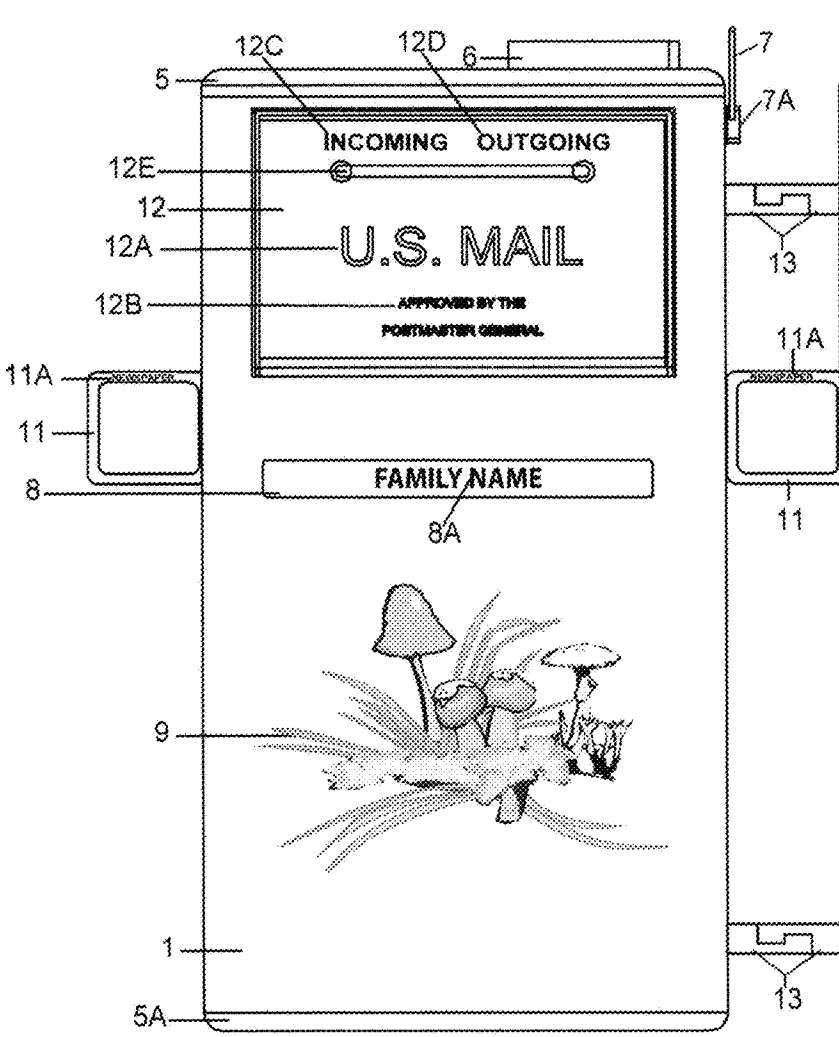
FIG. 14A
FIG. 14

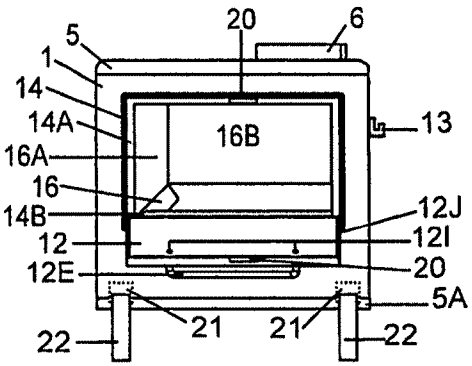
FIG. 16B
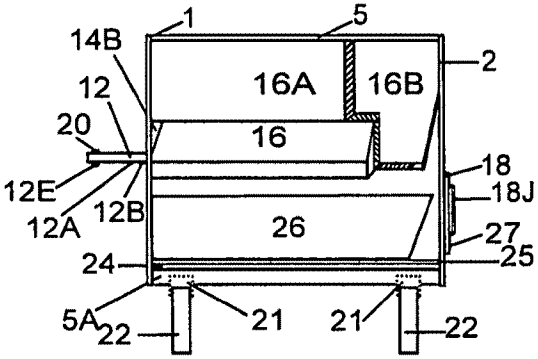
FIG. 16C
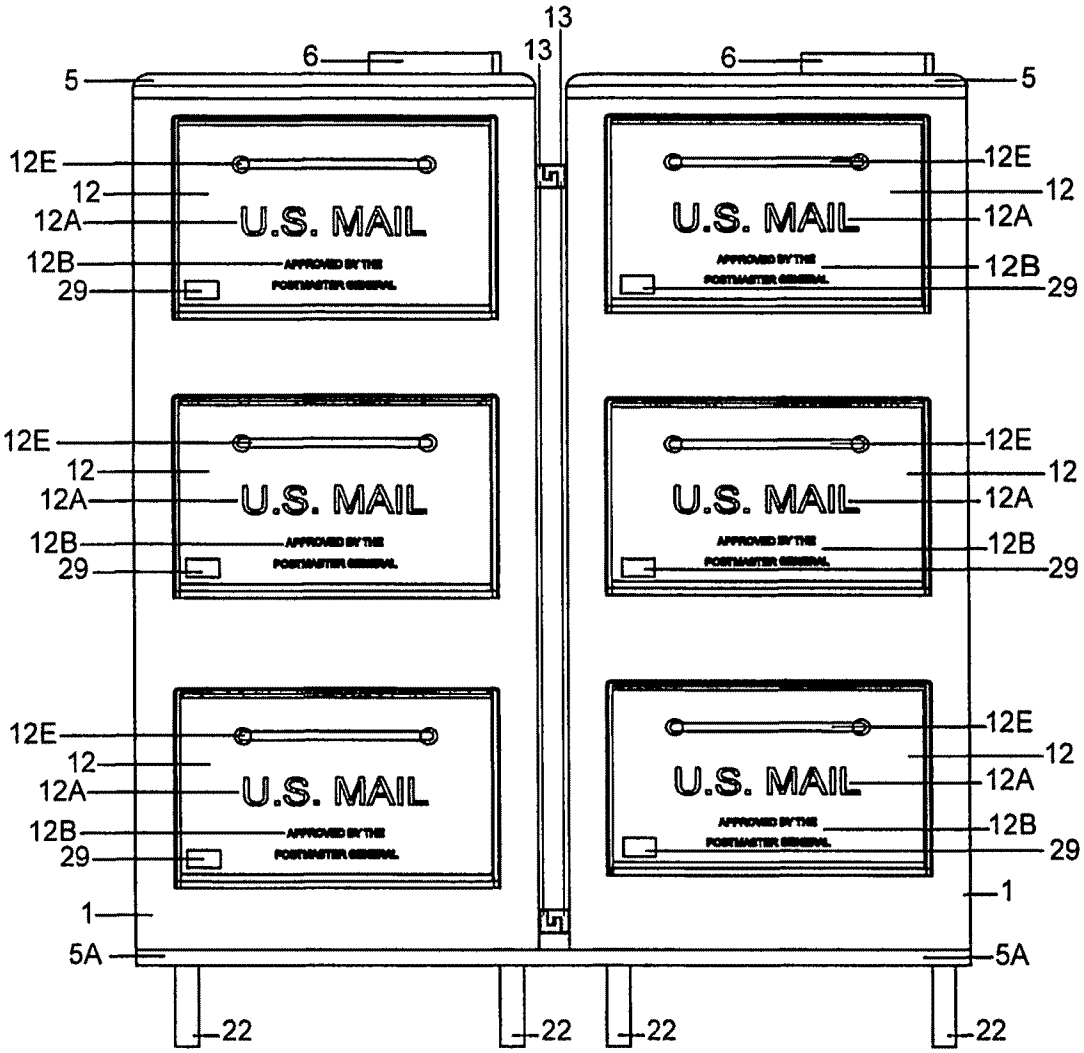
FIG. 16A
FIG. 16

SAFE "4U" MAILBOX

REFERENCES CITED [REFERENCED BY]

U.S. Patent Documents

| | | |
|---|---|---|
| 378,955 | March 1888 | Dubey |
| 461,381 | October 1891 | Richter |
| 1,027,524 | May 1912 | Cook |
| 1,256,044 | February 1918 | Schilling |
| 1,451,343 | April 1923 | Panagopolous |
| 2,421,221 | May 1947 | Rothe |
| 4,363,438 | December 1982 | Connor |
| 2005/0247772 | November 2005 | Miller |
| 7,040,529 | May 2006 | Swider et al |
| 7,487,907 | February 2009 | Miller |

REFERENCES CITED [REFERENCED BY]

"Not Applicable"

STATEMENT REGARDING FEDERALLY SPONSORED RESEARCH OR DEVELOPMENT

"Not Applicable"

THE NAMES OF THE PARTIES TO A JOINT RESEARCH AGREEMENT

"Not Applicable"

INCORPORATION-BY-REFERENCE OF MATERIAL SUBMITTED ON A COMPACT DISC

"Not Applicable"

REFERENCE TO A "MICROFICHE APPENDIX"

"Not Applicable"

BACKGROUND OF THE INVENTION

1. Field of the Invention

This invention relates to the field of mailboxes, in the category of receptacles in general mailboxes, however more particular in the security mailbox arena. Mailboxes generally are of two types, urban mailbox and rural mailbox; multiple types are contained within this patent application.

2. Description of Related Art

The proximity of the rural mailboxes to the street allows the mail carrier to deposit/retrieve mail in the rural mailbox without sometimes getting out of their vehicles. Unfortunately, the fact that the single door to the typical rural mailbox faces the road means that the homeowner has to either step into the street or reach around the mailbox to send or retrieve their mail. This creates hazardous conditions for the homeowner and the Postal worker. For the Postal worker has to get out of their vehicle to deliver packages, which could involve roadside/curbside accidents, work related injuries and even death for the Postal workers and homeowners alike.

By virtue of this design, the "Safe "4U" Mailbox", along with modification/resizing of parts to accommodate city, rural, condos and multi-family dwellings will be known as "Safe "4U" Multi-Mailbox", "Safe "4U" Residential Mailbox", and "Safe "4U apartments/sub-divisions/condos Mailboxes", which helps secure incoming mail/small packages and create uniformity of mailboxes in all areas. The basic design allows for rear secure access panel making easy access for people with disabilities, elderly, handicap and everyday homeowners to retrieve their mail safely. This design has safety in mind for everyone, making this mailbox safer than the standard curbside mailboxes currently on the market today.

The aspects of each design are shown within the accompanying drawings.

BRIEF SUMMARY OF THE INVENTION

By virtue of this Design, the homeowner doesn't ever have step into the street again to send or retrieve incoming mail/small packages. The unit has a security keylock system in rear of the mailbox to keep incoming mail/small packages secure for pick-up.

The unit is fully functional, sturdy, durable, easy to install, which makes the "Safe "4U" Mailbox", "Safe "4U" Multi-Mailbox", "Safe "4U" Residential Mailbox", and "Safe "4U apartments/sub-divisions/condos Mailboxes" more efficient than mailboxes currently used today. Most curbside mailboxes don't have a way of securing incoming mail/small packages that don't fit into mailboxes are often left on homeowners' steps, front porches, etc., by postal workers making it easy for vandals to steal packages and personal information used in Identity theft.

This stand-alone mailbox can be constructed from some sort of plastic, metal, fabricated material, or environmentally friendly material that's weather resistant and sturdy. The unit is held together with some sort of tamper resistant screws, threaded screws, fasteners, bolts, and/or rivets, and some sort of heavy-duty adhesive, which by design will be secure and safer for homeowners. The "Safe "4U" Mailbox" can remain as designed, or enclosed with bricks if the homeowner prefers. Either way, this stand-alone unit will secure homeowners incoming mail/small packages, lowing the risk to homeowners and postal workers alike from related injuries and/or depth, and possibility helps the U.S. Postal Service lower their cost on Identity theft cases.

BRIEF DESCRIPTION OF THE SEVERAL VIEWS OF THE DRAWINGS

FIG. 5: Depicts 3 views of "Safe "4U" Mailbox" consisting of:

FIG. 5A: Interlocking top panel (5), Address mount holes (6A), Flag (7), Flag assembly (7A), Address holder (6), Top view of incoming/outgoing mail door (12), Top view of horizontal handle (12E), Pegs to secure address holder on top of mailbox (17B).

FIG. 5B: Portion of left interlocking panel (3), Interlocking base plate with cut-outs for poles (5A), Plastic/rubber seals that attaches to poles (22A).

FIG. 5C: Portion of right interlocking panel (4), Tamper resistant screws, threaded screws, fasteners, bolts, and/or rivets and placement (23).

FIG. 6: Portion of sections for incoming/outgoing chambers of the "Safe "4U" Mailbox", one with incoming/outgoing door closed, one with incoming/outgoing door open, consisting of:

FIG. 6A: Front interlocking panel (1), Interlocking top panel (5), Address holder (6), Flag (7), Flag assembly (7A), Homeowners nameplate (8), Lettering for homeowners name (8A), Reflectors (10), Newspaper sleeve (11), Lettering for newspaper sleeve (11A), Incoming/outgoing mail door (12), Lettering on front of incoming/outgoing door indicating U.S. Mail (12A), Lettering on front of incoming/outgoing door indicating Approved by the Postmaster General (12B), Lettering on front of incoming/outgoing door indicating incoming mail (12C), Lettering on front of incoming/outgoing door indicating outgoing mail (12D), Horizontal handle (12E), Interlocking hinges (13).

FIG. 6B: Front interlocking panel (1), Interlocking top panel (5), Address holder (6), Flag (7), Flag assembly (7A), Homeowners nameplate (8), Lettering for homeowners name (8A), Reflectors (10), Newspaper sleeve (11), Lettering for newspaper sleeve (11A), Incoming/outgoing mail door open (12), Horizontal handle (12E), Lettering on inside of incoming/outgoing compartments indicating incoming mail slot (12G), lettering on inside compartments indicating outgoing mail slot (12H), Pre-drilled holes for horizontal handle (12I), Trim inside incoming/outgoing door (12J), Interlocking hinges (13), Housing unit for incoming/outgoing mail compartments (14), Compartment for incoming mail (14A), Lip of incoming mail compartment (14B), Compartment divider (14C), Compartment for outgoing mail (15), Ribbed floor of outgoing mail compartment (15A), Trim for incoming/outgoing mail compartments (15B), Angled chute (16), Inside panel on incoming mail compartment (16A), Bumper board (16B), Rear view of upper outgoing mail door (17), Pegs (17B), Peg housing (17C), Standard screw for upper outgoing mail door (17D), Magnets (20).

FIG. 10: Depicts four views of the "Safe "4U" Mailbox" pegboard without basket and basket pulled out consisting of:

FIG. 10A: Bottom of front panel (1), Bottom of rear panel (2), Bottom of left panel (3), Bottom of right panel (4), Bottom view of incoming chamber (14A), Bottom view of outgoing compartment (15), Bottom view of bumper board (16B), Couplings (21), Bottom view peg board (24), Bottom view of railing system (25), Bottom view of circular cut-out holes (27), Bottom view of side rails (28).

FIG. 10B: Seam of front panel (1), Seam of rear panel (2), Seam of left panel (3), Seam of right panel (4), Couplings (21), Peg board (24), Railing system (25), Circular cut-out holes (27), Side rails (28).

FIG. 10C: Portion of right panel (4), Couplings (21), Peg board (24), Railing system (25), Circular cut-out holes (27), Side Rails (28).

FIG. 10D: Portion of right panel (4), Couplings (21), Peg board (24), Railing system (25), Basket (26), Circular cut-out holes (27), Side Rails (28).

FIG. 12: "Safe 4U" Mailbox", rear upper front/back of mail door views consisting of:

FIG. 12A: Rear view of "Safe 4U Mailbox". Rear interlocking panel (2), Interlocking top panel (5), Rearview of Interlocking base plate (5A), Rearview of Address holder (6), Sideview of flag (7), Sideview of flag assembly (7A), Sideview of reflectors (10), Rearview of Newspaper sleeve (11), Sideview of interlocking hinges (13), Upper outgoing mail door (17), Rear upper mail door knob (17A), Pegs (17B), Peg sleeves (17C), Lower secure compartment, (18D), Trim around secure compartment (18K), Awning (19).

FIG. 12B: Front view of upper outgoing mail door of "Safe 4U Mailbox". Upper outgoing mail door (17), Upper outgoing mail door knob (17A), Pegs (17B).

FIG. 12C: Reverse view of upper outgoing mail door of "Safe 4U Mailbox". Trim around upper outgoing mail door (15C), Upper outgoing mail door (17), Pegs (17B), standard screw (17D), Magnet (20).

FIG. 13: "Safe 4U" Mailbox", with front/back lower secure mail door views consisting of:

FIG. 13A: Rear view of "Safe 4U Mailbox"; with lower secure door. Rear interlocking panel (2), Rearview of Interlocking top panel (5), Rearview of Interlocking base plate (5A), Rearview of Address holder (6), Sideview of flag (7), Sideview of flag assembly (7A), Sideview of reflectors (10), Rearview of Newspaper holder (11), Lettering indicating outgoing mail (12H), Sideview of interlocking hinges (13), Outgoing mail compartment (15), Ribbed floor on outgoing mail compartment (15A), Trim around outgoing mail compartment (15C), Upper outgoing mail door open (17), Pegs (17B), Peg sleeves (17C), Lower secure door (18), Security mount (18A), Key slot (18B), Manufacturing ID (18C), Vertical handle (18J), Awning (19), Magnet (20).

FIG. 13B: Front lower secure door of "Safe 4U Mailbox". Pegs for lower secure door (17B), Lower secure door (18), Security mount (18A), Key slot (18B), Manufacturing ID (18C), Vertical handle (18J).

FIG. 13C: Reverse view of lower secure door of "Safe 4U Mailbox". Pegs (17B), Lower secure door (18), Trim around lower secure door (18E), Latch (18F), Rearview of secure key mount (18G), Standard screw for lower secure door rear (18H), Pre-drilled holes for vertical handle (18I).

FIG. 14: Attachments for multi-dwellings/units for "Safe 4U" Mailbox", consisting of:

FIG. 14A: Front interlocking panel (1), Interlocking top panel (5), Interlocking base plate (5A), Address holder (6), Flag (7), Flag assembly (7A), Homeowners nameplate (8), Lettering for homeowners name (8A), Design element (9), Newspaper holder (11), Lettering for newspaper sleeve (11A), Incoming/outgoing mail door (12), Lettering on front of mail door indicating U.S. Mail (12A), Lettering on front of mail door indicating Approved by the Postmaster General (12B), Lettering on front of mail door indicating incoming mail (12C), Lettering on front of mail door indicating outgoing mail (12D), Horizontal handle (12E), Interlocking hinges (13).

FIG. 14B: Front interlocking panel (1), Interlocking top panel (5), Interlocking base plate (5A), Address holder (6), Flag (7), Flag assembly (7A), Homeowners nameplate (8), Lettering for homeowners name (8A), Design element (9), Reflectors (10), Newspaper holder (11), Lettering for newspaper sleeve (11A), Incoming/outgoing mail door (12), Lettering on front of mail door indicating U.S. Mail (12A), Lettering on front of mail door indicating Approved by the Postmaster General (12B), Lettering on front of mail door indicating incoming mail (12C), Lettering on front of mail door indicating outgoing mail (12D), Horizontal handle (12E), Interlocking hinges (13).

FIG. 16: Depicts "Safe 4U" Mailbox", for Apartments/Sub-divisions/Condos in three figures consisting of:

FIG. 16A: Front interlocking panel (1), Interlocking top panel (5), Interlocking base plate (5A), Address holder (6), Incoming mail door (12), Lettering on front of mail door indicating U.S. Mail (12A), Lettering indicating Approved by the Postmaster General (12B), Horizontal handle (12E), Interlocking hinges (13), Poles (22), Number identifier for apartments/sub-divisions/condos (29).

FIG. 16B: Front interlocking panel (1), Interlocking top panel (5), Interlocking base plate (5A), Address holder (6), Incoming mail door open (12), Horizontal handle for door (12E), Pre-drilled holes for horizontal handle (12I), Trim (12J), Interlocking hinge (13), Housing unit for incoming mail compartments (14), Compartment for incoming mail (14A), Lip of incoming mail compartment (14B), Angle chute (16), Inside panel on incoming mail compartment (16A), Bumper board (16B), Magnets (20), Couplings 21, Poles (22).

FIG. 16C: Front interlocking panel (1), Rear interlocking panel (2), Interlocking top panel (5), Interlocking base plate (5A), Incoming mail door open (12), Sideview of lettering on front of mail door indicating U.S. Mail (12A), Sideview of lettering indicating Approved by the Postmaster General (12B), Sideview of horizontal handle (12E), Lip of incoming mail compartment (14B), Angle chute (16), Inside panel on incoming mail compartment (16A), Bumper board (16B), Lower secure door (18), Vertical handle (18J), Magnets (20), Couplings 21, Poles (22), Peg board (24), Railing system (25), Basket (26), Number identifier for apartments/subdivisions/condos (29).

DETAILED DESCRIPTION OF INVENTION

Figure 1:
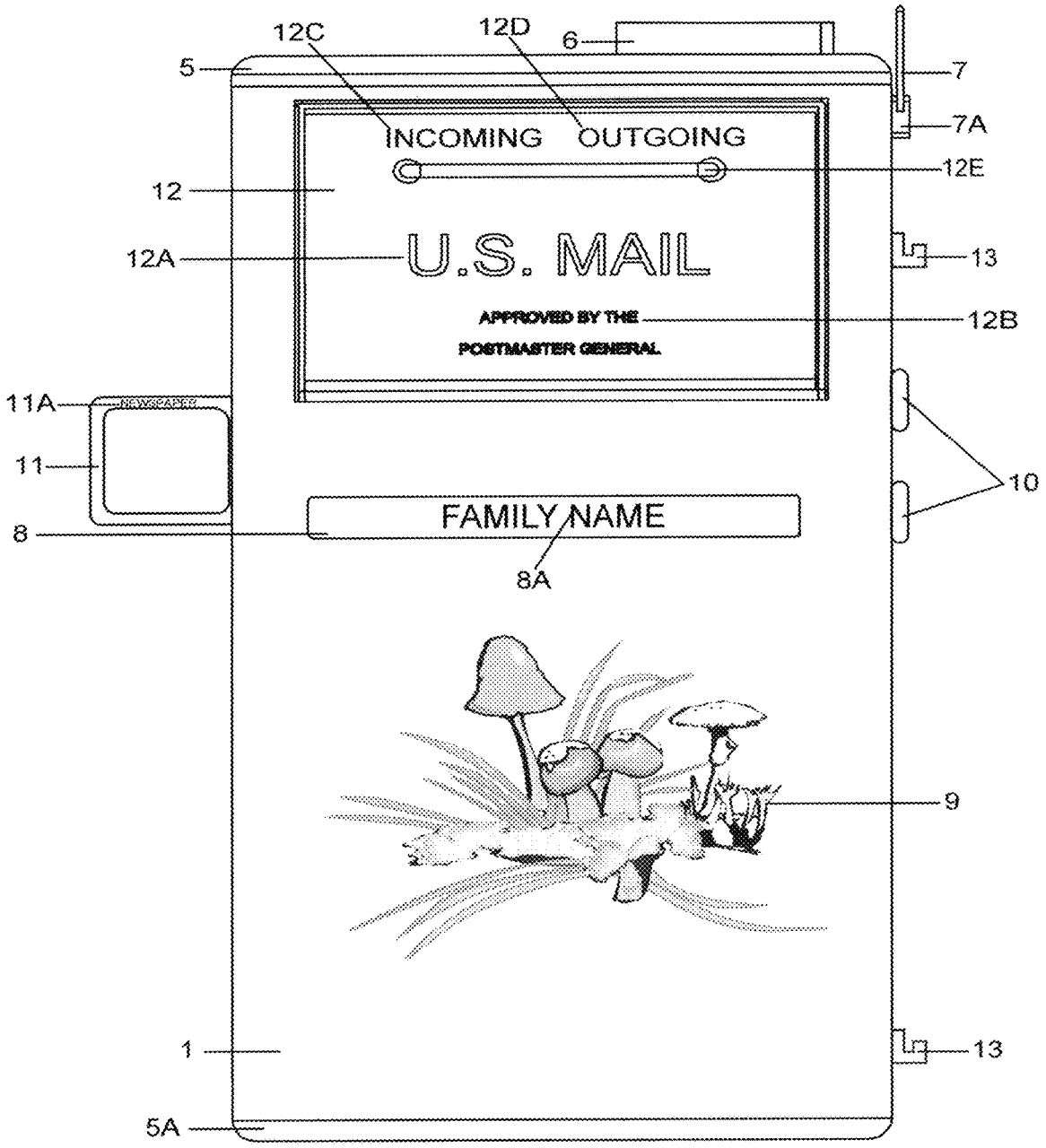
FIG. 1: Front interlocking panel (1), Interlocking top panel (5), Interlocking baseplate (5A), Address holder (6), Flag (7), Flag assembly (7A), Homeowners nameplate (8), Lettering for homeowners name (8A), Design element (9), Reflectors (10), Newspaper sleeve (11), Lettering on newspaper sleeve (11A), Incoming/outgoing mailbox door (12), Lettering on front of incoming/outgoing door indicating U.S. Mail (12A), Lettering on front incoming/outgoing mailbox door indicating Approved by the Postmaster General (12B), Lettering on front incoming/outgoing door indicating incoming mail (12C), Lettering on front incoming/outgoing door indicating outgoing mail (12D), Horizontal handle (12E), Interlocking hinges (13).

FIG. 1: Depicts front view of Safe "4U" Mailbox", constructed from some sort of plastic, metal, fabricated material, or some sort of environmentally friendly material that creates an enclosure for incoming/outgoing mail/small packages. The unit will be functional for securing homeowners' incoming mail/small packages. The unit will be about 60.00-inches-high, side panels will be about 55.00-inches-high by 27.00-inches-wide, front, back panels will be about 55.00-inches-high by 26.00-inches-wide. Top, bottom panels will be about 28.00-inches-wide by 27.00-inches-wide, 2-inches thick consisting of:

Front panel 1, about 55.00-inches-high by about 26.00-inches-wide. All Panels are internally trimmed down from 1.00-inch to 0.50-inch to create interlocking panels 2, 3, 4, 5, and 5A, which are created from some sort of plastic, metal, fabricated material or some sort of environmentally friendly material. Front panel has a name plate for homeowner name 8, adhesive backed letter display name 8A, decorative emblem 9, held together with some sort of heavy-duty adhesive, the front panel has cut-out/molded compartment for attaching pull-down incoming/outgoing mail door 12, Formed into incoming/outgoing door are raised lettering indicating U.S. Mail 12A, Raised lettering indicating Approved by the Postmaster General 12B, Raised lettering indicating incoming mail compartment 12C, Raised lettering indicating outgoing mail compartment 12D, Horizontal handle 12E.

Figure 8:
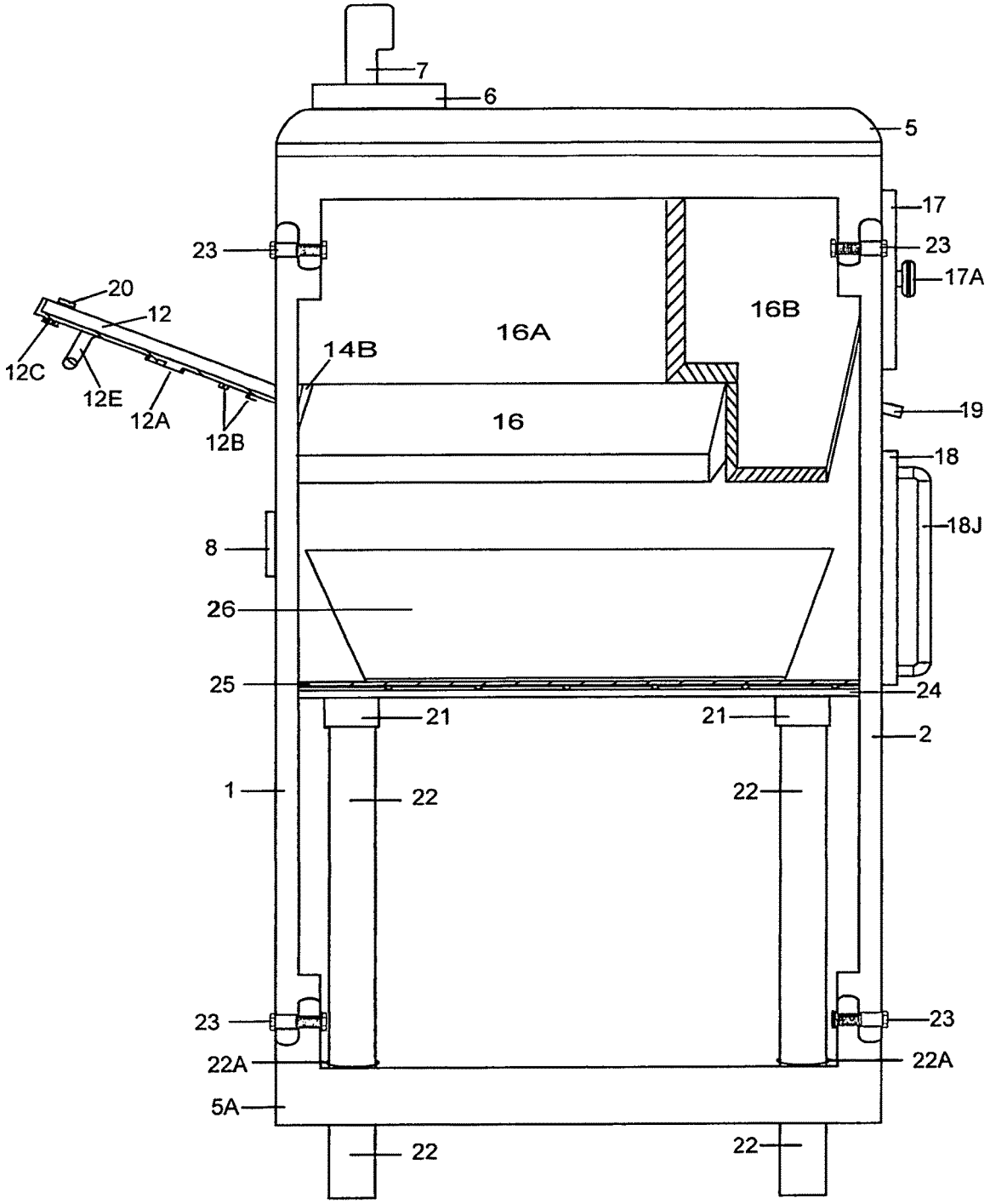
FIG. 8: Left view without panel of the "Safe "4U" Mailbox". Sideview of Front interlocking panel (1), Sideview of Rear interlocking panel (2), Sideview of Interlocking top panel (5), Sideview of Interlocking base plate (5A), Sideview of Address holder (6), Sideview of Flag (7), Sideview of homeowners nameplate (8), Sideview of incoming/outgoing mail door (12), Sideview of lettering for incoming/outgoing door indicating U.S. Mail (12A), Sideview of lettering for Approved by the Postmaster General (12B), Sideview of lettering for indicating incoming mail (12C), Sideview of horizontal handle (12E), Lip of incoming mail compartment (14B), Angled chute (16), Inside panel on incoming mail compartment (16A), Sideview of bumper board (16B), Side view of Upper outgoing mail door (17), Sideview of Upper outgoing mail door knob (17A), Sideview of lower secure door (18), Vertical handle (18J), Sideview of Awning (19), Magnet (20), Couplings (21), Internal and external poles (22), Plastic/rubber seals (22A), Tamper resistant screws, threaded screws, fasteners, bolts, and/or rivets to attach panels (23), Peg board (24), Railing system (25), Basket (26).

Top panel 5, about 28.00-inches-wide by about 27.00-inches-long, and about 2.00-inches-thick, trimmed down from the inside from 1.00-inch to 0.50-inch, top panel has about a 15°-degree curved edge for rain or snow to runoff. Top panel has a 0.25-inch cosmetic seam line at the 1.00-inch mark to give the illusion of two pieces, Address holder attaches to top panel 6. Top panel, address holder is created from some sort of plastic, metal, fabricated material or some sort of environmentally friendly material. Top panel interlocks with panels 1, 2, 3, 4, that are internally trimmed down on the inside from 1.00-inch to 0.50-inch to create interlocking panels (FIG. 8).

Interlocking baseplate 5A, about 28.00-inches-wide by about 27.00-inches-long, and about 2.00-inches-thick, trimmed down from the inside from 1.00-inch to 0.50-inch, baseplate has about a 15°-degree curved edge for rain or snow to runoff. Created from some sort of plastic, metal, fabricated material or some sort of environmentally friendly material. Base plate interlocks with panels 1, 2, 3, 4, that are internally trimmed down on the inside from 1.00-inch to 0.50-inch to create interlocking panels (FIG. 8).

Address holder 6, attaches to top panel 5, about 6-inches-long on front and right side, by about 1-inch-high, about 0.50-inches-thick. Address holder fits into molded circular holes on top panel 5, (FIG. 5A). Adhesive backed numbers used on market are about 0.50-inch-high by 0.50-inch-wide. Address holder is made from some sort of plastic, metal, fabricated material or some sort of environmentally friendly material and secured with some sort of adhesive.

Flag 7, mounted on the side of right panel (FIG. 4), flag is about 10.00-inches-high, made from sort of plastic, metal, fabricated material or some sort of environmentally friendly material. Top portion of flag has about a 2.00-inches-high by 2.00-inches-wide square when raised.

Flag mount 7A, mount is conventional 2.00-inch by 2.00-inch-square, (FIG. 4), screw for mount is about 1.00-inch-long.

Homeowners' nameplate 8, about 20.00-inches-long by about 2.00-inches-wide, about 2.00-inches-high, and about 0.50-inch-thick. Holding up to about (18) 1.00-inch by 1.00-inch adhesive backed letters for displaying homeowners' last name 8A, if desired. Nameplate may be expanded with some sort of expanders/s-hooks if homeowner desires for additional names. Made from some sort of plastic, metal, fabricated material or some sort of environmentally friendly material, secured with some sort of heavy-duty adhesive, expanders/s-hooks are market items.

Design element 9, about 17.00-inches-high by 11.00-inches-wide, for homeowners to personalization front of unit with computer generated, adhesive backed design elements ranging from sports, gardening, automobiles, arts, etc. if they like that are, made from some sort of plastic film that is weather resistant.

Reflectors 10, adhesive backed reflectors come in varies colors and attach to right panel 4, (FIG. 4), reflectors are between 4.00-inches-high, 2.00-inches-wide, either circular or square.

Figure 3:
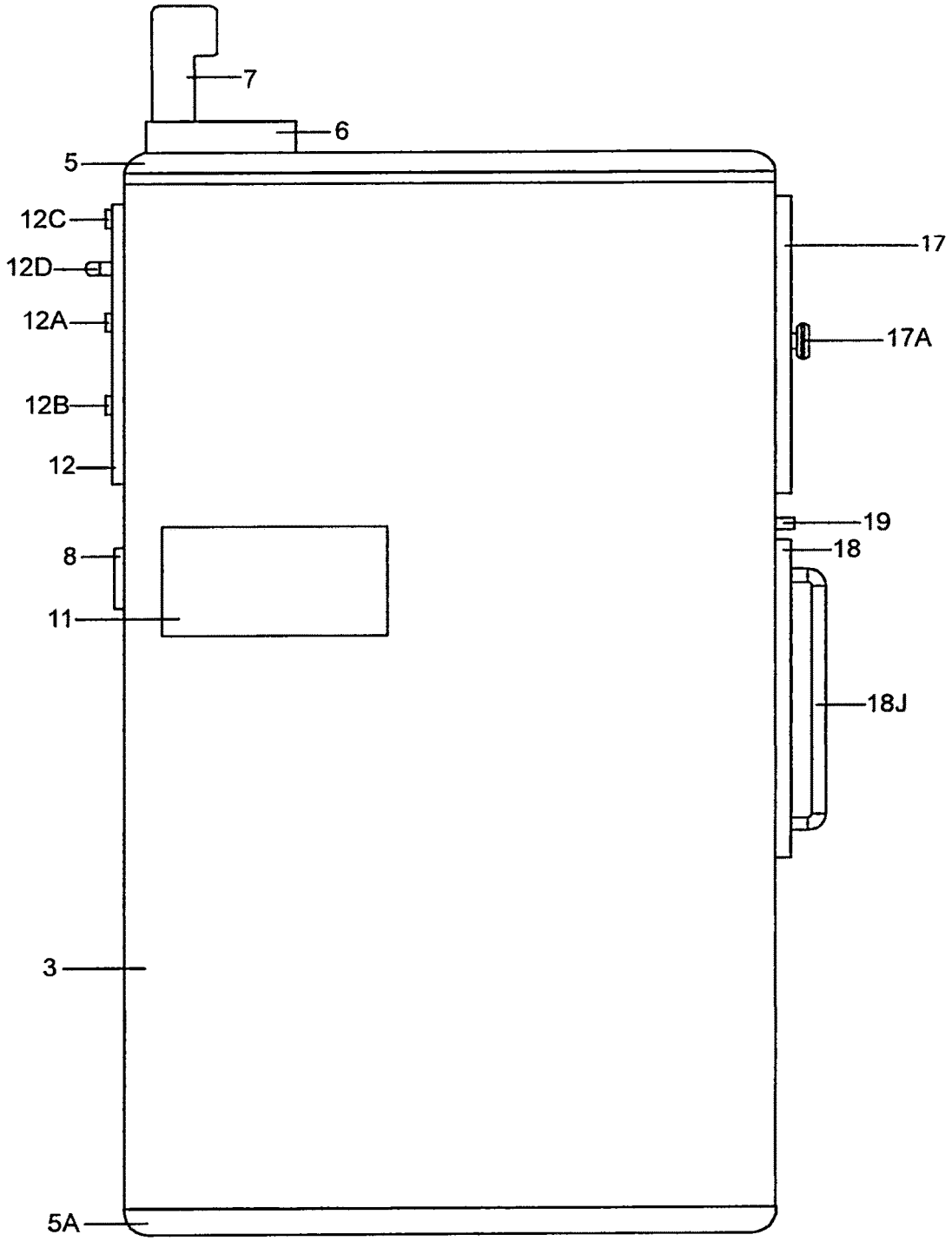
FIG. 3: Left interlocking panel (3), Sideview of Interlocking top panel (5), Interlocking base plate (5A), Side portion of flag (7), Sideview of homeowners nameplate (8), Sideview of newspaper sleeve (11), Sideview of incoming/outgoing mail door (12), Sideview of lettering on incoming/outgoing door indicating U.S. Mail (12A), Sideview of lettering on incoming/outgoing door Approved by the Postmaster General (12B), Sideview of lettering on incoming/outgoing door indicating incoming mail (12C), Sideview of horizontal handle for door (12E), Sideview of Interlocking hinges (13), Sideview of Upper outgoing mail door (17), Side view of outgoing mail door knob (17A), Sideview of lower secure door (18), Sideview of vertical handle (18J), Sideview of awning (19).

Newspaper/advertisement attachment 11, about 8.00-inches-high by about 8.00-inches-wide, about 12.00-inches-long, and about 0.50-inch-thick, molded into panel 3 (FIG. 3). Top portion of the newspapers/advertisement has lettering identifying slot 11A. Made from sort of plastic, metal, fabricated material or some sort of environmentally friendly material.

Incoming/outgoing mailbox door 12, Incoming/outgoing door is about 24-inches-wide, about 14.00-inches-high, and about 0.50-inch-thick, and is a pull-down door. Door is attached to upper front panel of the "Safe "4U" Mailbox" with pegs 17B (FIG. 6B). Formed into incoming/outgoing door are raised lettering indicating U.S. Mail 12A, letters are about 1.00-inch-high, about 0.25-inch-thick. Raised lettering indicating Approved by the Postmaster General 12B, about 0.50-inches-high and about 0.25-inch-thick. Raised lettering indicating incoming mail slot 12C, about 1.00-inch-high and about 0.25-inch-thick. Raised lettering indicating outgoing mail slot 12D, about 1.00-inch-high and about 0.25-inch-thick, door is made from sort of plastic, metal, fabricated material or some sort of environmentally friendly material.

Figure 7:
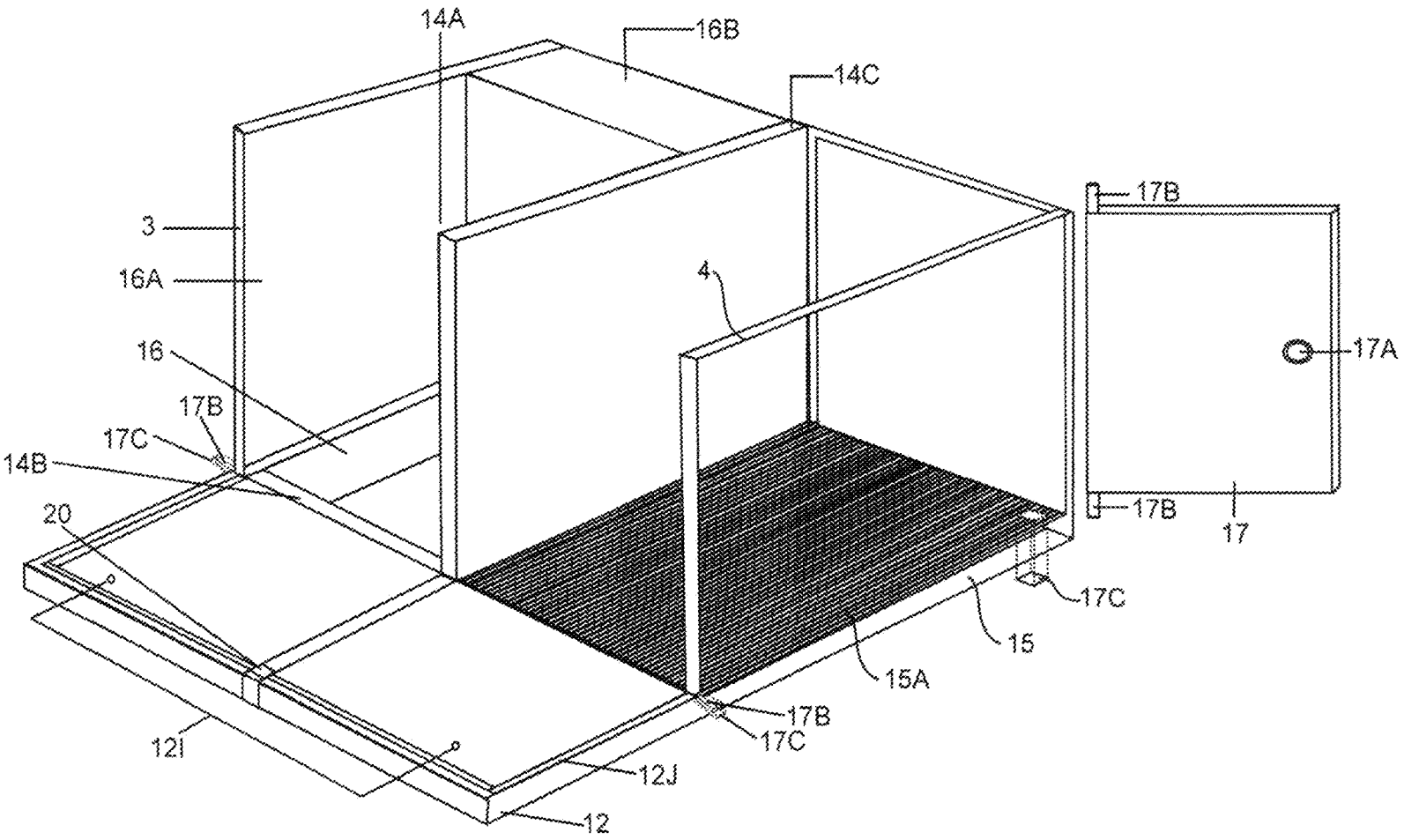
FIG. 7: Upper compartments of "Safe "4U" Mailbox" without top and transparent side panel. Left interlocking panel (3), Right transparent interlocking panel (4), Incoming/outgoing mail door open (12), Pre-drilled holes to attach horizontal handle (12I), Trim around incoming/outgoing door (12J), Compartment for incoming mail (14A), Lip of incoming mail compartment (14B), Compartment divider (14C), Compartment for outgoing mail (15), Ribbed floor of outgoing mail compartment (15A), Angle chute (16), Inside wall of incoming mail compartment (16A), Bumper board (16B), Upper outgoing mail door (17), Upper outgoing mail door knob (17A), Pegs (17B), Peg housing (17C), Magnet (20).

Horizontal handle 12E, about 22.00-inches-long by about 1.00-inch-wide. Handle is made from sort of plastic, metal, fabricated material or some sort of environmentally friendly material. Attaches with standard screws that is about 1.00-inch-long, attaches where pre-drilled holes are indicated (FIG. 6B, 7).

Interlocking hinges 13, hinges attach to sides of panels 3, 4, (FIG. 3, 4), of "Safe "4U" Mailbox", about 1.00-inches-wide by 1.00-inch-high, 0.50-inch-thick, for creating interlocking parts for multi-units. Interlocking hinges are located near the top and bottom of mailbox, either glued/screwed, made from sort of plastic, metal, fabricated material or some sort of environmentally friendly material.

Figure 2:
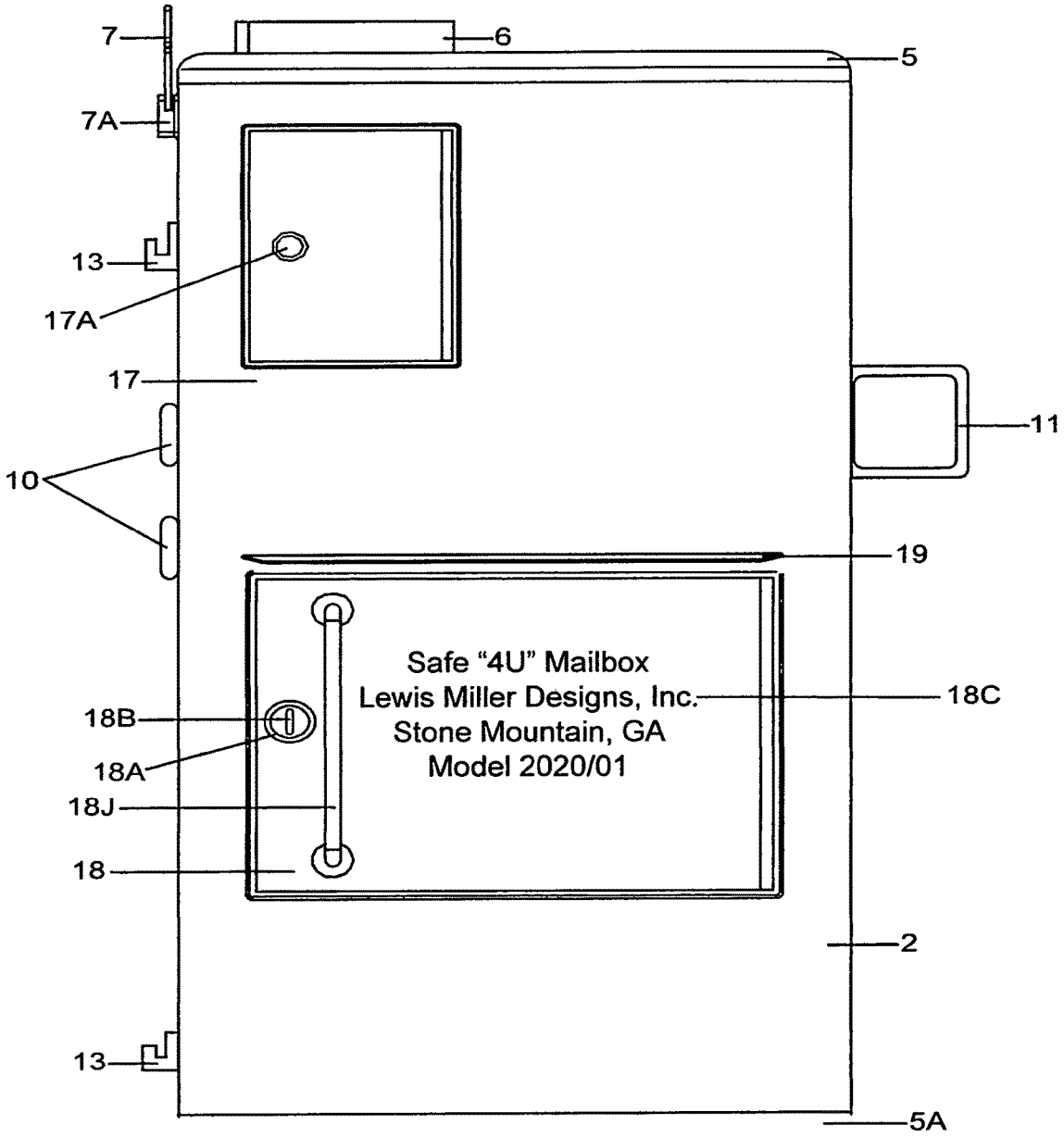
FIG. 2: Rear interlocking panel (2), Interlocking top panel (5), Interlocking baseplate (5A), Flag (7), Flag assembly (7A), Reflectors (10), Newspaper sleeve (11), Interlocking hinges (13), Upper outgoing mail door (17), Outgoing mail door knob (17A), Lower secure door (18), Security mount (18A), Key slot (18B), Manufacturing ID (18C), Vertical handle (18J), Awning (19).

FIG. 2: Depicts Rear panel of "Safe "4U" Mailbox" consisting of:

Rear panel 2, about 55.00-inches-high by about 26.00-inches-wide. Panel has two cut-out/molded compartments, outgoing mail 15, lower secure compartment 18D. All Panels are internally trimmed down from the inside from 1.00-inch to 0.50-inch to create interlocking panels with 1, 3, 4, 5 and 5A, made from some sort of plastic, metal, fabricated material or some sort of environmentally friendly material. Held together with some sort of heavy-duty adhesive and secured with some sort of tamper resistance screws, threaded screws, fasteners, bolts, and/or rivets, 23 (FIG. 5C, 8), which are about 1.00-inch-long.

Top panel 5, about 28.00-inches-wide by about 27.00-inches-long, and about 2.00-inches-thick, trimmed down from the inside from 1.00-inch to 0.50-inch, top panel has about a 15°-degree curved edge for rain or snow to runoff. Top panel has a 0.25-inch cosmetic seam line at the 1.00-inch mark to give the illusion of two pieces, Address holder attaches to top panel 6. Top panel, address holder is created from some sort of plastic, metal, fabricated material or some sort of environmentally friendly material. Top panel interlocks with panels 1, 2, 3, 4, that are internally trimmed down on the inside from 1.00-inch to 0.50-inch to create interlocking panels (FIG. 8).

Interlocking baseplate 5A, about 28.00-inches-wide by about 27.00-inches-long, and about 2.00-inches-thick, trimmed down from the inside from 1.00-inch to 0.50-inch, baseplate has about a 15°-degree curved edge for rain or snow to runoff. Created from some sort of plastic, metal, fabricated material or some sort of environmentally friendly material. Base plate interlocks with panels 1, 2, 3, 4, that are internally trimmed down on the inside from 1.00-inch to 0.50-inch to create interlocking panels (FIG. 8).

Flag 7, mounted on the side of right panel (FIG. 4), flag is about 10.00-inches-high, made from sort of plastic, metal, fabricated material or some sort of environmentally friendly material. Top portion of flag has about a 2.00-inches-high by 2.00-inches-wide square when raised.

Flag mount 7A, mount is conventional 2.00-inch by 2.00-inch-square, (FIG. 4), screw for mount is about 1.00-inch-long.

Reflectors 10, adhesive backed reflectors come in varies colors and attach to right panel 4, (FIG. 4), reflectors are between 4.00-inches-high, 2.00-inches-wide, either circular or square.

Newspaper/advertisement attachment 11, about 8.00-inches-high by about 8.00-inches-wide, about 12.00-inches-long, and about 0.50-inch-thick, molded into panel 3 (FIG. 3). Top portion of the newspapers/advertisement has lettering identifying slot 11A. Made from sort of plastic, metal, fabricated material or some sort of environmentally friendly material.

Interlocking hinges 13, hinges attach to sides of panels 3, 4, (FIG. 3, 4), of "Safe "4U" Mailbox", about 1.00-inches-wide by 1.00-inch-high, 0.50-inch-thick, for creating interlocking parts for multi-units. Interlocking hinges are located near the top and bottom of mailbox, either glued/screwed, made from sort of plastic, metal, fabricated material or some sort of environmentally friendly material.

Figure 11:
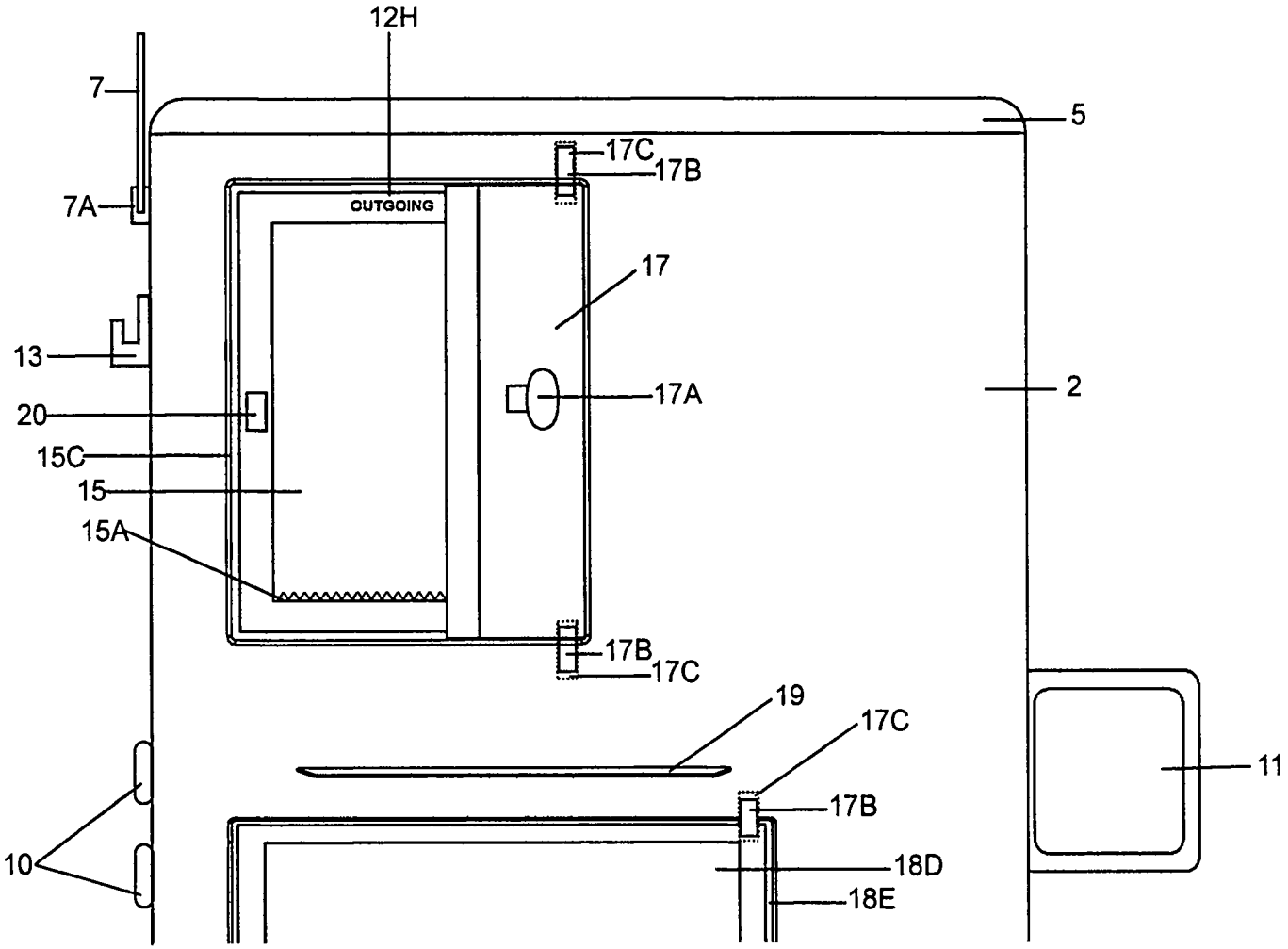
FIG. 11: Rear upper outgoing compartment of the "Safe "4U" Mailbox". Rear interlocking panel (2), Rearview of Interlocking top panel (5), Sideview of Flag (7), Sideview of Flag assembly (7A), Sideview of reflectors (10), Rearview of Newspaper sleeve (11), Lettering on outgoing compartment indicating outgoing mail slot (12H), Sideview of interlocking hinges (13), Outgoing mail compartment (15), Ribbed floor of outgoing mail compartment (15A), Trim around outgoing mail compartment (15C), Upper outgoing mail door (17), Upper outgoing mail door knob (17A), Pegs (17B), Peg sleeves (17C), Magnet (20).

Upper outgoing mail door 17, about 14.00-inches-high by about 10.00-inches-wide, about 0.50-inch-thick to insert outgoing mail from rear of unit (FIG. 11). Door is secured with pegs 17B (FIG. 7, 11), that are about are about 0.25-inch in diameter by about 4.50-inches-long, pre-formed holes for pegs are formed into upper section of rear panel 2, (FIG. 11), made from sort of plastic, metal, fabricated material or some sort of environmentally friendly material.

Figure 9:
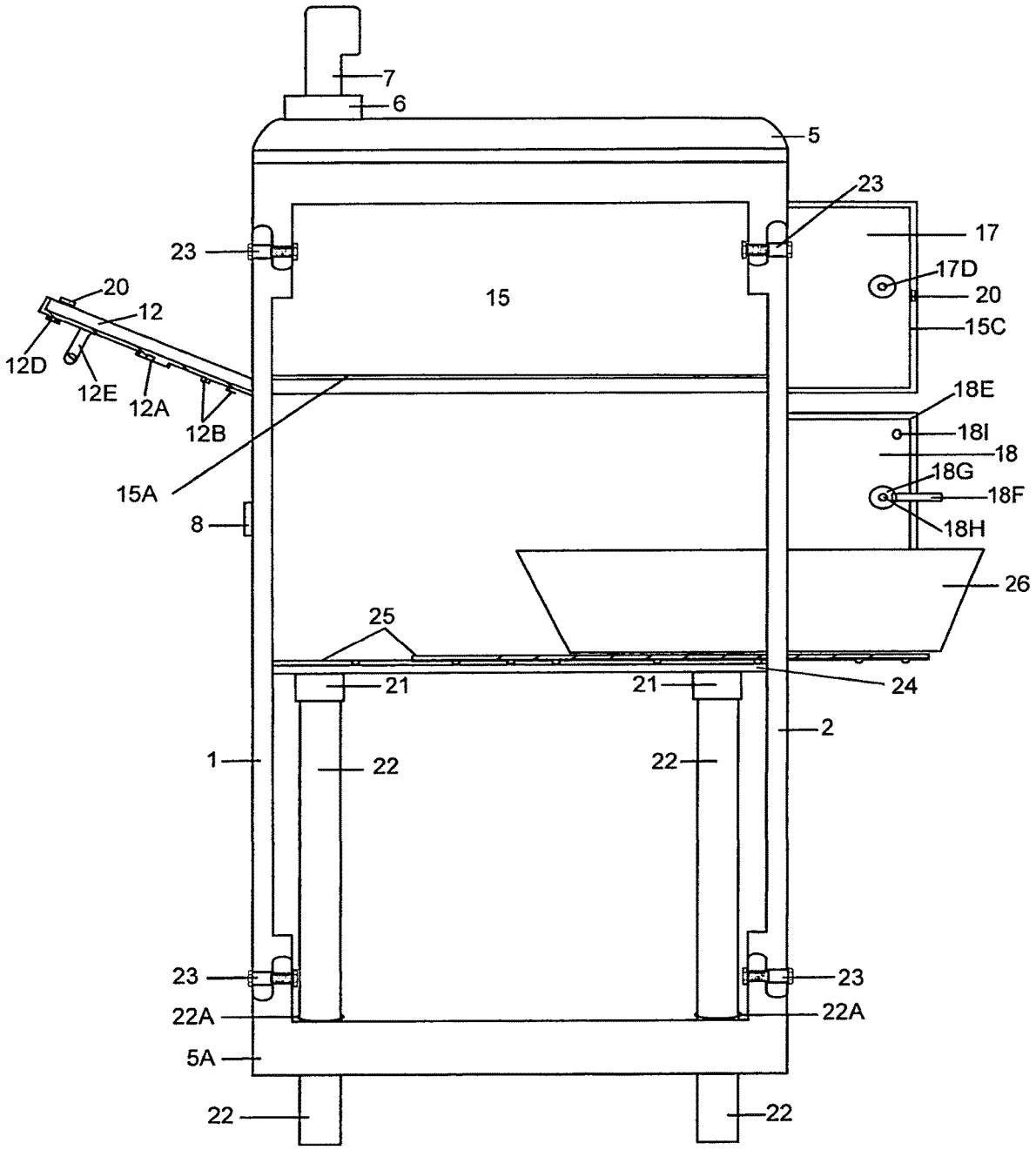
FIG. 9: Right view without panel of the "Safe "4U" Mailbox" with front/rear doors open and pull-out basket. Sideview of Front interlocking panel (1), Sideview of Rear interlocking panel (2), Sideview of Interlocking top panel (5), Sideview of Interlocking base plate (5A), Sideview of Address holder (6), Sideview of Flag (7), Sideview of homeowners nameplate (8), Sideview of incoming/outgoing mail door (12), Sideview of lettering on door indicating U.S. Mail (12A), Sideview of lettering for Approved by the Postmaster General (12B), Sideview of lettering for indicating outgoing mail (12D), Horizontal handle (12E), Outgoing mail compartment (15), Ribbed floor of outgoing mail compartment (15A), Trim around outgoing mail door (15C), Side view of Upper outgoing mail door (17), Standard screw for Upper outgoing mail door (17D), Sideview of open lower secure door (18), Trim around lower secure door (18E), Latch for lower secure door (18F), Rearview of secure key mount (18G), Standard screw for lower secure door rear (18H), Pre-drilled holes for vertical handle (18I), Magnet (20), Couplings (21), Internal/external poles (22), Plastic/rubber seals (22A), Tamper resistant screws, threaded screws, fasteners, bolts, and/or rivets to attach panels (23), Peg board (24), Railing system (25), Basket (26).

Upper outgoing mail door knob 17A, about 2.00-inches by 2.00-inches round in diameter, attached with standard screw where pre-drilled hole is indicated 17D (FIG. 6B, 9, 12). Made from sort of plastic, metal, fabricated material or some sort of environmentally friendly material.

Lower rear secure door, 18, about 16.00-inch-high by about 20.00-inch-wide, about 0.50-inch-thick, attaches through pre-formed holes in lower panel 2, secured with pegs 17B (FIG. 13), that are about 0.25-inch in diameter by about 4.50-inches-long. Made from sort of plastic, metal, fabricated material or some sort of environmentally friendly material.

Key security mount, 18A, about 2.00-inches-by 2.00-inches-square/round in diameter that secures the rear lower secure door.

Key system 18B, standard key to lock and unlock lower secure door.

Manufacturing ID, 18C, about 1.00-inch-high letters, raised about 0.25-inch-thick, molded in lower secure door to identity month, year of manufacturing.

Vertical handle 18J, about 14.00-inch-long by about 1.00-inch-wide, made from sort of plastic, metal, fabricated material or some sort of environmentally friendly material, attached with standard screws that is about 1.00-inch-long, attaches where pre-drilled holes are indicated (FIG. 13C).

Covered awning, 19, about 22.00-inches-long by about 2.00-inches-wide, 0.50-inch-thick, sloped on about a 45°-degrees, molded into back of panel 2. Made from sort of plastic, metal, fabricated material or some sort of environmentally friendly material.

FIG. 3: Depicts Left panel of "Safe "4U" Mailbox" consisting of:

Left panel 3, about 55.00-inches-high by about 27.00-inches-wide. Panel has molded compartment for newspaper/advertisement attachment 11, either glued/screwed interlocking attachments 13, All Panels are internally trimmed down from the inside from 1.00-inch to 0.50-inch to create interlocking panels with 1, 2, 4, 5 and 5A, made from some sort of plastic, metal, fabricated material or some sort of environmentally friendly material. Held together with some sort of heavy-duty adhesive and secured with some sort of tamper resistance screws, threaded screws, fasteners, bolts, and/or rivets, 23 (FIG. 5C, 8), which are about 1.00-inch-long.

Top panel 5, about 28.00-inches-wide by about 27.00-inches-long, and about 2.00-inches-thick, trimmed down from the inside from 1.00-inch to 0.50-inch, top panel has about a 15°-degree curved edge for rain or snow to runoff. Top panel has a 0.25-inch cosmetic seam line at the 1.00-inch mark to give the illusion of two pieces, Address holder attaches to top panel 6. Top panel, address holder is created from some sort of plastic, metal, fabricated material or some sort of environmentally friendly material. Top panel interlocks with panels 1, 2, 3, 4, that are internally trimmed down on the inside from 1.00-inch to 0.50-inch to create interlocking panels (FIG. 8).

Interlocking baseplate 5A, about 28.00-inches-wide by about 27.00-inches-long, and about 2.00-inches-thick, trimmed down from the inside from 1.00-inch to 0.50-inch, baseplate has about a 15°-degree curved edge for rain or snow to runoff. Created from some sort of plastic, metal, fabricated material or some sort of environmentally friendly material. Base plate interlocks with panels 1, 2, 3, 4, that are internally trimmed down on the inside from 1.00-inch to 0.50-inch to create interlocking panels (FIG. 8).

Sideview of Flag 7, mounted on the side of right panel (FIG. 4), flag is about 10.00-inches-high, made from sort of plastic, metal, fabricated material or some sort of environmentally friendly material. Top portion of flag has about a 2.00-inches-high by 2.00-inches-wide square when raised.

Sideview of homeowners' nameplate 8, about 20.00-inches-long by about 2.00-inches-wide, about 2.00-inches-high, and about 0.50-inch-thick. Holding up to about (18) 1.00-inch by 1.00-inch adhesive backed letters for displaying homeowners' last name 8A, if desired. Nameplate may be expanded with some sort of expanders/s-hooks if homeowner desires for additional names. Made from some sort of plastic, metal, fabricated material or some sort of environmentally friendly material, secured with some sort of heavy-duty adhesive, expanders/s-hooks are market items.

Sideview of newspaper/advertisement attachment 11, about 8.00-inches-high by about 8.00-inches-wide, about 12.00-inches-long, and about 0.50-inch-thick, molded into panel 3 (FIG. 3). Made from sort of plastic, metal, fabricated material or some sort of environmentally friendly material.

Sideview of incoming/outgoing mailbox door 12, Incoming/outgoing door is about 24-inches-wide, about 14.00-inches-high, and about 0.50-inch-thick, and is a pull-down door. Door is attached to upper front panel of the "Safe "4U" Mailbox" with pegs 17B (FIG. 6B). Formed into incoming/outgoing door are raised lettering indicating U.S. Mail 12A, letters are about 1.00-inch-high, about 0.25-inch-thick. Raised lettering indicating Approved by the Postmaster General 12B, about 0.50-inches-high and about 0.25-inch-thick. Raised lettering indicating incoming mail slot 12C, about 1.00-inch-high and about 0.25-inch-thick. Made from sort of plastic, metal, fabricated material or some sort of environmentally friendly material.

Sideview of horizontal handle 12E, about 22.00-inches-long by about 1.00-inch-wide. Handle is made from sort of plastic, metal, fabricated material or some sort of environmentally friendly material. Attaches with standard screws that is about 1.00-inch-long, attaches where pre-drilled holes are indicated (FIG. 6B, 7).

Interlocking hinges 13, hinges attach to sides of panels 3, 4, (FIG. 3, 4), of "Safe "4U" Mailbox", about 1.00-inches-wide by 1.00-inch-high, 0.50-inch-thick, for creating interlocking parts for multi-units. Interlocking hinges are located near the top and bottom of mailbox, either glued/screwed, made from sort of plastic, metal, fabricated material or some sort of environmentally friendly material.

Sideview of Upper outgoing mail door 17, about 14.00-inches-high by about 10.00-inches-wide, about 0.50-inch-thick to insert outgoing mail from rear of unit (FIG. 11). Door is secured with pegs 17B (FIG. 7, 11), that are about are about 0.25-inch in diameter by about 4.50-inches-long, pre-formed holes for pegs are formed into upper section of rear panel 2, (FIG. 11), made from sort of plastic, metal, fabricated material or some sort of environmentally friendly material.

Upper outgoing mail door knob 17A, about 2.00-inches by 2.00-inches round in diameter, attached with standard screw where pre-drilled hole is indicated 17D (FIG. 6B, 9, 12). Made from sort of plastic, metal, fabricated material or some sort of environmentally friendly material.

Sideview of lower rear secure door, 18, about 16.00-inch-high by about 20.00-inch-wide, about 0.50-inch-thick, attaches through pre-formed holes in lower panel 2, secured with pegs 17B (FIG. 13), that are about 0.25-inch in diameter by about 4.50-inches-long. Made from sort of plastic, metal, fabricated material or some sort of environmentally friendly material.

Sideview of vertical handle 18J, about 14.00-inch-long by about 1.00-inch-wide, made from sort of plastic, metal, fabricated material or some sort of environmentally friendly material, attached with standard screws that is about 1.00-inch-long, attaches where pre-drilled holes are indicated (FIG. 13C).

Covered awning, 19, about 22.00-inches-long by about 2.00-inches-wide, 0.50-inch-thick, sloped on about a 45°-degrees, molded into back of panel 2. Made from sort of plastic, metal, fabricated material or some sort of environmentally friendly material.

Figure 4:
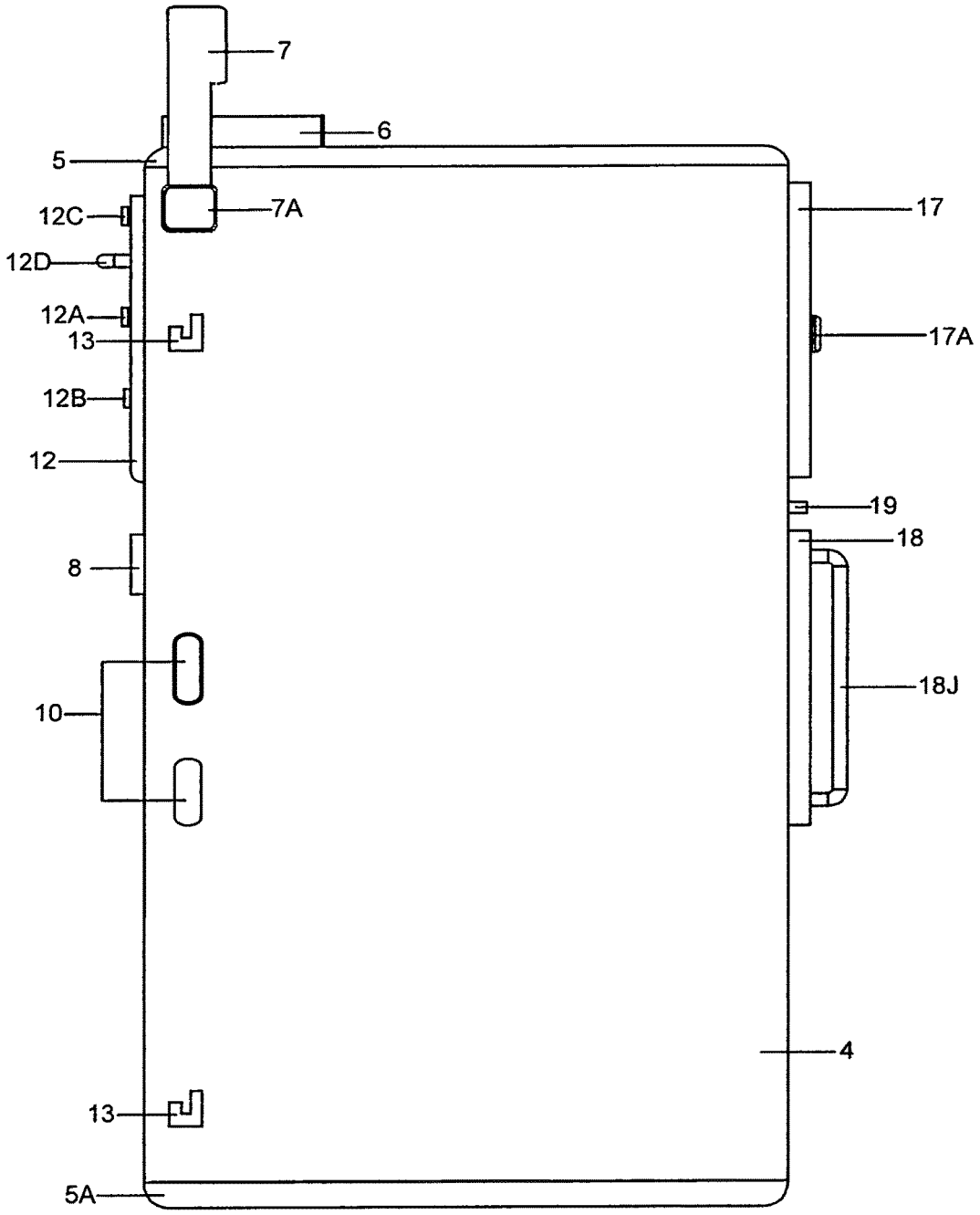
FIG. 4: Right interlocking panel (4), Sideview of Interlocking top panel (5), Sideview of Interlocking base plate (5A), Sideview of Address holder (6), Sideview of Flag (7), Sideview of Flag assembly (7A), Sideview of homeowners nameplate (8), Sideview of Reflectors (10), Sideview of incoming/outgoing mail door (12), Sideview of lettering on incoming/outgoing door indicating U.S. Mail (12A), Sideview of lettering for Approved by the Postmaster General (12B), Sideview of lettering on incoming/outgoing door indicating outgoing mail (12D), Horizontal handle (12E), Sideview of Interlocking hinges (13), Sideview of upper outgoing mail door (17), Sideview of outgoing mail door knob (17A), Sideview of lower secure door (18), Sideview of vertical handle for lower secure door (18J), Sideview of Awning (19).

FIG. 4: Depicts Right panel of "Safe "4U" Mailbox" consisting of:

Right panel 4, about 55.00-inches-high by about 27.00-inches-wide. Panel has either glued/screwed reflectors 10, All Panels are internally trimmed down from the inside from 1.00-inch to 0.50-inch to create interlocking panels with 1, 2, 4, 5 and 5A, made from some sort of plastic, metal, fabricated material or some sort of environmentally friendly material. Held together with some sort of heavy-duty adhesive and secured with some sort of tamper resistance screws, threaded screws, fasteners, bolts, and/or rivets, 23 (FIG. 5C, 8), which are about 1.00-inch-long.

Sideview of top panel 5, about 28.00-inches-wide by about 27.00-inches-long, and about 2.00-inches-thick, trimmed down from the inside from 1.00-inch to 0.50-inch, top panel has about a 15°-degree curved edge for rain or snow to runoff. Top panel has a 0.25-inch cosmetic seam line at the 1.00-inch mark to give the illusion of two pieces, Address holder attaches to top panel 6. Top panel, address holder is created from some sort of plastic, metal, fabricated material or some sort of environmentally friendly material. Top panel interlocks with panels 1, 2, 3, 4, that are internally trimmed down on the inside from 1.00-inch to 0.50-inch to create interlocking panels (FIG. 8).

Interlocking baseplate 5A, about 28.00-inches-wide by about 27.00-inches-long, and about 2.00-inches-thick, trimmed down from the inside from 1.00-inch to 0.50-inch, baseplate has about a 15°-degree curved edge for rain or snow to runoff. Created from some sort of plastic, metal, fabricated material or some sort of environmentally friendly material. Base plate interlocks with panels 1, 2, 3, 4, that are internally trimmed down on the inside from 1.00-inch to 0.50-inch to create interlocking panels (FIG. 8).

Sideview of address holder 6, attaches to top panel 5, about 6-inches-long on front and right side, by about 1-inch-high, about 0.50-inches-thick. Address holder fits into molded circular holes on top panel 5, (FIG. 5A). Adhesive backed numbers used on market are about 0.50-inch-high by 0.50-inch-wide. Address holder is made from some sort of plastic, metal, fabricated material or some sort of environmentally friendly material and secured with some sort of adhesive.

Sideview of Flag 7, mounted on the side of right panel (FIG. 4), flag is about 10.00-inches-high, made from sort of plastic, metal, fabricated material or some sort of environmentally friendly material. Top portion of flag has about a 2.00-inches-high by 2.00-inches-wide square when raised.

Sideview of flag mount 7A, mount is conventional 2.00-inch by 2.00-inch-square, (FIG. 4), screw for mount is about 1.00-inch-long.

Sideview of homeowners' nameplate 8, about 20.00-inches-long by about 2.00-inches-wide, about 2.00-inches-high, and about 0.50-inch-thick. Holding up to about (18)

1.00-inch by 1.00-inch adhesive backed letters for displaying homeowners' last name 8A, if desired. Nameplate may be expanded with some sort of expanders/s-hooks if homeowner desires for additional names. Made from some sort of plastic, metal, fabricated material or some sort of environmentally friendly material, secured with some sort of heavy-duty adhesive, expanders/s-hooks are market items.

Sideview of reflectors 10, adhesive backed reflectors come in varies colors and attach to right panel 4, (FIG. 4), reflectors are between 4.00-inches-high, 2.00-inches-wide, either circular or square.

Sideview of Incoming/outgoing mailbox door 12, Incoming/outgoing door is about 24-inches-wide, about 14.00-inches-high, and about 0.50-inch-thick, and is a pull-down door. Door is attached to upper front panel of the "Safe "4U" Mailbox" with pegs 17B (FIG. 6B). Formed into incoming/outgoing door are raised lettering indicating U.S. Mail 12A, letters are about 1.00-inch-high, about 0.25-inch-thick. Raised lettering indicating Approved by the Postmaster General 12B, about 0.50-inches-high and about 0.25-inch-thick. Raised lettering indicating outgoing mail slot 12D, about 1.00-inch-high and about 0.25-inch-thick, door is made from sort of plastic, metal, fabricated material or some sort of environmentally friendly material.

Sideview of horizontal handle 12E, about 22.00-inches-long by about 1.00-inch-wide. Handle is made from sort of plastic, metal, fabricated material or some sort of environmentally friendly material. Attaches with standard screws that is about 1.00-inch-long, attaches where pre-drilled holes are indicated (FIG. 6B, 7).

Sideview of Interlocking hinges 13, hinges attach to sides of panels 3, 4, (FIG. 3, 4), of "Safe "4U" Mailbox", about 1.00-inches-wide by 1.00-inch-high, 0.50-inch-thick, for creating interlocking parts for multi-units. Interlocking hinges are located near the top and bottom of mailbox, either glued/screwed, made from sort of plastic, metal, fabricated material or some sort of environmentally friendly material.

Sideview of Upper outgoing mail door 17, about 14.00-inches-high by about 10.00-inches-wide, about 0.50-inch-thick to insert outgoing mail from rear of unit (FIG. 11). Door is secured with pegs 17B (FIG. 7, 11), that are about are about 0.25-inch in diameter by about 4.50-inches-long, pre-formed holes for pegs are formed into upper section of rear panel 2, (FIG. 11), made from sort of plastic, metal, fabricated material or some sort of environmentally friendly material.

Sideview of Upper outgoing mail door knob 17A, about 2.00-inches by 2.00-inches round in diameter, attached with standard screw where pre-drilled hole is indicated 17D (FIG. 6B, 9, 12). Made from sort of plastic, metal, fabricated material or some sort of environmentally friendly material.

Sideview of lower rear secure door, 18, about 16.00-inch-high by about 20.00-inch-wide, about 0.50-inch-thick, attaches through pre-formed holes in lower panel 2, secured with pegs 17B (FIG. 13), that are about 0.25-inch in diameter by about 4.50-inches-long. Made from sort of plastic, metal, fabricated material or some sort of environmentally friendly material.

Sideview of vertical handle 18J, about 14.00-inch-long by about 1.00-inch-wide, made from sort of plastic, metal, fabricated material or some sort of environmentally friendly material, attached with standard screws that is about 1.00-inch-long, attaches where pre-drilled holes are indicated (FIG. 13C).

Sideview of covered awning, 19, about 22.00-inches-long by about 2.00-inches-wide, 0.50-inch-thick, sloped on about a 45°-degrees, molded into back of panel 2. Made from sort of plastic, metal, fabricated material or some sort of environmentally friendly material.

FIG. 5: Depicts three views, Top/Bottom panel views of the "Safe "4U" Mailbox" along with some sort of tamper resistance screws, threaded screws, fasteners, bolts, and/or rivets, and portion of side panel attachment consisting of:

Portion of Top panel 5, about 28.00-inches-wide by about 27.00-inches-long, and about 2.00-inches-thick, trimmed down from the inside from 1.00-inch to 0.50-inch, top panel has about a 15°-degree curved edge for rain or snow to runoff. Top panel has a 0.25-inch cosmetic seam line at the 1.00-inch mark to give the illusion of two pieces, Address holder attaches to top panel 6. Top panel, address holder is created from some sort of plastic, metal, fabricated material or some sort of environmentally friendly material. Top panel interlocks with panels 1, 2, 3, 4, that are internally trimmed down on the inside from 1.00-inch to 0.50-inch to create interlocking panels (FIG. 8).

Address holder 6, attaches to top panel 5, about 6-inches-long on front and right side, by about 1-inch-high, about 0.50-inches-thick. Address holder fits into molded circular holes on top panel 5, (FIG. 5A). Adhesive backed numbers used on market are about 0.50-inch-high by 0.50-inch-wide. Address holder is made from some sort of plastic, metal, fabricated material or some sort of environmentally friendly material and secured with some sort of adhesive.

Address holder holes 6A, holes formed/molded into top panel 5, for address holder to attach, holes are recessed about 2.00-inches on front/side of top panel 5, about 0.25-inch in diameter by about 1.00-inch in depth for address holder, held with some sort of heavy-duty glue.

Top view of Flag 7, mounted on the side of right panel (FIG. 4), flag is about 10.00-inches-high, made from sort of plastic, metal, fabricated material or some sort of environmentally friendly material. Top portion of flag has about a 2.00-inches-high by 2.00-inches-wide square when raised.

Top view of flag mount 7A, mount is conventional 2.00-inch by 2.00-inch-square, (FIG. 4), screw for mount is about 1.00-inch-long.

Top view of Incoming/outgoing mailbox door 12, Incoming/outgoing door is about 24-inches-wide, about 14.00-inches-high, and about 0.50-inch-thick, and is a pull-down door. Door is attached to upper front panel of the "Safe "4U" Mailbox" with pegs 17B (FIG. 6B).

Top view of horizontal handle 12E, about 22.00-inches-long by about 1.00-inch-wide. Handle is made from sort of plastic, metal, fabricated material or some sort of environmentally friendly material. Attaches with standard screws that is about 1.00-inch-long, attaches where pre-drilled holes are indicated (FIG. 6B, 7).

Pegs 17B, about 0.25-inch in diameter by about 1.00-inch in depth for address holder to securely fit on top of panel 5. Made from some sort of plastic, metal, fabricated material or some sort of environmentally friendly material.

FIG. 5B: Portion of left panel 3, about 55.00-inches-high by about 27.00-inches-wide. Panel has molded compartment for newspaper/advertisement attachment 11, either glued/screwed interlocking attachments 13, All Panels are internally trimmed down from the inside from 1.00-inch to 0.50-inch to create interlocking panels with 1, 2, 4, 5 and 5A, made from some sort of plastic, metal, fabricated material or some sort of environmentally friendly material. Held together with some sort of heavy-duty adhesive and secured with some sort of tamper resistance screws, threaded screws, fasteners, bolts, and/or rivets, 23 (FIG. 5C, 8), which are about 1.00-inch-long.

Interlocking baseplate 5A, about 28.00-inches-wide by about 27.00-inches-long, and about 2.00-inches-thick, trimmed down from the inside from 1.00-inch to 0.50-inch, baseplate has about a 15°-degree curved edge for rain or snow to runoff. Baseplate has 4 about 1.25-inch circular cut-outs for internal poles to go through that get cemented into ground. Created from some sort of plastic, metal, fabricated material or some sort of environmentally friendly material. Base plate interlocks with panels 1, 2, 3, 4, that are internally trimmed down on the inside from 1.00-inch to 0.50-inch to create interlocking panels (FIG. 8).

Circular plastic seals 22A, about 1.00-inch by 1.00-inch in diameter, to seal inside unit from bugs/moisture out (FIG. 5B).

FIG. 5C: Portion of right panel 4, about 55.00-inches-high by about 27.00-inches-wide. Panel has either glued/screwed reflectors 10, All Panels are internally trimmed down from the inside from 1.00-inch to 0.50-inch to create interlocking panels with 1, 2, 4, 5 and 5A, made from some sort of plastic, metal, fabricated material or some sort of environmentally friendly material. Held together with some sort of heavy-duty adhesive and secured with some sort of tamper resistance screws, threaded screws, fasteners, bolts, and/or rivets, 23 (FIG. 5C, 8), which are about 1.00-inch-long.

Tamper resistance screws, threaded screws, fasteners, bolts, and/or rivets 23, about 1.00-inch-long to secure panels together. Made from sort of plastic, metal, fabricated material or some sort of environmentally friendly material.

FIG. 6: Depicts two views of "Safe "4U" Mailbox", one with the incoming/outgoing mailbox door closed, one with incoming/outgoing mailbox door open consisting of:

FIG. 6A: Front panel 1, about 55.00-inches-high by about 26.00-inches-wide. All Panels are internally trimmed down from 1.00-inch to 0.50-inch to create interlocking panels 2, 3, 4, 5, and 5A, which are created from some sort of plastic, metal, fabricated material or some sort of environmentally friendly material. Front panel has a name plate for homeowner name 8, adhesive backed letter display name 8A, decorative emblem 9, held together with some sort of heavy-duty adhesive, the front panel has cut-out/molded compartment for attaching pull-down incoming/outgoing mail door 12, Formed into incoming/outgoing door are raised lettering indicating U.S. Mail 12A, Raised lettering indicating Approved by the Postmaster General 12B, Raised lettering indicating incoming mail compartment 12C, Raised lettering indicating outgoing mail compartment 12D, Horizontal handle 12E.

Top panel 5, about 28.00-inches-wide by about 27.00-inches-long, and about 2.00-inches-thick, trimmed down from the inside from 1.00-inch to 0.50-inch, top panel has about a 15°-degree curved edge for rain or snow to runoff. Top panel has a 0.25-inch cosmetic seam line at the 1.00-inch mark to give the illusion of two pieces, Address holder attaches to top panel 6. Top panel, address holder is created from some sort of plastic, metal, fabricated material or some sort of environmentally friendly material. Top panel interlocks with panels 1, 2, 3, 4, that are internally trimmed down on the inside from 1.00-inch to 0.50-inch to create interlocking panels (FIG. 8).

Address holder 6, attaches to top panel 5, about 6-inches-long on front and right side, by about 1-inch-high, about 0.50-inches-thick. Address holder fits into molded circular holes on top panel 5, (FIG. 5A). Adhesive backed numbers used on market are about 0.50-inch-high by 0.50-inch-wide. Address holder is made from some sort of plastic, metal, fabricated material or some sort of environmentally friendly material and secured with some sort of adhesive.

Flag 7, mounted on the side of right panel (FIG. 4), flag is about 10.00-inches-high, made from sort of plastic, metal, fabricated material or some sort of environmentally friendly material. Top portion of flag has about a 2.00-inches-high by 2.00-inches-wide square when raised.

Flag mount 7A, mount is conventional 2.00-inch by 2.00-inch-square, (FIG. 4), screw for mount is about 1.00-inch-long.

Homeowners' nameplate 8, about 20.00-inches-long by about 2.00-inches-wide, about 2.00-inches-high, and about 0.50-inch-thick. Holding up to about (18) 1.00-inch by 1.00-inch adhesive backed letters for displaying homeowners' last name 8A, if desired. Nameplate may be expanded with some sort of expanders/s-hooks if homeowner desires for additional names. Made from some sort of plastic, metal, fabricated material or some sort of environmentally friendly material, secured with some sort of heavy-duty adhesive, expanders/s-hooks are market items.

Reflectors 10, adhesive backed reflectors come in varies colors and attach to right panel 4, (FIG. 4), reflectors are between 4.00-inches-high, 2.00-inches-wide, either circular or square.

Newspaper/advertisement attachment 11, about 8.00-inches-high by about 8.00-inches-wide, about 12.00-inches-long, and about 0.50-inch-thick, molded into panel 3 (FIG. 3). Top portion of the newspapers/advertisement has lettering identifying slot 11A. Made from sort of plastic, metal, fabricated material or some sort of environmentally friendly material.

Incoming/outgoing mailbox door 12, Incoming/outgoing door is about 24-inches-wide, about 14.00-inches-high, and about 0.50-inch-thick, and is a pull-down door. Door is attached to upper front panel of the "Safe "4U" Mailbox" with pegs 17B (FIG. 6B). Formed into incoming/outgoing door are raised lettering indicating U.S. Mail 12A, letters are about 1.00-inch-high, about 0.25-inch-thick. Raised lettering indicating Approved by the Postmaster General 12B, about 0.50-inches-high and about 0.25-inch-thick. Raised lettering indicating incoming mail slot 12C, about 1.00-inch-high and about 0.25-inch-thick. Raised lettering indicating outgoing mail slot 12D, about 1.00-inch-high and about 0.25-inch-thick, door is made from sort of plastic, metal, fabricated material or some sort of environmentally friendly material.

Horizontal handle 12E, about 22.00-inches-long by about 1.00-inch-wide. Handle is made from sort of plastic, metal, fabricated material or some sort of environmentally friendly material. Attaches with standard screws that is about 1.00-inch-long, attaches where pre-drilled holes are indicated (FIG. 6B, 7).

Interlocking hinges 13, hinges attach to sides of panels 3, 4, (FIG. 3, 4), of "Safe "4U" Mailbox", about 1.00-inches-wide by 1.00-inch-high, 0.50-inch-thick, for creating interlocking parts for multi-units. Interlocking hinges are located near the top and bottom of mailbox, either glued/screwed, made from sort of plastic, metal, fabricated material or some sort of environmentally friendly material.

FIG. 6B: Front panel 1, about 55.00-inches-high by about 26.00-inches-wide. All Panels are internally trimmed down from 1.00-inch to 0.50-inch to create interlocking panels 2, 3, 4, 5, and 5A, which are created from some sort of plastic, metal, fabricated material or some sort of environmentally friendly material. Front panel has a name plate for homeowner name 8, adhesive backed letter display name 8A, decorative emblem 9, held together with some sort of heavy-duty adhesive, the front panel has cut-out/molded compartment for attaching pull-down incoming/outgoing mail door 12, Formed into incoming/outgoing door are raised lettering indicating U.S. Mail 12A, Raised lettering indicating Approved by the Postmaster General 12B, Raised lettering indicating incoming mail compartment 12C, Raised lettering indicating outgoing mail compartment 12D, Horizontal handle 12E.

Top panel 5, about 28.00-inches-wide by about 27.00-inches-long, and about 2.00-inches-thick, trimmed down from the inside from 1.00-inch to 0.50-inch, top panel has about a 15°-degree curved edge for rain or snow to runoff. Top panel has a 0.25-inch cosmetic seam line at the 1.00-inch mark to give the illusion of two pieces, Address holder attaches to top panel 6. Top panel, address holder is created from some sort of plastic, metal, fabricated material or some sort of environmentally friendly material. Top panel interlocks with panels 1, 2, 3, 4, that are internally trimmed down on the inside from 1.00-inch to 0.50-inch to create interlocking panels (FIG. 8).

Address holder 6, attaches to top panel 5, about 6-inches-long on front and right side, by about 1-inch-high, about 0.50-inches-thick. Address holder fits into molded circular holes on top panel 5, (FIG. 5A). Adhesive backed numbers used on market are about 0.50-inch-high by 0.50-inch-wide. Address holder is made from some sort of plastic, metal, fabricated material or some sort of environmentally friendly material and secured with some sort of adhesive.

Flag 7, mounted on the side of right panel (FIG. 4), flag is about 10.00-inches-high, made from sort of plastic, metal, fabricated material or some sort of environmentally friendly material. Top portion of flag has about a 2.00-inches-high by 2.00-inches-wide square when raised.

Flag mount 7A, mount is conventional 2.00-inch by 2.00-inch-square (FIG. 4), screw for mount is about 1.00-inch-long.

Homeowners' nameplate 8, about 20.00-inches-long by about 2.00-inches-wide, about 2.00-inches-high, and about 0.50-inch-thick. Holding up to about (18) 1.00-inch by 1.00-inch adhesive backed letters for displaying homeowners' last name 8A, if desired. Nameplate may be expanded with some sort of expanders/s-hooks if homeowner desires for additional names. Made from some sort of plastic, metal, fabricated material or some sort of environmentally friendly material, secured with some sort of heavy-duty adhesive, expanders/s-hooks are market items.

Reflectors 10, adhesive backed reflectors come in varies colors and attach to right panel 4, (FIG. 4), reflectors are between 4.00-inches-high, 2.00-inches-wide, either circular or square.

Newspaper/advertisement attachment 11, about 8.00-inches-high by about 8.00-inches-wide, about 12.00-inches-long, and about 0.50-inch-thick, molded into panel 3 (FIG. 3). Top portion of the newspapers/advertisement has lettering identifying slot 11A. Made from sort of plastic, metal, fabricated material or some sort of environmentally friendly material.

Incoming/outgoing mailbox door 12, door attaches to upper front panel of the "Safe "4U" Mailbox" and is a pull-down door. Incoming/outgoing door is about 14.00-inches-high by about 24-inches-wide, and about 0.50-inch-thick. Pegs 17B (FIG. 6B), are about are about 0.25-inch in diameter by about 4.50-inches-long so they fit into the sides pre-formed holes within front panel 1 (FIG. 6B).

Horizontal handle 12E, about 22.00-inches-long by about 1.00-inch-wide. Handle is made from sort of plastic, metal, fabricated material or some sort of environmentally friendly material. Attaches with standard screws that is about 1.00-inch-long, attaches where pre-drilled holes are indicated (FIG. 6B, 7).

Incoming mail slot lettering 12G, raised lettering indicating incoming mail slot, about 0.25-inch-high and about 0.25-inch-thick.

Outgoing mail slot lettering 12H, raised lettering indicating outgoing mail slot, about 0.25-inch-high and about 0.25-inch-thick.

Pre-drilled holes 12I, for attaching the horizontal handle to the incoming/outgoing mailbox door.

Trim 12J, about 23.00-inch-wide by 13.00-inch-high by about 0.25-inch thick, fits in groove of incoming/outgoing mail door.

Interlocking hinges 13, hinges attach to sides of panels 3, 4, (FIG. 3, 4), of "Safe "4U" Mailbox", about 1.00-inches-wide by 1.00-inch-high, 0.50-inch-thick, for creating interlocking parts for multi-units. Interlocking hinges are located near the top and bottom of mailbox, either glued/screwed, made from sort of plastic, metal, fabricated material or some sort of environmentally friendly material.

Incoming/outgoing mailbox chamber 14, about 13.50-inch-high by about 23.50-inch-wide and about 0.50-inch-thick. Chamber is formed/molded into front panel 1, and rear panel 2, for which incoming/outgoing mail compartments slide into chamber. Made from sort of plastic, metal, fabricated material or some sort of environmentally friendly material as one unit that's inserted into upper section of front panel.

Incoming mailbox compartment 14A, about 13.00-inch-high by 13.00-inch-wide, about 0.25-inch-thick with opening at base for incoming mail and small packages to fall into a secure basket (FIG. 8) for pick-up.

Incoming mailbox lip 14B, about 13.00-inch-long by 2.00-inch-wide, about 0.25-inch-thick to guild/slide incoming mail/small packages into secure area.

Center divider 14C, about 13.00-inch-high by 25.00-inch-long, about 0.25-inch-thick to separate incoming/outgoing compartments.

Outgoing mailbox compartment 15, about 13.00-inch-high by 10.00-inch-wide, about 25.00-inch-long, allowing homeowner to safely insert outgoing mail from rear of unit.

Raised outgoing mail floor 15A, about 1.00-inch-high by 10.00-inches-wide, about 25.00-inches-long so awaiting outgoing mail doesn't get wet.

Trim 15B, about 13.00-inch-high by about 23.00-inch-wide, about 0.25-inch thick to fit in groove of incoming/outgoing mail door.

Angled chute 16, about 12.00-inch-long, about 2.00-inch-wide, on about a 45°-degree angle, for guiding mail/small packages into awaiting basket 26.

Side wall of incoming compartment 16A, about 13.00-inch-high by 14.00-inch-long, about 0.25-inch-thick, angle chute 16, is formed/molded into side wall for guiding mail/small packages into awaiting basket 26.

Bumper board 16B, about 13.00-inch-high by about 13.00-inch-in wide, about 11-inch deep, about 0.25-inch-thick, for guiding mail/small packages into awaiting basket 26, (FIG. 8).

Rear view of upper outgoing mail door 17, about 14.00-inches-high by about 10.00-inches-wide, about 0.50-inch-thick to insert outgoing mail from rear of unit (FIG. 11). Door is secured with pegs 17B (FIG. 7, 11), that are about are about 0.25-inch in diameter by about 4.50-inches-long, pre-formed holes for pegs are formed into upper section of rear panel 2, (FIG. 11), made from sort of plastic, metal, fabricated material or some sort of environmentally friendly material.

Pegs 17B, resized, pegs are inserted into peg sleeves 17C, (FIG. 6B), either square or circular, allowing for opening/closing of incoming/outgoing mail door, outgoing mail door, and lower secure door (FIG. 12,13). Pegs are about 0.25-inch in diameter and about 4.50-inches long, Made from some sort of plastic, metal, wood, fabricated material or some sort of environmentally friendly material.

Peg chamber 17C, either square or circular, about 0.25-inch in diameter by about 2.00-inches-deep, chambers are formed/molded into panels 1, 2, (FIGS. 6, 12, 13). Made from plastic, wood, metal, fabricated material or some sort of environmentally friendly material.

Rearview of outgoing door screw mount (17D), about 1.00-inch long, standard market item.

Magnet 20, about 0.25-inch-wide by about 1.00-inch-long, fits into molded grooves of mailbox.

FIG. 7: "Safe "4U" Mailbox" without top compartment and transparent side panel consisting of:

Left panel 3, about 55.00-inches-high by about 27.00-inches-wide. Panel has molded compartment for newspaper/advertisement attachment 11, either glued/screwed interlocking attachments 13, All Panels are internally trimmed down from the inside from 1.00-inch to 0.50-inch to create interlocking panels with 1, 2, 4, 5 and 5A, made from some sort of plastic, metal, fabricated material or some sort of environmentally friendly material. Held together with some sort of heavy-duty adhesive and secured with some sort of tamper resistance screws, threaded screws, fasteners, bolts, and/or rivets, 23 (FIG. 5C, 8), which are about 1.00-inch-long.

Transparent right panel 4, about 55.00-inches-high by about 27.00-inches-wide. Panel has either glued/screwed reflectors 10, All Panels are internally trimmed down from the inside from 1.00-inch to 0.50-inch to create interlocking panels with 1, 2, 4, 5 and 5A, made from some sort of plastic, metal, fabricated material or some sort of environmentally friendly material. Held together with some sort of heavy-duty adhesive and secured with some sort of tamper resistance screws, threaded screws, fasteners, bolts, and/or rivets, 23 (FIG. 5C, 8), which are about 1.00-inch-long.

Incoming/outgoing mailbox door 12, door attaches to upper front panel of the "Safe "4U" Mailbox" and is a pull-down door. Incoming/outgoing door is about 14.00-inches-high by about 24-inches-wide, and about 0.50-inch-thick. Pegs 17B (FIG. 6B), are about are about 0.25-inch in diameter by about 4.50-inches-long so they fit into the sides pre-formed holes within front panel 1 (FIG. 6B).

Pre-drilled holes 12I, for attaching the horizontal handle to the incoming/outgoing mailbox door.

Trim 12J, about 23.00-inch-wide by 13.00-inch-high by about 0.25-inch thick, fits in groove of incoming/outgoing mail door.

Incoming mailbox compartment 14A, about 13.00-inch-high by 13.00-inch-wide, about 0.25-inch-thick with opening at base for incoming mail and small packages to fall into a secure basket (FIG. 8) for pick-up.

Incoming mailbox lip 14B, about 13.00-inch-long by 2.00-inch-wide, about 0.25-inch-thick to guild/slide incoming mail/small packages into secure area.

Center divider 14C, about 13.00-inch-high by 25.00-inch-long, about 0.25-inch-thick to separate incoming/outgoing compartments.

Outgoing mailbox compartment 15, about 13.00-inch-high by 10.00-inch-wide, about 25.00-inch-long, allowing homeowner to safely insert outgoing mail from rear of unit.

Raised outgoing mail floor 15A, about 1.00-inch-high by 10.00-inches-wide, about 25.00-inches-long so awaiting outgoing mail doesn't get wet.

Angled chute 16, about 12.00-inch-long, about 2.00-inch-wide, on about a 45°-degree angle, for guiding mail/small packages into awaiting basket 26.

Side wall of incoming compartment 16A, about 13.00-inch-high by 14.00-inch-long, about 0.25-inch-thick, angle chute 16, is formed/molded into side wall for guiding mail/small packages into awaiting basket 26.

Bumper board 16B, about 13.00-inch-high by about 13.00-inch-in wide, about 11-inch deep, about 0.25-inch-thick, for guiding mail/small packages into awaiting basket 26, (FIG. 8).

Upper outgoing mail door 17, about 14.00-inches-high by about 10.00-inches-wide, about 0.50-inch-thick to insert outgoing mail from rear of unit (FIG. 11). Door is secured with pegs 17B (FIG. 7, 11), that are about are about 0.25-inch in diameter by about 4.50-inches-long, pre-formed holes for pegs are formed into upper section of rear panel 2, (FIG. 11), made from sort of plastic, metal, fabricated material or some sort of environmentally friendly material.

Upper outgoing mail door knob 17A, about 2.00-inches by 2.00-inches round in diameter, attached with standard screw where pre-drilled hole is indicated 17D (FIG. 6B, 9, 12). Made from sort of plastic, metal, fabricated material or some sort of environmentally friendly material.

Pegs 17B, resized, pegs are inserted into peg sleeves 17C, (FIG. 6B), either square or circular, allowing for opening/closing of incoming/outgoing mail door, outgoing mail door, and lower secure door (FIG. 12,13). Pegs are about 0.25-inch in diameter and about 4.50-inches long, Made from some sort of plastic, metal, wood, fabricated material or some sort of environmentally friendly material.

Peg chamber 17C, either square or circular, about 0.25-inch in diameter by about 2.00-inches-deep, chambers are formed/molded into panels 1, 2, (FIGS. 6, 12, 13). Made from plastic, wood, metal, fabricated material or some sort of environmentally friendly material.

Magnet 20, about 0.25-inch-wide by about 1.00-inch-long, fits into molded grooves of mailbox.

FIG. 8: Depicts internal cross section of the "Safe "4U" Mailbox" consisting of:

Sideview of front panel 1, about 55.00-inches-high by about 26.00-inches-wide. All Panels are internally trimmed down from 1.00-inch to 0.50-inch to create interlocking panels 2, 3, 4, 5, and 5A, which are created from some sort of plastic, metal, fabricated material or some sort of environmentally friendly material. Front panel has a name plate for homeowner name 8, front panel has cut-out/molded compartment for attaching pull-down incoming/outgoing mail door 12.

Sideview of rear panel 2, about 55.00-inches-high by about 26.00-inches-wide. Panel has two cut-out/molded compartments, outgoing mail 15, lower secure compartment 18D. All Panels are internally trimmed down from the inside from 1.00-inch to 0.50-inch to create interlocking panels with 1, 3, 4, 5 and 5A, made from some sort of plastic, metal, fabricated material or some sort of environmentally friendly material. Held together with some sort of heavy-duty adhesive and secured with some sort of tamper resistance screws, threaded screws, fasteners, bolts, and/or rivets, 23 (FIG. 5C, 8), which are about 1.00-inch-long.

Top panel 5, about 28.00-inches-wide by about 27.00-inches-long, and about 2.00-inches-thick, trimmed down from the inside from 1.00-inch to 0.50-inch, top panel has about a 15°-degree curved edge for rain or snow to runoff. Top panel has a 0.25-inch cosmetic seam line at the 1.00-inch mark to give the illusion of two pieces, Address holder attaches to top panel 6. Top panel, address holder is created from some sort of plastic, metal, fabricated material or some sort of environmentally friendly material. Top panel interlocks with panels 1, 2, 3, 4, that are internally trimmed down on the inside from 1.00-inch to 0.50-inch to create interlocking panels (FIG. 8).

Sideview of Interlocking baseplate 5A, about 28.00-inches-wide by about 27.00-inches-long, and about 2.00-inches-thick, trimmed down from the inside from 1.00-inch to 0.50-inch, baseplate has about a 15°-degree curved edge for rain or snow to runoff. Created from some sort of plastic, metal, fabricated material or some sort of environmentally friendly material. Base plate interlocks with panels 1, 2, 3, 4, that are internally trimmed down on the inside from 1.00-inch to 0.50-inch to create interlocking panels (FIG. 8).

Sideview of address holder 6, attaches to top panel 5, about 6-inches-long on front and right side, by about 1-inch-high, about 0.50-inches-thick. Address holder fits into molded circular holes on top panel 5, (FIG. 5A). Adhesive backed numbers used on market are about 0.50-inch-high by 0.50-inch-wide. Address holder is made from some sort of plastic, metal, fabricated material or some sort of environmentally friendly material and secured with some sort of adhesive.

Sideview of Flag 7, mounted on the side of right panel (FIG. 4), flag is about 10.00-inches-high, made from sort of plastic, metal, fabricated material or some sort of environmentally friendly material. Top portion of flag has about a 2.00-inches-high by 2.00-inches-wide square when raised.

Sideview of homeowners' nameplate 8, about 20.00-inches-long by about 2.00-inches-wide, about 2.00-inches-high, and about 0.50-inch-thick. Holding up to about (18) 1.00-inch by 1.00-inch adhesive backed letters for displaying homeowners' last name 8A, if desired. Nameplate may be expanded with some sort of expanders/s-hooks if homeowner desires for additional names. Nameplate is made from some sort of plastic, metal, fabricated material or some sort of environmentally friendly material, secured with some sort of heavy-duty adhesive, expanders/s-hooks are market items.

Sideview of Incoming/outgoing mailbox door 12, Incoming/outgoing door is about 24-inches-wide, about 14.00-inches-high, and about 0.50-inch-thick, and is a pull-down door. Door is attached to upper front panel of the "Safe "4U" Mailbox" with pegs 17B (FIG. 6B). Formed into incoming/outgoing door are raised lettering indicating U.S. Mail 12A, letters are about 1.00-inch-high, about 0.25-inch-thick. Raised lettering indicating Approved by the Postmaster General 12B, about 0.50-inches-high and about 0.25-inch-thick. Raised lettering indicating incoming mail slot 12C, about 1.00-inch-high and about 0.25-inch-thick. Door is made from sort of plastic, metal, fabricated material or some sort of environmentally friendly material.

Sideview of horizontal handle 12E, about 22.00-inches-long by about 1.00-inch-wide. Handle is made from sort of plastic, metal, fabricated material or some sort of environmentally friendly material. Attaches with standard screws that is about 1.00-inch-long, attaches where pre-drilled holes are indicated (FIG. 6B, 7).

Sideview of incoming mailbox lip 14B, about 13.00-inch-long by 2.00-inch-wide, about 0.25-inch-thick to guild/slide incoming mail/small packages into secure area.

Angled chute 16, about 12.00-inch-long, about 2.00-inch-wide, on about a 45°-degree angle, for guiding mail/small packages into awaiting basket 26.

Sideview of side wall of incoming compartment 16A, about 13.00-inch-high by 14.00-inch-long, about 0.25-inch-thick, angle chute 16, is formed/molded into side wall for guiding mail/small packages into awaiting basket 26.

Sideview of bumper board 16B, about 13.00-inch-high by about 13.00-inch-in wide, about 11-inch deep, about 0.25-inch-thick, for guiding mail/small packages into awaiting basket 26, (FIG. 8).

Sideview of Upper outgoing mail door 17, about 14.00-inches-high by about 10.00-inches-wide, about 0.50-inch-thick to insert outgoing mail from rear of unit (FIG. 11). Door is secured with pegs 17B (FIG. 7, 11), that are about are about 0.25-inch in diameter by about 4.50-inches-long, pre-formed holes for pegs are formed into upper section of rear panel 2, (FIG. 11), made from sort of plastic, metal, fabricated material or some sort of environmentally friendly material.

Sideview of Upper outgoing mail door knob 17A, about 2.00-inches by 2.00-inches round in diameter, attached with standard screw where pre-drilled hole is indicated 17D (FIG. 6B, 9, 12). Made from sort of plastic, metal, fabricated material or some sort of environmentally friendly material.

Sideview of lower rear secure door, 18, about 16.00-inch-high by about 20.00-inch-wide, about 0.50-inch-thick, attaches through pre-formed holes in lower panel 2, secured with pegs 17B (FIG. 13), that are about 0.25-inch in diameter by about 4.50-inches-long. Made from sort of plastic, metal, fabricated material or some sort of environmentally friendly material.

Sideview of vertical handle 18J, about 14.00-inch-long by about 1.00-inch-wide, made from sort of plastic, metal, fabricated material or some sort of environmentally friendly material, attached with standard screws that is about 1.00-inch-long, attaches where pre-drilled holes are indicated (FIG. 13C).

Sideview of covered awning, 19, about 22.00-inches-long by about 2.00-inches-wide, 0.50-inch-thick, sloped on about a 45°-degrees, molded into back of panel 2. Made from sort of plastic, metal, fabricated material or some sort of environmentally friendly material.

Sideview of magnet 20, about 0.25-inch-wide by about 1.00-inch-long, fits into molded grooves of mailbox.

Couplings 21, about 1.25-inch-round by about 1.00-inch-deep, secured with adhesive to pegboard 24, made from sort of plastic, metal, fabricated material or some sort of environmentally friendly material.

Poles, 22, about 1.00-inch-wide by about 30.00-inch-long, internal poles are about 18.00-inch-long, remaining 12.00-inches go through cut-outs (FIG. 5B), buried into ground to secure unit.

Circular plastic seals 22A, about 1.00-inch by 1.00-inch in diameter, to seal inside of mailbox from bugs and moisture (FIG. 5B).

Sideview of tamper resistance screws, threaded screws, fasteners, bolts, and/or rivets 23, about 1.00-inch-long to secure panels together. Made from sort of plastic, metal, fabricated material or some sort of environmentally friendly material.

Sideview of peg board 24, about 25.00-inch-long by about 25.00-inch-wide, about 0.50-inch-thick, about 0.25-inch-circular cutout holes throughout 27 (FIG. 10). Made from sort of plastic, metal, fabricated material or some sort of environmentally friendly material.

Sideview of railing system 25, about 24.00-inches-long by 1.00-inch-wide, two rails are mounted about 10.00-inches apart on peg board 24, rollers are inserted into rails and are about 0.25-inch-thick, for basket to glide in/out when retrieving incoming mail/small packages. Made from sort of plastic, metal, fabricated material or some sort of environmentally friendly material.

Sideview of basket 26, about 24.00-inch-long by about 24.00-inch-wide, about 14.00-inch-deep for retrieving incoming mail/small packages. Made from sort of plastic, metal, fabricated material or some sort of environmentally friendly material.

FIG. 9: Depicts internal cross section of the "Safe "4U" Mailbox" with basket pulled out consisting of:

Sideview of front panel 1, about 55.00-inches-high by about 26.00-inches-wide. All Panels are internally trimmed down from 1.00-inch to 0.50-inch to create interlocking panels 2, 3, 4, 5, and 5A, which are created from some sort of plastic, metal, fabricated material or some sort of environmentally friendly material. Front panel has a name plate for homeowner name 8, front panel has cut-out/molded compartment for attaching pull-down incoming/outgoing mail door 12.

Sideview of rear panel 2, about 55.00-inches-high by about 26.00-inches-wide. Panel has two cut-out/molded compartments, outgoing mail 15, lower secure compartment 18D. All Panels are internally trimmed down from the inside from 1.00-inch to 0.50-inch to create interlocking panels with 1, 3, 4, 5 and 5A, made from some sort of plastic, metal, fabricated material or some sort of environmentally friendly material. Held together with some sort of heavy-duty adhesive and secured with some sort of tamper resistance screws, threaded screws, fasteners, bolts, and/or rivets, 23 (FIG. 5C, 8), which are about 1.00-inch-long.

Top panel 5, about 28.00-inches-wide by about 27.00-inches-long, and about 2.00-inches-thick, trimmed down from the inside from 1.00-inch to 0.50-inch, top panel has about a 15°-degree curved edge for rain or snow to runoff. Top panel has a 0.25-inch cosmetic seam line at the 1.00-inch mark to give the illusion of two pieces, Address holder attaches to top panel 6. Top panel, address holder is created from some sort of plastic, metal, fabricated material or some sort of environmentally friendly material. Top panel interlocks with panels 1, 2, 3, 4, that are internally trimmed down on the inside from 1.00-inch to 0.50-inch to create interlocking panels (FIG. 8).

Sideview of Interlocking baseplate 5A, about 28.00-inches-wide by about 27.00-inches-long, and about 2.00-inches-thick, trimmed down from the inside from 1.00-inch to 0.50-inch, baseplate has about a 15°-degree curved edge for rain or snow to runoff. Created from some sort of plastic, metal, fabricated material or some sort of environmentally friendly material. Base plate interlocks with panels 1, 2, 3, 4, that are internally trimmed down on the inside from 1.00-inch to 0.50-inch to create interlocking panels (FIG. 8).

Sideview of address holder 6, attaches to top panel 5, about 6-inches-long on front and right side, by about 1-inch-high, about 0.50-inches-thick. Address holder fits into molded circular holes on top panel 5, (FIG. 5A). Adhesive backed numbers used on market are about 0.50-inch-high by 0.50-inch-wide. Address holder is made from some sort of plastic, metal, fabricated material or some sort of environmentally friendly material and secured with some sort of adhesive.

Portion of Flag 7, mounted on the side of right panel (FIG. 4), flag is about 10.00-inches-high, made from sort of plastic, metal, fabricated material or some sort of environmentally friendly material. Top portion of flag has about a 2.00-inches-high by 2.00-inches-wide square when raised.

Sideview of homeowners' nameplate 8, about 20.00-inches-long by about 2.00-inches-wide, about 2.00-inches-high, and about 0.50-inch-thick. Holding up to about (18) 1.00-inch by 1.00-inch adhesive backed letters for displaying homeowners' last name 8A, if desired. Nameplate may be expanded with some sort of expanders/s-hooks if homeowner desires for additional names. Nameplate is made from some sort of plastic, metal, fabricated material or some sort of environmentally friendly material, secured with some sort of heavy-duty adhesive, expanders/s-hooks are market items.

Sideview of Incoming/outgoing mailbox door 12, Incoming/outgoing door is about 24-inches-wide, about 14.00-inches-high, and about 0.50-inch-thick, and is a pull-down door. Door is attached to upper front panel of the "Safe "4U" Mailbox" with pegs 17B (FIG. 6B). Formed into incoming/outgoing door are raised lettering indicating U.S. Mail 12A, letters are about 1.00-inch-high, about 0.25-inch-thick. Raised lettering indicating Approved by the Postmaster General 12B, about 0.50-inches-high and about 0.25-inch-thick. Raised lettering indicating outgoing mail slot 12D, about 1.00-inch-high and about 0.25-inch-thick, door is made from sort of plastic, metal, fabricated material or some sort of environmentally friendly material.

Sideview of horizontal handle 12E, about 22.00-inches-long by about 1.00-inch-wide. Handle is made from sort of plastic, metal, fabricated material or some sort of environmentally friendly material. Attaches with standard screws that is about 1.00-inch-long, attaches where pre-drilled holes are indicated (FIG. 6B, 7).

Outgoing mailbox compartment 15, about 13.00-inch-high by 10.00-inch-wide, about 25.00-inch-long, allowing homeowner to safely insert outgoing mail from rear of unit.

Raised outgoing mail floor 15A, about 1.00-inch-high by 10.00-inches-wide, about 25.00-inches-long so awaiting outgoing mail doesn't get wet.

Trim 15C, about 9.00-inch-high by about 13.00-inch-wide, about 0.25-inch thick, fits in groove of outgoing mail door.

Sideview of Upper outgoing mail door 17, about 14.00-inches-high by about 10.00-inches-wide, about 0.50-inch-thick to insert outgoing mail from rear of unit (FIG. 11). Door is secured with pegs 17B (FIG. 7, 11), that are about are about 0.25-inch in diameter by about 4.50-inches-long, pre-formed holes for pegs are formed into upper section of rear panel 2, (FIG. 11), made from sort of plastic, metal, fabricated material or some sort of environmentally friendly material.

Outgoing door screw mount 17D, about 1.00-inch long, standard market item.

Sideview of lower rear secure door, 18, about 16.00-inch-high by about 20.00-inch-wide, about 0.50-inch-thick, attaches through pre-formed holes in lower panel 2, secured with pegs 17B (FIG. 13), that are about 0.25-inch in diameter by about 4.50-inches-long. Made from sort of plastic, metal, fabricated material or some sort of environmentally friendly material.

Trim 18E, about 19.00-inch-high by 15.00-inch-wide by about 0.25-inch thick, fits into groove of lower rear secure door.

Swing arm 18F, about 2.00-inch-wide by about 3.00-inch-long to lock/unlock secure area.

Rear mount 18G, about 2.00-inches round in diameter, made from some sort of plastic, metal, fabricated material or some sort of environmentally friendly material.

Standard screw, 18H, about 1.00-inch-long screw for securing mount to rear lower secure door.

Pre-drilled holes 18I, for attaching vertical handle to the lower secure door.

Sideview of magnet 20, about 0.25-inch-wide by about 1.00-inch-long, fits into molded grooves of mailbox.

Sideview of couplings 21, about 1.25-inch-round by about 1.00-inch-deep, secured with adhesive to pegboard 24, made from sort of plastic, metal, fabricated material or some sort of environmentally friendly material.

Poles, 22, about 1.00-inch-wide by about 30.00-inch-long, internal poles are about 18.00-inch-long, remaining 12.00-inches go through cut-outs (FIG. 5B), buried into ground to secure unit.

Circular plastic seals 22A, about 1.00-inch by 1.00-inch in diameter, to seal inside of mailbox from bugs and moisture (FIG. 5B).

Sideview of tamper resistance screws, threaded screws, fasteners, bolts, and/or rivets 23, about 1.00-inch-long to secure panels together. Made from sort of plastic, metal, fabricated material or some sort of environmentally friendly material.

Sideview of peg board 24, about 25.00-inch-long by about 25.00-inch-wide, about 0.50-inch-thick, about 0.25-inch-circular cutout holes throughout 27 (FIG. 10). Made from sort of plastic, metal, fabricated material or some sort of environmentally friendly material.

Sideview of railing system 25, about 24.00-inches-long by 1.00-inch-wide, two rails are mounted about 10.00-inches apart on peg board 24, rollers are inserted into rails and are about 0.25-inch-thick, for basket to glide in/out when retrieving incoming mail/small packages. Made from sort of plastic, metal, fabricated material or some sort of environmentally friendly material.

Sideview of basket 26, about 24.00-inch-long by about 24.00-inch-wide, about 14.00-inch-deep for retrieving incoming mail/small packages. Made from sort of plastic, metal, fabricated material or some sort of environmentally friendly material.

FIG. 10: Depicts four views of the "Safe "4U" Mailbox" pegboard with basket pulled out and without basket consisting of:

FIG. 10A: Seam of front panel 1, about 55.00-inches-high by about 26.00-inches-wide. All Panels are internally trimmed down from the inside from 1.00-inch to 0.50-inch to create interlocking panels 2, 3, 4, 5, and 5A, made from some sort of plastic, metal, fabricated material or some sort of environmentally friendly material.

Seam of rear panel 2, about 55.00-inches-high by about 26.00-inches-wide. Panel has two cut-out/molded compartments, outgoing mail 15, lower secure compartment 18D. All Panels are internally trimmed down from the inside from 1.00-inch to 0.50-inch to create interlocking panels with 1, 3, 4, 5 and 5A, made from some sort of plastic, metal, fabricated material or some sort of environmentally friendly material.

Seam of left panel 3, about 55.00-inches-high by about 27.00-inches-wide. Panel has molded compartment for newspaper/advertisement attachment 11, either glued/screwed interlocking attachments 13, All Panels are internally trimmed down from the inside from 1.00-inch to 0.50-inch to create interlocking panels with 1, 2, 4, 5 and 5A, made from some sort of plastic, metal, fabricated material or some sort of environmentally friendly material.

Seam of right panel 4, about 55.00-inches-high by about 27.00-inches-wide. Panel has either glued/screwed reflectors 10, All Panels are internally trimmed down from the inside from 1.00-inch to 0.50-inch to create interlocking panels with 1, 2, 4, 5 and 5A, made from some sort of plastic, metal, fabricated material or some sort of environmentally friendly material.

Bottom view of Incoming mailbox compartment 14A, about 13.00-inch-high by 13.00-inch-wide, about 0.25-inch-thick with opening at base for incoming mail and small packages to fall into a secure basket (FIG. 8) for pick-up.

Bottom view of outgoing mailbox compartment 15, about 13.00-inch-high by 10.00-inch-wide, about 25.00-inch-long, allowing homeowner to safely insert outgoing mail from rear of unit.

Bottom view of bumper board 16B, about 13.00-inch-high by about 13.00-inch-in wide, about 11-inch deep, about 0.25-inch-thick, for guiding mail/small packages into awaiting basket 26, (FIG. 8).

Bottom view of couplings 21, about 1.25-inch-round by about 1.00-inch-deep, secured with adhesive to pegboard 24, made from sort of plastic, metal, fabricated material or some sort of environmentally friendly material.

Bottom view of peg board 24, about 25.00-inch-long by about 25.00-inch-wide, about 0.50-inch-thick, about 0.25-inch-circular cutout holes throughout 27 (FIG. 10). Made from sort of plastic, metal, fabricated material or some sort of environmentally friendly material.

Bottom view of railing system 25, about 24.00-inches-long by 1.00-inch-wide, two rails are mounted about 10.00-inches apart on peg board 24, rollers are inserted into rails and are about 0.25-inch-thick, for basket to glide in/out when retrieving incoming mail/small packages. Made from sort of plastic, metal, fabricated material or some sort of environmentally friendly material.

Bottom view of circular cut-out holes, 27, about 0.25-inch by 0.25-inch circular holes, made from sort of plastic, metal, fabricated material or some sort of environmentally friendly material.

Bottom view of side rails, 28, rails are molded/glued into side panels 3, and 4, 24.00-inch-long by 2.00-inch wide by 0.25-inch thick, creating non-moveable pegboard. Made from sort of plastic, metal, fabricated material or some sort of environmentally friendly material.

FIG. 10B: Seam of front panel 1, about 55.00-inches-high by about 26.00-inches-wide. All Panels are internally trimmed down from the inside from 1.00-inch to 0.50-inch to create interlocking panels 2, 3, 4, 5, and 5A, made from some sort of plastic, metal, fabricated material or some sort of environmentally friendly material.

Seam of rear panel 2, about 55.00-inches-high by about 26.00-inches-wide. Panel has two cut-out/molded compartments, outgoing mail 15, lower secure compartment 18D. All Panels are internally trimmed down from the inside from 1.00-inch to 0.50-inch to create interlocking panels with 1, 3, 4, 5 and 5A, made from some sort of plastic, metal, fabricated material or some sort of environmentally friendly material.

Seam of left panel 3, about 55.00-inches-high by about 27.00-inches-wide. Panel has molded compartment for newspaper/advertisement attachment 11, either glued/screwed interlocking attachments 13, All Panels are internally trimmed down from the inside from 1.00-inch to 0.50-inch to create interlocking panels with 1, 2, 4, 5 and 5A, made from some sort of plastic, metal, fabricated material or some sort of environmentally friendly material.

Seam of right panel 4, about 55.00-inches-high by about 27.00-inches-wide. Panel has either glued/screwed reflectors 10, All Panels are internally trimmed down from the inside from 1.00-inch to 0.50-inch to create interlocking panels with 1, 2, 4, 5 and 5A, made from some sort of plastic, metal, fabricated material or some sort of environmentally friendly material.

Couplings 21, about 1.25-inch-round by about 1.00-inch-deep, secured with adhesive to pegboard 24, made from sort of plastic, metal, fabricated material or some sort of environmentally friendly material.

Peg board 24, about 25.00-inch-long by about 25.00-inch-wide, about 0.50-inch-thick, about 0.25-inch-circular cutout holes throughout 27 (FIG. 10). Made from sort of plastic, metal, fabricated material or some sort of environmentally friendly material.

Railing system 25, about 24.00-inches-long by 1.00-inch-wide, two rails are mounted about 10.00-inches apart on peg board 24, rollers are inserted into rails and are about 0.25-inch-thick, for basket to glide in/out when retrieving incoming mail/small packages. Made from sort of plastic, metal, fabricated material or some sort of environmentally friendly material.

Circular cut-out holes, 27, about 0.25-inch by 0.25-inch circular holes, made from sort of plastic, metal, fabricated material or some sort of environmentally friendly material.

Side rails, 28, rails are molded/glued into side panels 3, and 4, 24.00-inch-long by 2.00-inch wide by 0.25-inch thick, creating non-moveable pegboard. Made from sort of plastic, metal, fabricated material or some sort of environmentally friendly material.

FIG. 10C: Portion of right panel 4, about 55.00-inches-high by about 27.00-inches-wide. Panel has either glued/screwed reflectors 10, All Panels are internally trimmed down from the inside from 1.00-inch to 0.50-inch to create interlocking panels with 1, 2, 4, 5 and 5A, made from some sort of plastic, metal, fabricated material or some sort of environmentally friendly material.

Couplings 21, about 1.25-inch-round by about 1.00-inch-deep, secured with adhesive to pegboard 24, made from sort of plastic, metal, fabricated material or some sort of environmentally friendly material.

Peg board 24, about 25.00-inch-long by about 25.00-inch-wide, about 0.50-inch-thick, about 0.25-inch-circular cutout holes throughout 27 (FIG. 10). Made from sort of plastic, metal, fabricated material or some sort of environmentally friendly material.

Railing system 25, about 24.00-inches-long by 1.00-inch-wide, two rails are mounted about 10.00-inches apart on peg board 24, rollers are inserted into rails and are about 0.25-inch-thick, for basket to glide in/out when retrieving incoming mail/small packages. Made from sort of plastic, metal, fabricated material or some sort of environmentally friendly material.

Circular cut-out holes, 27, about 0.25-inch by 0.25-inch circular holes, made from sort of plastic, metal, fabricated material or some sort of environmentally friendly material.

Side rails, 28, rails are molded/glued into side panels 3, and 4, 24.00-inch-long by 2.00-inch wide by 0.25-inch thick, creating non-moveable pegboard. Made from sort of plastic, metal, fabricated material or some sort of environmentally friendly material.

FIG. 10D: Portion of right panel 4, about 55.00-inches-high by about 27.00-inches-wide. Panel has either glued/screwed reflectors 10, All Panels are internally trimmed down from the inside from 1.00-inch to 0.50-inch to create interlocking panels with 1, 2, 4, 5 and 5A, made from some sort of plastic, metal, fabricated material or some sort of environmentally friendly material.

Couplings 21, about 1.25-inch-round by about 1.00-inch-deep, secured with adhesive to pegboard 24, made from sort of plastic, metal, fabricated material or some sort of environmentally friendly material.

Peg board 24, about 25.00-inch-long by about 25.00-inch-wide, about 0.50-inch-thick, about 0.25-inch-circular cutout holes throughout 27 (FIG. 10). Made from sort of plastic, metal, fabricated material or some sort of environmentally friendly material.

Railing system 25, about 24.00-inches-long by 1.00-inch-wide, two rails are mounted about 10.00-inches apart on peg board 24, rollers are inserted into rails and are about 0.25-inch-thick, for basket to glide in/out when retrieving incoming mail/small packages. Made from sort of plastic, metal, fabricated material or some sort of environmentally friendly material.

Basket 26, about 24.00-inch-long by about 24.00-inch-wide, about 14.00-inch-deep for retrieving incoming mail/small packages. Made from sort of plastic, metal, fabricated material or some sort of environmentally friendly material.

Circular cut-out holes, 27, about 0.25-inch by 0.25-inch circular holes, made from sort of plastic, metal, fabricated material or some sort of environmentally friendly material.

Side rails, 28, rails are molded/glued into side panels 3, and 4, 24.00-inch-long by 2.00-inch wide by 0.25-inch thick, creating non-moveable pegboard. Made from sort of plastic, metal, fabricated material or some sort of environmentally friendly material.

FIG. 11: Depicts Rear upper view of "Safe "4U" Mailbox" with outgoing mail chamber, pegs and door consisting of:

Portion of rear panel 2, about 55.00-inches-high by about 26.00-inches-wide. Panel has two cut-out/molded compartments, outgoing mail 15, lower secure compartment 18D. All Panels are internally trimmed down from the inside from 1.00-inch to 0.50-inch to create interlocking panels with 1, 3, 4, 5 and 5A, made from some sort of plastic, metal, fabricated material or some sort of environmentally friendly material. Held together with some sort of heavy-duty adhesive and secured with some sort of tamper resistance screws, threaded screws, fasteners, bolts, and/or rivets, 23 (FIG. 5C, 8), which are about 1.00-inch-long.

Top panel 5, about 28.00-inches-wide by about 27.00-inches-long, and about 2.00-inches-thick, trimmed down from the inside from 1.00-inch to 0.50-inch, top panel has about a 15°-degree curved edge for rain or snow to runoff. Top panel has a 0.25-inch cosmetic seam line at the 1.00-inch mark to give the illusion of two pieces, Address holder attaches to top panel 6. Top panel, address holder is created from some sort of plastic, metal, fabricated material or some sort of environmentally friendly material. Top panel interlocks with panels 1, 2, 3, 4, that are internally trimmed down on the inside from 1.00-inch to 0.50-inch to create interlocking panels (FIG. 8).

Address holder 6, attaches to top panel 5, about 6-inches-long on front and right side, by about 1-inch-high, about 0.50-inches-thick. Address holder fits into molded circular holes on top panel 5, (FIG. 5A). Adhesive backed numbers used on market are about 0.50-inch-high by 0.50-inch-wide. Address holder is made from some sort of plastic, metal, fabricated material or some sort of environmentally friendly material and secured with some sort of adhesive.

Flag 7, mounted on the side of right panel (FIG. 4), flag is about 10.00-inches-high, made from sort of plastic, metal, fabricated material or some sort of environmentally friendly material. Top portion of flag has about a 2.00-inches-high by 2.00-inches-wide square when raised.

Flag mount 7A, mount is conventional 2.00-inch by 2.00-inch-square, (FIG. 4), screw for mount is about 1.00-inch-long.

Reflectors 10, adhesive backed reflectors come in varies colors and attach to right panel 4, (FIG. 4), reflectors are between 4.00-inches-high, 2.00-inches-wide, either circular or square.

Newspaper/advertisement attachment 11, about 8.00-inches-high by about 8.00-inches-wide, about 12.00-inches-long, and about 0.50-inch-thick, molded into panel 3 (FIG. 3). Made from sort of plastic, metal, fabricated material or some sort of environmentally friendly material.

Outgoing mail slot lettering 12H, raised lettering indicating outgoing mail slot, about 0.25-inch-high and about 0.25-inch-thick.

Interlocking hinges 13, hinges attach to sides of panels 3, 4, (FIG. 3, 4), of "Safe "4U" Mailbox", about 1.00-inches-wide by 1.00-inch-high, 0.50-inch-thick, for creating interlocking parts for multi-units. Interlocking hinges are located near the top and bottom of mailbox, either glued/screwed, made from sort of plastic, metal, fabricated material or some sort of environmentally friendly material.

Outgoing mailbox compartment 15, about 13.00-inch-high by 10.00-inch-wide, about 25.00-inch-long, allowing homeowner to safely insert outgoing mail from rear of unit.

Raised outgoing mail floor 15A, about 1.00-inch-high by 10.00-inches-wide, about 25.00-inches-long so awaiting outgoing mail doesn't get wet.

Trim 15C, about 9.00-inch-high by about 13.00-inch-wide, about 0.25-inch thick, fits in groove of outgoing mail door.

Upper outgoing mail door 17, about 14.00-inches-high by about 10.00-inches-wide, about 0.50-inch-thick to insert outgoing mail from rear of unit (FIG. 11). Door is secured with pegs 17B (FIG. 7, 11), that are about are about 0.25-inch in diameter by about 4.50-inches-long, pre-formed holes for pegs are formed into upper section of rear panel 2, (FIG. 11), made from sort of plastic, metal, fabricated material or some sort of environmentally friendly material.

Upper outgoing mail door knob 17A, about 2.00-inches by 2.00-inches round in diameter, attached with standard screw where pre-drilled hole is indicated 17D (FIG. 6B, 9, 12). Made from sort of plastic, metal, fabricated material or some sort of environmentally friendly material.

Pegs 17B, resized, pegs are inserted into peg sleeves 17C, (FIG. 6B), either square or circular, allowing for opening/closing of incoming/outgoing mail door, outgoing mail door, and lower secure door (FIG. 12,13). Pegs are about 0.25-inch in diameter and about 4.50-inches long. Made from some sort of plastic, metal, wood, fabricated material or some sort of environmentally friendly material Peg chamber 17C, either square or circular, about 0.25-inch in diameter by about 2.00-inches-deep, chambers are formed/molded into panels 1, 2, (FIGS. 6, 12, 13). Made from plastic, wood, metal, fabricated material or some sort of environmentally friendly material.

Magnet 20, about 0.25-inch-wide by about 1.00-inch-long, fits into molded grooves of mailbox.

FIG. 12: Depicts Rear of "Safe "4U" Mailbox" with upper rear door attached/detached showing front and back views of doors, consisting of:

FIG. 12A: Rear panel 2, about 55.00-inches-high by about 26.00-inches-wide. Panel has two cut-out/molded compartments, outgoing mail 15, lower secure compartment 18D. All Panels are internally trimmed down from the inside from 1.00-inch to 0.50-inch to create interlocking panels with 1, 3, 4, 5 and 5A, made from some sort of plastic, metal, fabricated material or some sort of environmentally friendly material. Held together with some sort of heavy-duty adhesive and secured with some sort of tamper resistance screws, threaded screws, fasteners, bolts, and/or rivets, 23 (FIG. 5C, 8), which are about 1.00-inch-long.

Top panel 5, about 28.00-inches-wide by about 27.00-inches-long, and about 2.00-inches-thick, trimmed down from the inside from 1.00-inch to 0.50-inch, top panel has about a 15°-degree curved edge for rain or snow to runoff. Top panel has a 0.25-inch cosmetic seam line at the 1.00-inch mark to give the illusion of two pieces, Address holder attaches to top panel 6. Top panel, address holder is created from some sort of plastic, metal, fabricated material or some sort of environmentally friendly material. Top panel interlocks with panels 1, 2, 3, 4, that are internally trimmed down on the inside from 1.00-inch to 0.50-inch to create interlocking panels (FIG. 8).

Sideview of Interlocking baseplate 5A, about 28.00-inches-wide by about 27.00-inches-long, and about 2.00-inches-thick, trimmed down from the inside from 1.00-inch to 0.50-inch, baseplate has about a 15°-degree curved edge for rain or snow to runoff. Created from some sort of plastic, metal, fabricated material or some sort of environmentally friendly material. Base plate interlocks with panels 1, 2, 3, 4, that are internally trimmed down on the inside from 1.00-inch to 0.50-inch to create interlocking panels (FIG. 8).

Address holder 6, attaches to top panel 5, about 6-inches-long on front and right side, by about 1-inch-high, about 0.50-inches-thick. Address holder fits into molded circular holes on top panel 5, (FIG. 5A). Adhesive backed numbers used on market are about 0.50-inch-high by 0.50-inch-wide. Address holder is made from some sort of plastic, metal, fabricated material or some sort of environmentally friendly material and secured with some sort of adhesive.

Flag 7, mounted on the side of right panel (FIG. 4), flag is about 10.00-inches-high, made from sort of plastic, metal, fabricated material or some sort of environmentally friendly material. Top portion of flag has about a 2.00-inches-high by 2.00-inches-wide square when raised.

Flag mount 7A, mount is conventional 2.00-inch by 2.00-inch-square, (FIG. 4), screw for mount is about 1.00-inch-long.

Reflectors 10, adhesive backed reflectors come in varies colors and attach to right panel 4, (FIG. 4), reflectors are between 4.00-inches-high, 2.00-inches-wide, either circular or square.

Newspaper/advertisement attachment 11, about 8.00-inches-high by about 8.00-inches-wide, about 12.00-inches-long, and about 0.50-inch-thick, molded into panel 3 (FIG. 3). Made from sort of plastic, metal, fabricated material or some sort of environmentally friendly material.

Interlocking hinges 13, hinges attach to sides of panels 3, 4, (FIG. 3, 4), of "Safe "4U" Mailbox", about 1.00-inches-wide by 1.00-inch-high, 0.50-inch-thick, for creating interlocking parts for multi-units. Interlocking hinges are located near the top and bottom of mailbox, either glued/screwed, made from sort of plastic, metal, fabricated material or some sort of environmentally friendly material.

Upper outgoing mail door 17, about 14.00-inches-high by about 10.00-inches-wide, about 0.50-inch-thick to insert outgoing mail from rear of unit (FIG. 11). Door is secured with pegs 17B (FIG. 7, 11), that are about are about 0.25-inch in diameter by about 4.50-inches-long, pre-formed holes for pegs are formed into upper section of rear panel 2, (FIG. 11), made from sort of plastic, metal, fabricated material or some sort of environmentally friendly material.

Upper outgoing mail door knob 17A, about 2.00-inches by 2.00-inches round in diameter, attached with standard screw where pre-drilled hole is indicated 17D (FIG. 6B, 9, 12). Made from sort of plastic, metal, fabricated material or some sort of environmentally friendly material.

Pegs 17B, resized, pegs are inserted into peg sleeves 17C, (FIG. 6B), either square or circular, allowing for opening/closing of incoming/outgoing mail door, outgoing mail door, and lower secure door (FIG. 12,13). Pegs are about 0.25-inch in diameter and about 4.50-inches long. Made from some sort of plastic, metal, wood, fabricated material or some sort of environmentally friendly material Peg chamber 17C, either square or circular, about 0.25-inch in diameter by about 2.00-inches-deep, chambers are formed/molded into panels 1, 2, (FIGS. 6, 12, 13). Made from plastic, wood, metal, fabricated material or some sort of environmentally friendly material.

Lower secure chamber 18D, about 15.00-inch-high by about 19.00-inch-wide, about 0.50-inch-thick, molded into panel 2, for securing incoming mail/small packages.

Trim 18K, about 14.00-inch-high by 18.00-inch-wide by about 0.25-inch thick, fits into groove of lower rear secure door.

Covered awning, 19, about 22.00-inches-long by about 2.00-inches-wide, 0.50-inch-thick, sloped on about a 45°-degrees, molded into back of panel 2. Made from sort of plastic, metal, fabricated material or some sort of environmentally friendly material.

FIG. 12B: Upper outgoing mail door 17, about 14.00-inches-high by about 10.00-inches-wide, about 0.50-inch-thick to insert outgoing mail from rear of unit (FIG. 11). Door is secured with pegs 17B (FIG. 7, 11), that are about are about 0.25-inch in diameter by about 4.50-inches-long, pre-formed holes for pegs are formed into upper section of rear panel 2, (FIG. 11), made from sort of plastic, metal, fabricated material or some sort of environmentally friendly material.

Upper outgoing mail door knob 17A, about 2.00-inches by 2.00-inches round in diameter, attached with standard screw where pre-drilled hole is indicated 17D (FIG. 6B, 9, 12). Made from sort of plastic, metal, fabricated material or some sort of environmentally friendly material.

Pegs 17B, resized, pegs are inserted into peg sleeves 17C, (FIG. 6B), either square or circular, allowing for opening/closing of incoming/outgoing mail door, outgoing mail door, and lower secure door (FIG. 12,13). Pegs are about 0.25-inch in diameter and about 4.50-inches long. Made from some sort of plastic, metal, wood, fabricated material or some sort of environmentally friendly material FIG. 12C: Trim 15C, about 9.00-inch-high by about 13.00-inch-wide, about 0.25-inch thick, fits in groove of outgoing mail door.

Upper outgoing mail door 17, about 14.00-inches-high by about 10.00-inches-wide, about 0.50-inch-thick to insert outgoing mail from rear of unit (FIG. 11). Door is secured with pegs 17B (FIG. 7, 11), that are about are about 0.25-inch in diameter by about 4.50-inches-long, pre-formed holes for pegs are formed into upper section of rear panel 2, (FIG. 11), made from sort of plastic, metal, fabricated material or some sort of environmentally friendly material.

Pegs 17B, resized, pegs are inserted into peg sleeves 17C, (FIG. 6B), either square or circular, allowing for opening/closing of incoming/outgoing mail door, outgoing mail door, and lower secure door (FIG. 12,13). Pegs are about 0.25-inch in diameter and about 4.50-inches long. Made from some sort of plastic, metal, wood, fabricated material or some sort of environmentally friendly material.

Outgoing door screw mount 17D, about 1.00-inch long, standard market item.

Magnet 20, about 0.25-inch-wide by about 1.00-inch-long, fits into molded grooves of mailbox.

FIG. 13: Depicts Rear of "Safe "4U" Mailbox", with views of lower secure door attached/detached showing front and back lower secure views consisting of:

FIG. 13A: Rear panel 2, about 55.00-inches-high by about 26.00-inches-wide. Panel has two cut-out/molded compartments, outgoing mail 15, lower secure compartment 18D. All Panels are internally trimmed down from the inside from 1.00-inch to 0.50-inch to create interlocking panels with 1, 3, 4, 5 and 5A, made from some sort of plastic, metal, fabricated material or some sort of environmentally friendly material. Held together with some sort of heavy-duty adhesive and secured with some sort of tamper resistance screws, threaded screws, fasteners, bolts, and/or rivets, 23 (FIG. 5C, 8), which are about 1.00-inch-long.

Top panel 5, about 28.00-inches-wide by about 27.00-inches-long, and about 2.00-inches-thick, trimmed down from the inside from 1.00-inch to 0.50-inch, top panel has about a 15°-degree curved edge for rain or snow to runoff. Top panel has a 0.25-inch cosmetic seam line at the 1.00-inch mark to give the illusion of two pieces, Address holder attaches to top panel 6. Top panel, address holder is created from some sort of plastic, metal, fabricated material or some sort of environmentally friendly material. Top panel interlocks with panels 1, 2, 3, 4, that are internally trimmed down on the inside from 1.00-inch to 0.50-inch to create interlocking panels (FIG. 8).

Sideview of Interlocking baseplate 5A, about 28.00-inches-wide by about 27.00-inches-long, and about 2.00-inches-thick, trimmed down from the inside from 1.00-inch to 0.50-inch, baseplate has about a 15°-degree curved edge for rain or snow to runoff. Created from some sort of plastic, metal, fabricated material or some sort of environmentally friendly material. Base plate interlocks with panels 1, 2, 3, 4, that are internally trimmed down on the inside from 1.00-inch to 0.50-inch to create interlocking panels (FIG. 8).

Address holder 6, attaches to top panel 5, about 6-inches-long on front and right side, by about 1-inch-high, about 0.50-inches-thick. Address holder fits into molded circular holes on top panel 5, (FIG. 5A). Adhesive backed numbers used on market are about 0.50-inch-high by 0.50-inch-wide. Address holder is made from some sort of plastic, metal, fabricated material or some sort of environmentally friendly material and secured with some sort of adhesive.

Flag 7, mounted on the side of right panel (FIG. 4), flag is about 10.00-inches-high, made from sort of plastic, metal, fabricated material or some sort of environmentally friendly material. Top portion of flag has about a 2.00-inches-high by 2.00-inches-wide square when raised.

Flag mount 7A, mount is conventional 2.00-inch by 2.00-inch-square, (FIG. 4), screw for mount is about 1.00-inch-long.

Reflectors 10, adhesive backed reflectors come in varies colors and attach to right panel 4, (FIG. 4), reflectors are between 4.00-inches-high, 2.00-inches-wide, either circular or square.

Newspaper/advertisement attachment 11, about 8.00-inches-high by about 8.00-inches-wide, about 12.00-inches-long, and about 0.50-inch-thick, molded into panel 3 (FIG. 3). Made from sort of plastic, metal, fabricated material or some sort of environmentally friendly material.

Outgoing mail slot lettering 12H, raised lettering indicating outgoing mail slot, about 0.25-inch-high and about 0.25-inch-thick.

Interlocking hinges 13, hinges attach to sides of panels 3, 4, (FIG. 3, 4), of "Safe "4U" Mailbox", about 1.00-inches-wide by 1.00-inch-high, 0.50-inch-thick, for creating interlocking parts for multi-units. Interlocking hinges are located near the top and bottom of mailbox, either glued/screwed, made from sort of plastic, metal, fabricated material or some sort of environmentally friendly material.

Outgoing mailbox compartment 15, about 13.00-inch-high by 10.00-inch-wide, about 25.00-inch-long, allowing homeowner to safely insert outgoing mail from rear of unit.

Raised outgoing mail floor 15A, about 1.00-inch-high by 10.00-inches-wide, about 25.00-inches-long so awaiting outgoing mail doesn't get wet.

Trim 15C, about 9.00-inch-high by about 13.00-inch-wide, about 0.25-inch thick, fits in groove of outgoing mail door.

Upper outgoing mail door 17, about 14.00-inches-high by about 10.00-inches-wide, about 0.50-inch-thick to insert outgoing mail from rear of unit (FIG. 11). Door is secured with pegs 17B (FIG. 7, 11), that are about are about 0.25-inch in diameter by about 4.50-inches-long, pre-formed holes for pegs are formed into upper section of rear panel 2, (FIG. 11), made from sort of plastic, metal, fabricated material or some sort of environmentally friendly material.

Pegs 17B, resized, pegs are inserted into peg sleeves 17C, (FIG. 6B), either square or circular, allowing for opening/closing of incoming/outgoing mail door, outgoing mail door, and lower secure door (FIG. 12,13). Pegs are about 0.25-inch in diameter and about 4.50-inches long. Made from some sort of plastic, metal, wood, fabricated material or some sort of environmentally friendly material.

Peg chamber 17C, either square or circular, about 0.25-inch in diameter by about 2.00-inches-deep, chambers are formed/molded into panels 1, 2, (FIGS. 6, 12, 13). Made from plastic, wood, metal, fabricated material or some sort of environmentally friendly material.

Lower rear secure door, 18, about 16.00-inch-high by about 20.00-inch-wide, about 0.50-inch-thick, attaches through pre-formed holes in lower panel 2, secured with pegs 17B (FIG. 13), that are about 0.25-inch in diameter by about 4.50-inches-long. Made from sort of plastic, metal, fabricated material or some sort of environmentally friendly material.

Key security mount, 18A, about 2.00-inches-by 2.00-inches-square/round in diameter that secures the rear lower secure door.

Key system 18B, standard key to lock and unlock lower secure door.

Manufacturing ID, 18C, about 1.00-inch-high letters, raised about 0.25-inch-thick, molded in lower secure door to identity month, year of manufacturing.

Vertical handle 18J, about 14.00-inch-long by about 1.00-inch-wide, made from sort of plastic, metal, fabricated material or some sort of environmentally friendly material, attached with standard screws that is about 1.00-inch-long, attaches where pre-drilled holes are indicated (FIG. 13C).

Covered awning, 19, about 22.00-inches-long by about 2.00-inches-wide, 0.50-inch-thick, sloped on about a 45°-degrees, molded into back of panel 2. Made from sort of plastic, metal, fabricated material or some sort of environmentally friendly material.

Magnet 20, about 0.25-inch-wide by about 1.00-inch-long, fits into molded grooves of mailbox.

FIG. 13B: Pegs 17B, resized, pegs are inserted into peg sleeves 17C, (FIG. 6B), either square or circular, allowing for opening/closing of incoming/outgoing mail door, outgoing mail door, and lower secure door (FIG. 12,13). Pegs are about 0.25-inch in diameter and about 4.50-inches long. Made from some sort of plastic, metal, wood, fabricated material or some sort of environmentally friendly material.

Lower rear secure door, 18, about 16.00-inch-high by about 20.00-inch-wide, about 0.50-inch-thick, attaches through pre-formed holes in lower panel 2, secured with pegs 17B (FIG. 13), that are about 0.25-inch in diameter by about 4.50-inches-long. Made from sort of plastic, metal, fabricated material or some sort of environmentally friendly material.

Key security mount, 18A, about 2.00-inches-by 2.00-inches-square/round in diameter that secures the rear lower secure door.

Key system 18B, standard key to lock and unlock lower secure door.

Manufacturing ID, 18C, about 1.00-inch-high letters, raised about 0.25-inch-thick, molded in lower secure door to identity month, year of manufacturing.

Vertical handle 18J, about 22.00-inch-long by about 1.00-inch-wide, made from sort of plastic, metal, fabricated material or some sort of environmentally friendly material, attached with standard screws that is about 1.00-inch-long, attaches where pre-drilled holes are indicated (FIG. 13C).

FIG. 13C: Pegs 17B, resized, pegs are inserted into peg sleeves 17C, (FIG. 6B), either square or circular, allowing for opening/closing of incoming/outgoing mail door, outgoing mail door, and lower secure door (FIG. 12,13). Pegs are about 0.25-inch in diameter and about 4.50-inches long. Made from some sort of plastic, metal, wood, fabricated material or some sort of environmentally friendly material.

Lower rear secure door, 18, about 16.00-inch-high by about 20.00-inch-wide, about 0.50-inch-thick, attaches through pre-formed holes in lower panel 2, secured with pegs 17B (FIG. 13), that are about 0.25-inch in diameter by about 4.50-inches-long. Made from sort of plastic, metal, fabricated material or some sort of environmentally friendly material.

Trim 18E, about 19.00-inch-high by 15.00-inch-wide by about 0.25-inch thick, fits into groove of lower rear secure door.

Swing arm 18F, about 2.00-inch-wide by about 3.00-inch-long to lock/unlock secure area.

Rear mount 18G, about 2.00-inches round in diameter, made from some sort of plastic, metal, fabricated material or some sort of environmentally friendly material.

Standard screw, 18H, about 1.00-inch-long screw for securing mount to rear lower secure door.

Pre-drilled holes 18I, for attaching vertical handle to the lower secure door.

FIG. 14: Depicts two views of "Safe "4U" Mailbox" with interlocking connectors used to construct multi-units of "Safe 4U mailbox" consisting of:

FIG. 14A: Front panel 1, about 55.00-inches-high by about 26.00-inches-wide. All Panels are internally trimmed down from 1.00-inch to 0.50-inch to create interlocking panels 2, 3, 4, 5, and 5A, which are created from some sort of plastic, metal, fabricated material or some sort of environmentally friendly material. Front panel has a name plate for homeowner name 8, adhesive backed letter display name 8A, decorative emblem 9, held together with some sort of heavy-duty adhesive, the front panel has cut-out/molded compartment for attaching pull-down incoming/outgoing mail door 12, Formed into incoming/outgoing door are raised lettering indicating U.S. Mail 12A, Raised lettering indicating Approved by the Postmaster General 12B, Raised lettering indicating incoming mail compartment 12C, raised lettering indicating outgoing mail compartment 12D, Horizontal handle 12E.

Top panel 5, about 28.00-inches-wide by about 27.00-inches-long, and about 2.00-inches-thick, trimmed down from the inside from 1.00-inch to 0.50-inch, top panel has about a 15°-degree curved edge for rain or snow to runoff. Top panel has a 0.25-inch cosmetic seam line at the 1.00-inch mark to give the illusion of two pieces, Address holder attaches to top panel 6. Top panel, address holder is created from some sort of plastic, metal, fabricated material or some sort of environmentally friendly material. Top panel interlocks with panels 1, 2, 3, 4, that are internally trimmed down on the inside from 1.00-inch to 0.50-inch to create interlocking panels (FIG. 8).

Interlocking baseplate 5A, about 28.00-inches-wide by about 27.00-inches-long, and about 2.00-inches-thick, trimmed down from the inside from 1.00-inch to 0.50-inch, baseplate has about a 15°-degree curved edge for rain or snow to runoff. Created from some sort of plastic, metal, fabricated material or some sort of environmentally friendly material. Base plate interlocks with panels 1, 2, 3, 4, that are internally trimmed down on the inside from 1.00-inch to 0.50-inch to create interlocking panels (FIG. 8).

Address holder 6, attaches to top panel 5, about 6-inches-long on front and right side, by about 1-inch-high, about 0.50-inches-thick. Address holder fits into molded circular holes on top panel 5, (FIG. 5A). Adhesive backed numbers used on market are about 0.50-inch-high by 0.50-inch-wide. Address holder is made from some sort of plastic, metal, fabricated material or some sort of environmentally friendly material and secured with some sort of adhesive.

Flag 7, mounted on the side of right panel (FIG. 4), flag is about 10.00-inches-high, made from sort of plastic, metal, fabricated material or some sort of environmentally friendly material. Top portion of flag has about a 2.00-inches-high by 2.00-inches-wide square when raised.

Flag mount 7A, mount is conventional 2.00-inch by 2.00-inch-square, (FIG. 4), screw for mount is about 1.00-inch-long.

Homeowners' nameplate 8, about 20.00-inches-long by about 2.00-inches-wide, about 2.00-inches-high, and about 0.50-inch-thick. Holding up to about (18) 1.00-inch by 1.00-inch adhesive backed letters for displaying homeowners' last name 8A, if desired. Nameplate may be expanded with some sort of expanders/s-hooks if homeowner desires for additional names. Nameplate is made from some sort of plastic, metal, fabricated material or some sort of environmentally friendly material, secured with some sort of heavy-duty adhesive, expanders/s-hooks are market items.

Design element 9, about 17.00-inches-high by 11.00-inches-wide, for homeowners to personalization front of unit with computer generated, adhesive backed design elements ranging from sports, gardening, automobiles, arts, etc. if they like that are, made from some sort of plastic film that is weather resistant.

Newspaper/advertisement attachment 11, about 8.00-inches-high by about 8.00-inches-wide, about 12.00-inches-long, and about 0.50-inch-thick, molded into panel 3 (FIG. 3). Top portion of the newspapers/advertisement has lettering identifying slot 11A. Made from sort of plastic, metal, fabricated material or some sort of environmentally friendly material.

Incoming/outgoing mailbox door 12, Incoming/outgoing door is about 24-inches-wide, about 14.00-inches-high, and about 0.50-inch-thick, and is a pull-down door. Door is attached to upper front panel of the "Safe "4U" Mailbox" with pegs 17B (FIG. 6B). Formed into incoming/outgoing door are raised lettering indicating U.S. Mail 12A, letters are about 1.00-inch-high, about 0.25-inch-thick. Raised lettering indicating Approved by the Postmaster General 12B, about 0.50-inches-high and about 0.25-inch-thick. Raised lettering indicating incoming mail slot 12C, about 1.00-inch-high and about 0.25-inch-thick. Raised lettering indicating outgoing mail slot 12D, about 1.00-inch-high and about 0.25-inch-thick, door is made from sort of plastic, metal, fabricated material or some sort of environmentally friendly material.

Horizontal handle 12E, about 22.00-inches-long by about 1.00-inch-wide. Handle is made from sort of plastic, metal, fabricated material or some sort of environmentally friendly material. Attaches with standard screws that is about 1.00-inch-long, attaches where pre-drilled holes are indicated (FIG. 6B, 7).

Interlocking hinges 13, resized, hinges attach to sides of panels 3, 4, (FIG. 3, 4), of "Safe "4U" Mailbox", about 8.00-inches-wide by 1.00-inch-high, 0.50-inch-thick, for creating interlocking parts for multi-units. Interlocking hinges are located near the top and bottom of mailbox, either glued/screwed, made from sort of plastic, metal, fabricated material or some sort of environmentally friendly material.

FIG. 14B: Front panel 1, about 55.00-inches-high by about 26.00-inches-wide. All Panels are internally trimmed down from 1.00-inch to 0.50-inch to create interlocking panels 2, 3, 4, 5, and 5A, which are created from some sort of plastic, metal, fabricated material or some sort of environmentally friendly material. Front panel has a name plate for homeowner name 8, adhesive backed letter display name 8A, decorative emblem 9, held together with some sort of heavy-duty adhesive, the front panel has cut-out/molded compartment for attaching pull-down incoming/outgoing mail door 12, Formed into incoming/outgoing door are raised lettering indicating U.S. Mail 12A, Raised lettering indicating Approved by the Postmaster General 12B, Raised lettering indicating incoming mail compartment 12C, raised lettering indicating outgoing mail compartment 12D, Horizontal handle 12E.

Top panel 5, about 28.00-inches-wide by about 27.00-inches-long, and about 2.00-inches-thick, trimmed down from the inside from 1.00-inch to 0.50-inch, top panel has about a 15°-degree curved edge for rain or snow to runoff. Top panel has a 0.25-inch cosmetic seam line at the 1.00-inch mark to give the illusion of two pieces, Address holder attaches to top panel 6. Top panel, address holder is created from some sort of plastic, metal, fabricated material or some sort of environmentally friendly material. Top panel interlocks with panels 1, 2, 3, 4, that are internally trimmed down on the inside from 1.00-inch to 0.50-inch to create interlocking panels (FIG. 8).

Interlocking baseplate 5A, about 28.00-inches-wide by about 27.00-inches-long, and about 2.00-inches-thick, trimmed down from the inside from 1.00-inch to 0.50-inch, baseplate has about a 15°-degree curved edge for rain or snow to runoff. Created from some sort of plastic, metal, fabricated material or some sort of environmentally friendly material. Base plate interlocks with panels 1, 2, 3, 4, that are internally trimmed down on the inside from 1.00-inch to 0.50-inch to create interlocking panels (FIG. 8).

Address holder 6, attaches to top panel 5, about 6-inches-long on front and right side, by about 1-inch-high, about 0.50-inches-thick. Address holder fits into molded circular holes on top panel 5, (FIG. 5A). Adhesive backed numbers used on market are about 0.50-inch-high by 0.50-inch-wide. Address holder is made from some sort of plastic, metal, fabricated material or some sort of environmentally friendly material and secured with some sort of adhesive.

Flag 7, mounted on the side of right panel (FIG. 4), flag is about 10.00-inches-high, made from sort of plastic, metal, fabricated material or some sort of environmentally friendly material. Top portion of flag has about a 2.00-inches-high by 2.00-inches-wide square when raised.

Flag mount 7A, mount is conventional 2.00-inch by 2.00-inch-square, (FIG. 4), screw for mount is about 1.00-inch-long.

Homeowners' nameplate 8, about 20.00-inches-long by about 2.00-inches-wide, about 2.00-inches-high, and about 0.50-inch-thick. Holding up to about (18) 1.00-inch by 1.00-inch adhesive backed letters for displaying homeowners' last name 8A, if desired. Nameplate may be expanded with some sort of expanders/s-hooks if homeowner desires for additional names. Nameplate is made from some sort of plastic, metal, fabricated material or some sort of environmentally friendly material, secured with some sort of heavy-duty adhesive, expanders/s-hooks are market items.

Design element 9, about 17.00-inches-high by 11.00-inches-wide, for homeowners to personalization front of unit with computer generated, adhesive backed design elements ranging from sports, gardening, automobiles, arts, etc. if they like that are, made from some sort of plastic film that is weather resistant.

Reflectors 10, adhesive backed reflectors come in varies colors and attach to right panel 4, (FIG. 4), reflectors are between 4.00-inches-high, 2.00-inches-wide, either circular or square.

Newspaper/advertisement attachment 11, about 8.00-inches-high by about 8.00-inches-wide, about 12.00-inches-long, and about 0.50-inch-thick, molded into panel 3 (FIG. 3). Top portion of the newspapers/advertisement has lettering identifying slot 11A. Made from sort of plastic, metal, fabricated material or some sort of environmentally friendly material.

Incoming/outgoing mailbox door 12, Incoming/outgoing door is about 24-inches-wide, about 14.00-inches-high, and about 0.50-inch-thick, and is a pull-down door. Door is attached to upper front panel of the "Safe "4U" Mailbox" with pegs 17B (FIG. 6B). Formed into incoming/outgoing door are raised lettering indicating U.S. Mail 12A, letters are about 1.00-inch-high, about 0.25-inch-thick. Raised lettering indicating Approved by the Postmaster General 12B, about 0.50-inches-high and about 0.25-inch-thick. Raised lettering indicating incoming mail slot 12C, about 1.00-inch-high and about 0.25-inch-thick. Raised lettering indicating outgoing mail slot 12D, about 1.00-inch-high and about 0.25-inch-thick, door is made from sort of plastic, metal, fabricated material or some sort of environmentally friendly material.

Horizontal handle 12E, about 22.00-inches-long by about 1.00-inch-wide. Handle is made from sort of plastic, metal, fabricated material or some sort of environmentally friendly material. Attaches with standard screws that is about 1.00-inch-long, attaches where pre-drilled holes are indicated (FIG. 6B, 7).

Interlocking hinges 13, hinges attach to sides of panels 3, 4, (FIG. 3, 4), of "Safe "4U" Mailbox", about 8.00-inches-wide by 1.00-inch-high, 0.50-inch-thick, for creating interlocking parts for multi-units. Interlocking hinges are located near the top and bottom of mailbox, either glued/screwed, made from sort of plastic, metal, fabricated material or some sort of environmentally friendly material.

Figure 15:
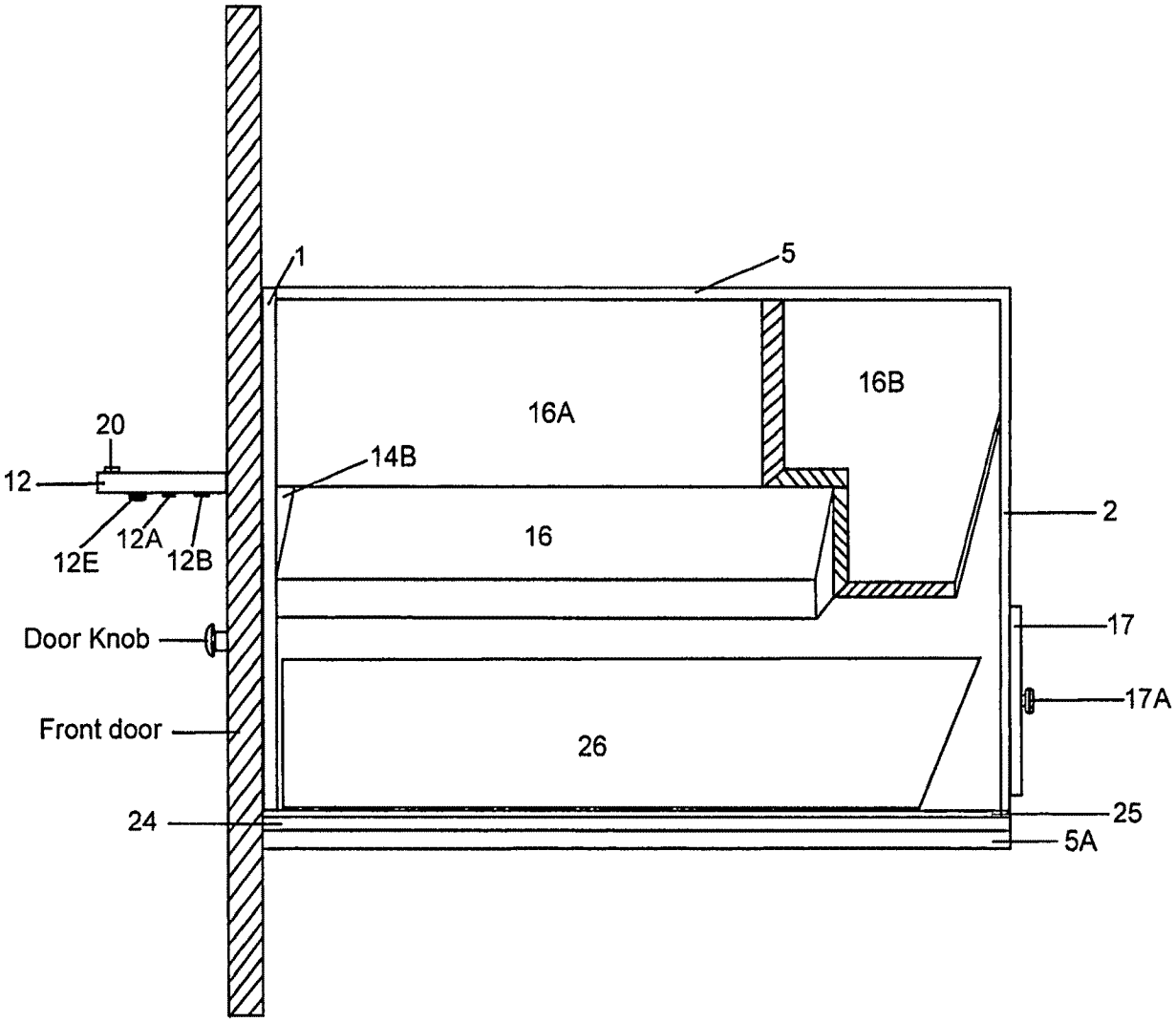
FIG. 15: Residential view of "Safe 4U Mailbox"; Front interlocking panel (1), Rear interlocking panel (2), Interlocking top panel (5), Interlocking base plate (5A), Sideview of incoming/outgoing mail door (12), Sideview of lettering on door indicating U.S. Mail (12A), Sideview of lettering for Approved by the Postmaster General (12B), Sideview of horizontal handle (12E), Lip of incoming mail compartment (14B), Angled chute (16), Inside panel on incoming mail compartment (16A), Bumper board (16B), Rear upper mail door (17), Rear upper mail door knob (17A), Magnet (20), Peg board (24), Railing system (25), Basket (26).

FIG. 15: Depicts resized cross section of residential "Safe "4U" Mailbox" without panels 3,4, shown consisting of:

Front panel 1, resized, attaches to back of resident's door, resized, about 13.00-inches-high by about 13.00-inches-wide, about 1.00-inches-thick. Panel has cut-out/molded compartment for incoming mail 14A. All Panels are internally trimmed down from the inside from 1.00-inch to 0.50-inch to create interlocking panels 2, 3, 4, 5, and 5A, made from some sort of plastic, metal, fabricated material or some sort of environmentally friendly material. Held together with some sort of heavy-duty adhesive and secured with some sort of tamper resistance screws, threaded screws, fasteners, bolts, and/or rivets, 23 (FIG. 5C, 8), which are about 1.00-inch-long.

Rear panel 2, resized, about 13.00-inches-high by about 13.00-inches-wide, about 1.00-inches-thick. Panel has cut-out/molded compartment for removing mail 15. All Panels are internally trimmed down from the inside from 1.00-inch to 0.50-inch to create interlocking panels with 1, 3, 4, 5 and 5A, made from some sort of plastic, metal, fabricated material or some sort of environmentally friendly material. Held together with some sort of heavy-duty adhesive and secured with some sort of tamper resistance screws, threaded screws, fasteners, bolts, and/or rivets, 23 (FIG. 5C, 8), which are about 1.00-inch-long.

Top panel 5, resized, about 14.00-inches-wide by about 14.00-inches-long, about 1.00-inches-thick, trimmed down from the inside from 1.00-inch to 0.50-inch, made from some sort of plastic, metal, fabricated material or some sort of environmentally friendly material. Top panel interlocks with panels 1, 2, 3, 4, that are internally trimmed down on the inside from 1.00-inch to 0.50-inch to create interlocking panels (FIG. 8). Interlocking baseplate 5A, resized, about 14.00-inches-wide by about 14.00-inches-long, and about 1.00-inches-thick, trimmed down from the inside from 1.00-inch to 0.50-inch, made from some sort of plastic, metal, fabricated material or some sort of environmentally friendly material. Top panel interlocks with panels 1, 2, 3, 4, that are internally trimmed down on the inside from 1.00-inch to 0.50-inch to create interlocking panels (FIG. 8).

Sideview of incoming/outgoing mailbox door 12, resized, about 14-inches-wide, about 14.00-inches-high, and about 0.50-inch-thick, and is a pull-down door. Door is attached to upper front panel of the "Safe "4U" Mailbox" with pegs 17B (FIG. 6B). Formed into incoming/outgoing door are raised lettering indicating U.S. Mail 12A, letters are about 1.00-inch-high, about 0.25-inch-thick. Raised lettering indicating Approved by the Postmaster General 12B, about 0.50-inches-high and about 0.25-inch-thick. Door is made from sort of plastic, metal, fabricated material or some sort of environmentally friendly material.

Side view of horizontal handle 12E, resized, about 12.00-inches-long by about 1.00-inch-wide. Handle is made from sort of plastic, metal, fabricated material or some sort of environmentally friendly material. Attaches with standard screws that is about 1.00-inch-long, attaches where pre-drilled holes are indicated (FIG. 6B, 7).

Sideview of incoming mailbox lip 14B, resized, about 13.00-inch-long by 1.00-inch-wide, about 0.25-inch-thick to guild/slide incoming mail/small packages into secure area.

Sideview of angled chute 16, resized, about 12.00-inch-long, about 2.00-inch-wide, on about a 45°-degree angle, for guiding mail/small packages into awaiting basket 26.

Sideview of side wall of incoming compartment 16A, resized, about 13.00-inch-high by 12.00-inch-long, about 0.25-inch-thick, angle chute 16, is formed/molded into side wall for guiding mail/small packages into awaiting basket 26.

Sideview of bumper board 16B, resized, about 13.00-inch-high by about 13.00-inch-in wide, about 1-inch deep, about 0.25-inch-thick, for guiding mail/small packages into awaiting basket 26, (FIG. 8).

Sideview of residential outgoing mail door 17, resized, universal part, about 12.00-inches-high by about 12.00-inches-wide, about 0.50-inch-thick to retrieve incoming mail from rear of unit (FIG. 11). Door is secured with pegs 17B (FIG. 7, 11), that are about are about 0.25-inch in diameter by about 4.50-inches-long, pre-formed holes for pegs are formed into upper section of rear panel 2, (FIG. 11), made from sort of plastic, metal, fabricated material or some sort of environmentally friendly material.

Upper outgoing mail door knob 17A, about 2.00-inches by 2.00-inches round in diameter, attached with standard screw where pre-drilled hole is indicated 17D (FIG. 6B, 9, 12). Made from sort of plastic, metal, fabricated material or some sort of environmentally friendly material.

Sideview of magnet 20, about 0.25-inch-wide by about 1.00-inch-long, fits into molded grooves of mailbox.

Peg board 24, resized, about 12.00-inch-long by about 12.00-inch-wide, about 0.50-inch-thick, about 0.25-inch-circular cutout holes throughout 27 (FIG. 10). Made from sort of plastic, metal, fabricated material or some sort of environmentally friendly material.

Sideview of railing system 25, resized, about 12.00-inches-long by 1.00-inch-wide, two rails are mounted about 5.00-inches apart on peg board 24, rollers are inserted into rails and are about 0.25-inch-thick, for basket to glide in/out when retrieving incoming mail/small packages. Made from sort of plastic, metal, fabricated material or some sort of environmentally friendly material.

Sideview of basket 26, resized, about 12.00-inch-long by about 12.00-inch-wide, about 12.00-inch-deep for retrieving incoming mail/small packages. Made from sort of plastic, metal, fabricated material or some sort of environmentally friendly material.

FIG. 16: Depicts views of "Safe "4U" Mailbox" used in apartment complexes/new sub-divisions/condos with internal section consisting of:

FIG. 16A: Front panel 1, resized, about 42.00-inches-high by about 14.00-inches-wide. Front panel has three cut-out/molded compartments for attaching incoming mail pull-down door 12, All Panels are internally trimmed down from the inside from 1.00-inch to 0.50-inch to create interlocking panels 2, 3, 4, 5, and 5A, made from some sort of plastic, metal, fabricated material or some sort of environmentally friendly material.

Top panel 5, resized about 15.00-inches-wide by about 15.00-inches-long, and about 2.00-inches-thick, trimmed down from the inside from 1.00-inch to 0.50-inch, top panel has about a 15°-degree curved edge for rain or snow to runoff. Top panel has a 0.25-inch cosmetic seam line at the 1.00-inch mark to give the illusion of two pieces, top panel interlocks with panels 1, 2, 3, 4, that are internally trimmed down on the inside from 1.00-inch to 0.50-inch to create interlocking panels (FIG. 8), made from some sort of plastic, metal, fabricated material or some sort of environmentally friendly material.

Interlocking baseplate 5A, resized, about 15.00-inches-wide by about 15.00-inches-long, and about 2.00-inches-thick, trimmed down from the inside from 1.00-inch to 0.50-inch, baseplate has about a 15°-degree curved edge for rain or snow to runoff. Base plate interlocks with panels 1, 2, 3, 4, that are internally trimmed down on the inside from 1.00-inch to 0.50-inch to create interlocking panels (FIG. 8). Made from some sort of plastic, metal, fabricated material or some sort of environmentally friendly material.

Address holder 6, universal part, attaches to top panel 5, about 6-inches-long on front and right side, by about 1-inch-high, about 0.50-inches-thick. Address holder fits into molded circular holes on top panel 5, (FIG. 5A). Adhesive backed numbers used on market are about 0.50-inch-high by 0.50-inch-wide to identify complex building number. Address holder is made from some sort of plastic, metal, fabricated material or some sort of environmentally friendly material and secured with some sort of adhesive.

Incoming mailbox door 12, resized, about 12-inches-wide, about 12.00-inches-high, and about 0.50-inch-thick, and is a pull-down door. Door is attached to upper front panel of the "Safe "4U" Mailbox" with pegs 17B (FIG. 6B). Formed into incoming/outgoing door are raised lettering indicating U.S. Mail 12A, letters are about 1.00-inch-high, about 0.25-inch-thick. Raised lettering indicating Approved by the Postmaster General 12B, about 0.50-inches-high and about 0.25-inch-thick. Door is made from sort of plastic, metal, fabricated material or some sort of environmentally friendly material.

Horizontal handle 12E, resized, about 10.00-inches-long by about 1.00-inch-wide. Handle is made from sort of plastic, metal, fabricated material or some sort of environmentally friendly material. Attaches with standard screws that is about 1.00-inch-long, attaches where pre-drilled holes are indicated (FIG. 6B, 7).

Interlocking hinge 13, resized, hinges attach to sides of panels 3, 4, (FIG. 3, 4), of "Safe "4U" Mailbox" converted for apartment complexes/new sub-divisions/condos, about 1.00-inches-wide by 1.00-inch-high, about 0.50-inch-thick, for creating interlocking parts for multi-units. Interlocking hinges are located near the top and bottom of mailbox, either glued/screwed, made from sort of plastic, metal, fabricated material or some sort of environmentally friendly material.

Poles, 22, resized, about 1.00-inch-wide by about 24.00-inch-long, internal poles going into base of bottom mailbox is about 8.00-inch-long, remaining 16.00-inches go through cut-outs (FIG. 5B), and are buried into ground to secure unit.

Apartment complexes/new sub-divisions/condos 29, Adhesive backed numbers currently used on market today, about 0.50-inch-high by 0.50-inch-wide to identify apartment complexes/new sub-divisions/condos units.

FIG. 16B: Front panel 1, resized, about 42.00-inches-high by about 14.00-inches-wide. Front panel has three cut-out/molded compartments for attaching incoming mail pull-down door 12, All Panels are internally trimmed down from the inside from 1.00-inch to 0.50-inch to create interlocking panels 2, 3, 4, 5, and 5A, made from some sort of plastic, metal, fabricated material or some sort of environmentally friendly material.

Top panel 5, resized about 15.00-inches-wide by about 15.00-inches-long, and about 2.00-inches-thick, trimmed down from the inside from 1.00-inch to 0.50-inch, top panel has about a 15°-degree curved edge for rain or snow to runoff. Top panel has a 0.25-inch cosmetic seam line at the 1.00-inch mark to give the illusion of two pieces, top panel interlocks with panels 1, 2, 3, 4, that are internally trimmed down on the inside from 1.00-inch to 0.50-inch to create interlocking panels (FIG. 8), made from some sort of plastic, metal, fabricated material or some sort of environmentally friendly material.

Interlocking baseplate 5A, resized, about 15.00-inches-wide by about 15.00-inches-long, and about 2.00-inches-thick, trimmed down from the inside from 1.00-inch to 0.50-inch, baseplate has about a 15°-degree curved edge for rain or snow to runoff. Base plate interlocks with panels 1, 2, 3, 4, that are internally trimmed down on the inside from 1.00-inch to 0.50-inch to create interlocking panels (FIG. 8). Made from some sort of plastic, metal, fabricated material or some sort of environmentally friendly material.

Address holder 6, universal part, attaches to top panel 5, about 6-inches-long on front and right side, by about 1-inch-high, about 0.50-inches-thick. Address holder fits into molded circular holes on top panel 5, (FIG. 5A). Adhesive backed numbers used on market are about 0.50-inch-high by 0.50-inch-wide to identify complex building number. Address holder is made from some sort of plastic, metal, fabricated material or some sort of environmentally friendly material and secured with some sort of adhesive.

Incoming mailbox door 12, resized, about 12-inches-wide, about 12.00-inches-high, and about 0.50-inch-thick, and is a pull-down door. Door is attached to upper front panel of the "Safe "4U" Mailbox" with pegs 17B (FIG. 6B). Formed into incoming/outgoing door are raised lettering indicating U.S. Mail 12A, letters are about 1.00-inch-high, about 0.25-inch-thick. Raised lettering indicating Approved by the Postmaster General 12B, about 0.50-inches-high and about 0.25-inch-thick. Door is made from sort of plastic, metal, fabricated material or some sort of environmentally friendly material.

Horizontal handle 12E, resized, about 10.00-inches-long by about 1.00-inch-wide. Handle is made from sort of plastic, metal, fabricated material or some sort of environmentally friendly material. Attaches with standard screws that is about 1.00-inch-long, attaches where pre-drilled holes are indicated (FIG. 6B, 7).

Pre-drilled holes 12I, for attaching the horizontal handle to the incoming mailbox door. Trim 12J, about 11.00-inch-wide by 11.00-inch-high by about 0.25-inch thick, fits in groove of incoming/outgoing mail door.

Interlocking hinge 13, resized, hinges attach to sides of panels 3, 4, (FIG. 3, 4), of "Safe "4U" Mailbox", about 8.00-inches-wide by 1.00-inch-high, 0.50-inch-thick, for creating interlocking parts for multi-units. Interlocking hinges are located near the top and bottom of mailbox, either glued/screwed, made from sort of plastic, metal, fabricated material or some sort of environmentally friendly material.

Incoming mailbox chamber 14, resized, about 13.25-inch-high by about 13.25-inch-wide and about 0.50-inch-thick. Chamber is formed/molded into front panel 1, and rear panel 2, for which incoming mail compartment slides into chamber. Made from sort of plastic, metal, fabricated material or some sort of environmentally friendly material as one unit that's inserted into upper section of front panel.

Incoming mailbox compartment 14A, resized, about 13.00-inch-high by 13.00-inch-wide, about 0.25-inch-thick with opening at base for incoming mail/small packages to fall into a secure basket (FIG. 8) for pick-up.

Incoming mailbox lip 14B, resized, about 13.00-inch-long by 1.00-inch-wide, about 0.25-inch-thick to guild/slide incoming mail/small packages into secure area.

Angled chute 16, resized, about 12.00-inch-long, about 2.00-inch-wide, on about a 45°-degree angle, for guiding mail/small packages into awaiting basket 26.

Side wall of incoming compartment 16A, resized, about 13.00-inch-high by 13.00-inch-long, about 0.25-inch-thick, angle chute 16, is formed/molded into side wall for guiding mail/small packages into awaiting basket 26.

Bumper board 16B, resized, about 13.00-inch-high by about 13.00-inch-in wide, about 1-inch deep, about 0.25-inch-thick, for guiding mail/small packages into awaiting basket 26, (FIG. 8).

Magnet 20, about 0.25-inch-wide by about 1.00-inch-long, fits into molded grooves of mailbox.

Couplings 21, about 1.25-inch-round by about 1.00-inch-deep, secured with adhesive to pegboard 24, made from sort of plastic, metal, fabricated material or some sort of environmentally friendly material.

Poles, 22, resized, about 1.00-inch-wide by about 24.00-inch-long, internal poles going into base of bottom mailbox is about 8.00-inch-long, remaining 16.00-inches go through cut-outs (FIG. 5B), and are buried into ground to secure unit.

FIG. 16C: Sideview of Front panel 1, resized, about 42.00-inches-high by about 14.00-inches-wide. Front panel has three cut-out/molded compartments for attaching incoming mail pull-down door 12, All Panels are internally trimmed down from the inside from 1.00-inch to 0.50-inch to create interlocking panels 2, 3, 4, 5, and 5A, made from some sort of plastic, metal, fabricated material or some sort of environmentally friendly material.

Sideview of Rear panel 2, resized, about 13.00-inches-high by about 13.00-inches-wide. Panel has one cut-out/molded compartments for removing mail 17. All Panels are internally trimmed down from the inside from 1.00-inch to 0.50-inch to create interlocking panels with 1, 3, 4, 5 and 5A, made from some sort of plastic, metal, fabricated material or some sort of environmentally friendly material. Held together with some sort of heavy-duty adhesive and secured with some sort of tamper resistance screws, threaded screws, fasteners, bolts, and/or rivets, 23 (FIG. 5C, 8), which are about 1.00-inch-long.

Sideview of Top panel 5, resized about 15.00-inches-wide by about 15.00-inches-long, and about 2.00-inches-thick, trimmed down from the inside from 1.00-inch to 0.50-inch, top panel has about a 15°-degree curved edge for rain or snow to runoff. Top panel has a 0.25-inch cosmetic seam line at the 1.00-inch mark to give the illusion of two pieces, top panel interlocks with panels 1, 2, 3, 4, that are internally trimmed down on the inside from 1.00-inch to 0.50-inch to create interlocking panels (FIG. 8), made from some sort of plastic, metal, fabricated material or some sort of environmentally friendly material.

Sideview of Interlocking baseplate 5A, resized, about 15.00-inches-wide by about 15.00-inches-long, and about 2.00-inches-thick, trimmed down from the inside from 1.00-inch to 0.50-inch, baseplate has about a 15°-degree curved edge for rain or snow to runoff. Base plate interlocks with panels 1, 2, 3, 4, that are internally trimmed down on the inside from 1.00-inch to 0.50-inch to create interlocking panels (FIG. 8). Made from some sort of plastic, metal, fabricated material or some sort of environmentally friendly material.

Sideview of Incoming mailbox door 12, resized, about 12-inches-wide, about 12.00-inches-high, and about 0.50-inch-thick, and is a pull-down door. Door is attached to upper front panel of the "Safe "4U" Mailbox" with pegs 17B (FIG. 6B). Formed into incoming/outgoing door are raised lettering indicating U.S. Mail 12A, letters are about 1.00-inch-high, about 0.25-inch-thick. Raised lettering indicating Approved by the Postmaster General 12B, about 0.50-inches-high and about 0.25-inch-thick. Door is made from sort of plastic, metal, fabricated material or some sort of environmentally friendly material.

Horizontal handle 12E, resized, about 10.00-inches-long by about 1.00-inch-wide. Handle is made from sort of plastic, metal, fabricated material or some sort of environmentally friendly material. Attaches with standard screws that is about 1.00-inch-long, attaches where pre-drilled holes are indicated (FIG. 6B, 7).

Sideview of incoming mailbox lip 14B, resized, about 13.00-inch-long by 1.00-inch-wide, about 0.25-inch-thick to guild/slide incoming mail/small packages into secure area.

Sideview of angled chute 16, resized, about 12.00-inch-long, about 2.00-inch-wide, on about a 45°-degree angle, for guiding mail/small packages into awaiting basket 26.

Side wall of incoming compartment 16A, resized, about 13.00-inch-high by 14.00-inch-long, about 0.25-inch-thick, angle chute 16, is formed/molded into side wall for guiding mail/small packages into awaiting basket 26.

Sideview of bumper board 16B, resized, about 13.00-inch-high by about 13.00-inch-in wide, about 1-inch deep, about 0.25-inch-thick, for guiding mail/small packages into awaiting basket 26, (FIG. 8).

Sideview of lower rear secure door, 18, resized, universal part, about 12.00-inch-high by about 12.00-inch-wide, about 0.50-inch-thick, attaches through pre-formed holes in lower panel 2, secured with pegs 17B (FIG. 13), that are about 0.25-inch in diameter by about 4.50-inches-long. Made from sort of plastic, metal, fabricated material or some sort of environmentally friendly material.

Sideview of vertical handle 18J, resized, about 10.00-inch-long by about 1.00-inch-wide, made from sort of plastic, metal, fabricated material or some sort of environmentally friendly material, attached with standard screws that is about 1.00-inch-long, attaches where pre-drilled holes are indicated (FIG. 13C).

Sideview of magnet 20, about 0.25-inch-wide by about 1.00-inch-long, fits into molded grooves of mailbox.

Sideview of couplings 21, about 1.25-inch-round by about 1.00-inch-deep, secured with adhesive to pegboard 24, made from sort of plastic, metal, fabricated material or some sort of environmentally friendly material.

Poles, 22, resized, about 1.00-inch-wide by about 24.00-inch-long, internal poles going into base of bottom mailbox is about 8.00-inch-long, remaining 16.00-inches go through cut-outs (FIG. 5B), and are buried into ground to secure unit.

Sideview of peg board 24, resized, about 12.00-inch-long by about 12.00-inch-wide, about 0.50-inch-thick, about 0.25-inch-circular cutout holes throughout 27 (FIG. 10). Made from sort of plastic, metal, fabricated material or some sort of environmentally friendly material.

Sideview of railing system 25, resized, about 12.00-inches-long by 1.00-inch-wide, two rails are mounted about 5.00-inches apart on peg board 24, rollers are inserted into rails and are about 0.25-inch-thick, for basket to glide in/out when retrieving incoming mail/small packages. Made from sort of plastic, metal, fabricated material or some sort of environmentally friendly material.

Sideview of basket 26, resized, about 12.00-inch-long by about 12.00-inch-wide, about 12.00-inch-deep for retrieving incoming mail/small packages. Made from sort of plastic, metal, fabricated material or some sort of environmentally friendly material.

Apartment complexes/new sub-divisions/condos 29, Adhesive backed numbers currently used on market today, about 0.50-inch-high by 0.50-inch-wide to identify apartment complexes/new sub-divisions/condos units.

I claim:

1. A security mailbox comprising:

front, back, left, right, top, and base panels defining an enclosure;

said base panel has four circular cut-outs for internal poles therethrough, wherein said poles extend through the base panel and are cemented into the ground for securing the mailbox;

four circular plastic seals cooperate with said cut-outs of said base panel and said poles to keep out moisture and small bugs;

said front panel has a pull-down door to expose an incoming mail compartment;

a bumper board is positioned in a rear of said incoming mail compartment to help mail fall into a lower secure area;

an address holder is on said top panel;

a flag and associated mount assembly are attached to said left or right panel;

said rear panel has two doors including an upper door for inserting outgoing mail into an outgoing mail compartment by the homeowner from the rear the mailbox for pick-up by the postal worker, and a lower secure door with a key lock assembly for retrieving incoming mail and small packages from said lower secure area; and an internal basket receives the incoming mail and small packages via a mail chute, wherein said basket sits upon a railing system that slides in and out of said enclosure, and wherein said railing system is attached on a peg board fixed within the enclosure.

2. The security mailbox according to claim 1, further comprises a name plate attached to said front panel.

3. The security mailbox according to claim 1, further comprises side reflectors attached to said left or right panel.

4. The security mailbox according to claim 1, further comprises an adhesive design element attached to said front panel.

5. The security mailbox according to claim 1, further comprises an awning attachment on said rear panel above said lower secure door to protect said key lock assembly from rain/snow run-off.

6. The security mailbox according to claim 1, further comprises door handles/knob for opening/closing said pull-down door, said upper door, and said lower secure door.

7. The security mailbox according to claim 1, further comprises of a sleeve on said left or right panel for receiving newspaper/advertisements.

* * * * *